US012435529B2

(12) United States Patent
Cordell et al.

(10) Patent No.: US 12,435,529 B2
(45) Date of Patent: Oct. 7, 2025

(54) HEADBOARD CONFIGURATION

(71) Applicant: Hilton International Holding LLC, McLean, VA (US)

(72) Inventors: Phil Cordell, McLean, VA (US); Jennifer McCardell, McLean, VA (US); Barry Sullivan, McLean, VA (US); Kenny Pyron, McLean, VA (US); Joseph Sencen, McLean, VA (US); Tom Horwitz, McLean, VA (US); Rachael Leson, McLean, VA (US); Adrianne Korczynski, McLean, VA (US); Kelli Fellers, McLean, VA (US)

(73) Assignee: Hilton International Holding LLC, McLean, VA (US)

( * ) Notice: Subject to any disclaimer, the term of this patent is extended or adjusted under 35 U.S.C. 154(b) by 199 days.

(21) Appl. No.: 17/758,602

(22) PCT Filed: Jan. 14, 2021

(86) PCT No.: PCT/US2021/013434
§ 371 (c)(1),
(2) Date: Jul. 11, 2022

(87) PCT Pub. No.: WO2021/146421
PCT Pub. Date: Jul. 22, 2021

(65) Prior Publication Data

US 2023/0046903 A1 Feb. 16, 2023

Related U.S. Application Data

(60) Provisional application No. 62/961,477, filed on Jan. 15, 2020.

(51) Int. Cl.

| | |
|---|---|
| ***E04H 3/02*** | (2006.01) |
| ***A47C 19/02*** | (2006.01) |
| ***A47C 21/00*** | (2006.01) |

(52) U.S. Cl.
CPC ..... *E04H 3/02* (2013.01); *A47C 19/022* (2013.01); *A47C 21/00* (2013.01); *A47C 21/003* (2013.01)

(58) Field of Classification Search
CPC ..... E04H 3/02; A47C 19/022; A47C 21/00; A47C 21/003
See application file for complete search history.

(56) References Cited

U.S. PATENT DOCUMENTS 2,672,624 A * 3/1954 Giuseffi ..... A47C 17/50 5/2.1
2,770,813 A * 11/1956 Marzillier ..... A47C 17/46 5/503.1

(Continued)

FOREIGN PATENT DOCUMENTS

ES 2 631 278 8/2017

OTHER PUBLICATIONS

English abstract to ES 2 631 278 published Aug. 30, 2017.

(Continued)

*Primary Examiner* — Omar F Hijaz
(74) *Attorney, Agent, or Firm* — DLA Piper LLP (US)

(57) ABSTRACT

A headboard is disclosed herein. The headboard includes: multiple back panels connected together to frame a mattress, each back panel capable of being separated from the other back panels and capable of being individually covered and/or replaced; and a wing panel on each side of the back panels, each wing panel tilted inward towards the mattress, and each wing panel capable of being individually covered and/or replaced.

11 Claims, 67 Drawing Sheets

(56) References Cited

U.S. PATENT DOCUMENTS

| | | | | | |
|---|---|---|---|---|---|
| 3,596,297 | A | * | 8/1971 | James | A47B 85/00 5/2.1 |
| 3,921,345 | A | * | 11/1975 | Damico | A47B 79/00 52/28 |
| 4,631,881 | A | * | 12/1986 | Charman | H02G 3/288 174/495 |
| D336,572 | S | * | 6/1993 | Gunderson | D6/718.14 |
| D358,269 | S | * | 5/1995 | Korch | D6/718.14 |
| 5,790,994 | A | * | 8/1998 | Leonard | A47C 19/005 5/183 |
| 6,128,875 | A | | 10/2000 | Quaintance | |
| 6,256,936 | B1 | | 7/2001 | Swensson et al. | |
| 6,691,475 | B1 | | 2/2004 | Tiongco et al. | |
| 6,694,566 | B1 | * | 2/2004 | Mockett | H02G 3/083 174/152 G |
| D493,975 | S | * | 8/2004 | Juneau | D6/393 |
| 7,681,259 | B2 | * | 3/2010 | Jin | A47C 19/022 5/183 |
| D639,578 | S | * | 6/2011 | Dordoni | D6/393 |
| 8,522,488 | B1 | * | 9/2013 | Newkirk | A61G 12/005 52/387 |
| 10,036,172 | B1 | | 7/2018 | Baker | |
| 2014/0096461 | A1 | | 4/2014 | McLoughlin et al. | |
| 2015/0052832 | A1 | | 2/2015 | McLoughlin et al. | |
| 2015/0308136 | A1 | | 10/2015 | Kuechenmeister et al. | |

OTHER PUBLICATIONS

Written Opinion cited in Application No. PCT/US21/13434 dated May 25, 2021.

International Search Report cited in Application No. PCT/US21/13434 dated May 25, 2021.

* cited by examiner (3) PART TEMPO HEADBOARD SYSTEM (2) SIDE WING PANELS AND (1) CENTER UPHOLSTERY

SIDE WING PANEL AND CLEATED PANEL

UPHOLSTERED
PANEL REMOVAL

INTEGRATED OUTLETS

CENTER FRAME AND UPHOLSTERED PANELS.
OPENING BELOW TOP OF MATTRESS

Welf Small Wall Shelf

This simple steel shelf turns any spare wall space into a minimal and attractive storage solution. Pair with the Welf Felt Shelf Pad to create the perfect landing spot for keys, specs and loose change. Available in small and large sizes.

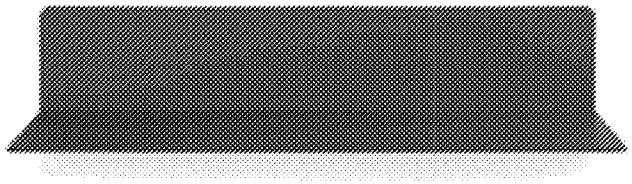

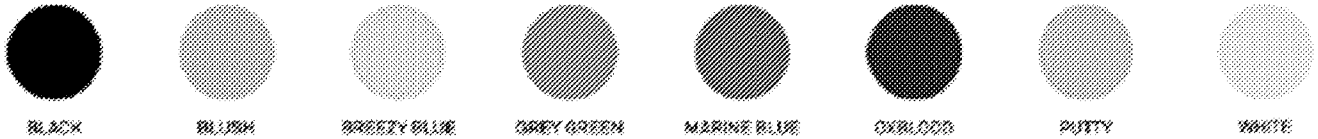

Materials

- Powder coated steel
- Includes simple mounting screws, anchors or hardware required
- Sizes vary overhead

| | |
|---|---|
| WF1-SHLFSM-BK | BLACK |
| WF1-SHLFSM-BH | BLUSH |
| WF1-SHLFSM-BL | BREEZY BLUE |
| WF1-SHLFSM-GR | GREY GREEN |
| WF1-SHLFSM-MB | MARINE BLUE |
| WF1-SHLFSM-OX | OXBLOOD |
| WF1-SHLFSM-PT | PUTTY |
| WF1-SHLFSM-WH | WHITE |

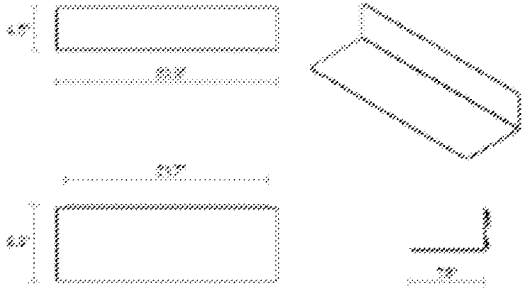

Figure 8E

HEADBOARD CONFIGURATION

CROSS-REFERENCE TO RELATED APPLICATION

This application is a U.S. National Stage Application of International Application No. PCT/US2021/013434 filed Jan. 14, 2021, which claims priority from Provisional Patent Application No. 62/961,477 filed Jan. 15, 2020. The entirety of all the above-listed applications are incorporated herein by reference.

ROOM CONFIGURATION

In the following description, various aspects of the present disclosure will be described. For purposes of explanation, specific configurations and details are set forth in order to provide a thorough understanding of the aspects of the disclosure. However, it will also be apparent to one skilled in the art that the present invention may be practiced without the specific details mentioned or with other details not mentioned. Thus, for example, well-known features may be omitted or simplified.

In accordance with aspects of the disclosure, a hotel room configuration is provided. The hotel room can be divided into multiple zones, including a power down zone, a get ready zone, or a bath suite zone, or any combination thereof. While a hotel room configuration is described, it should be noted that this room configuration can be used outside of a hotel setting.

Figure 1A:
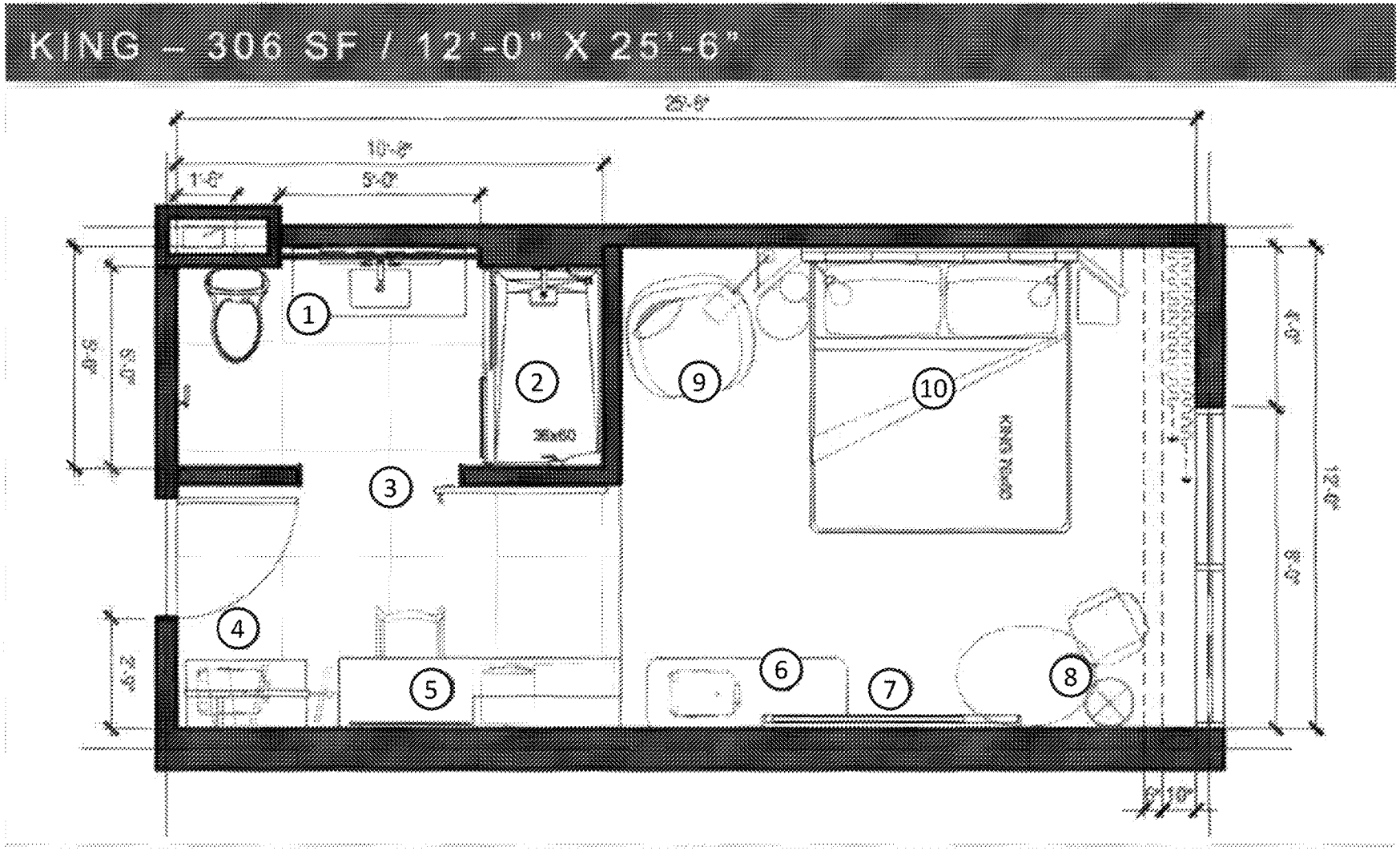
FIG. 1A-1B, FIG. 2 and FIG. 3A-3D illustrate example hotel room configurations, according to aspects of the disclosure.
Figure 1B:
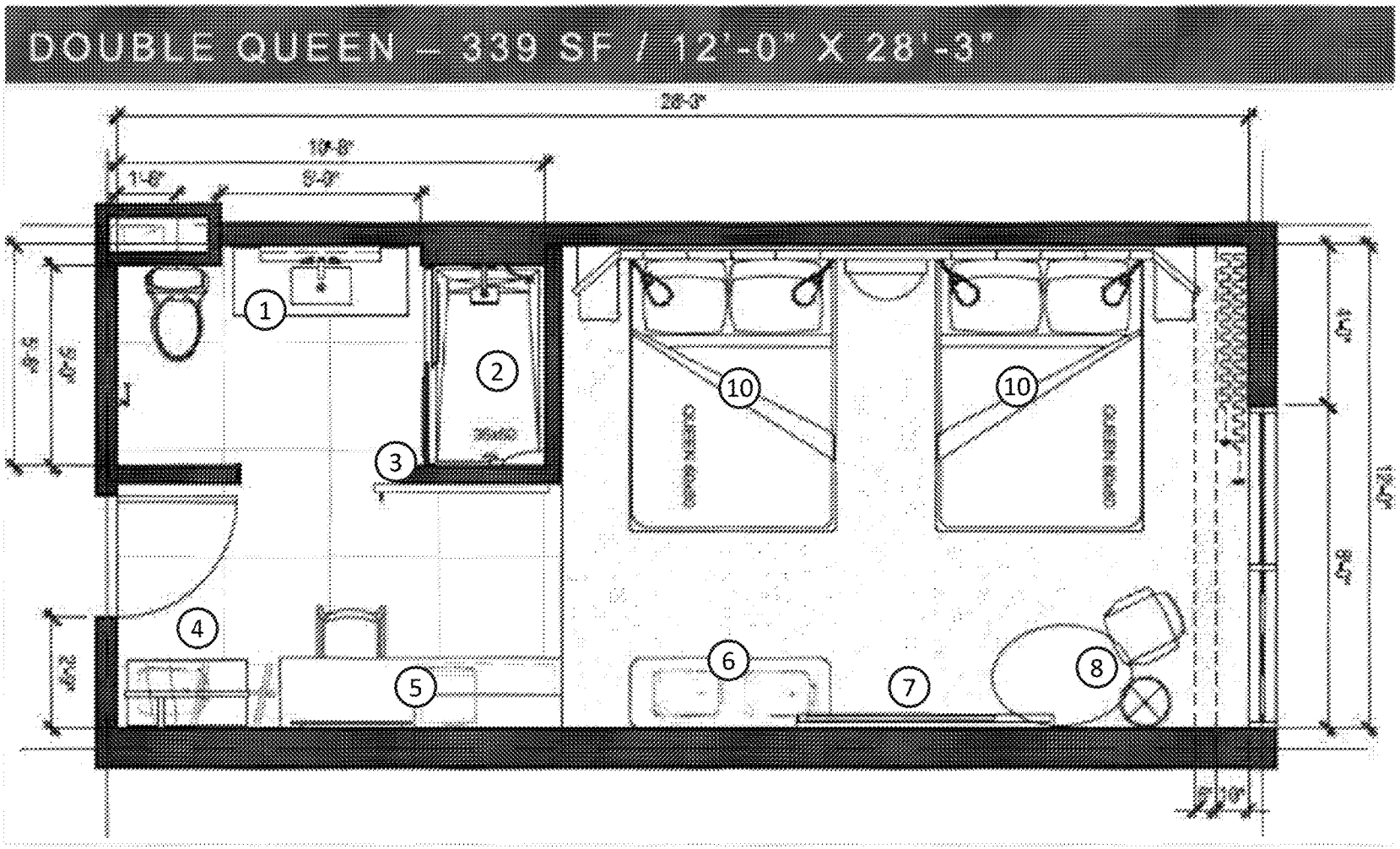

FIGS. 1A and 1B illustrate two example hotel room configurations that can re-image a room to help guests start and end the day at their best. FIG. 1A illustrates a first example hotel room that is a one-bed (e.g., king bed, queen bed) room. In this example, the hotel room can be approximately 300 square feet (e.g., 12 feet by 25 feet), although those of ordinary skill in the art will see that any size room can be used. FIG. 1B illustrates a two bed (e.g., two queen beds, two double beds) hotel room configuration. The hotel rooms shown in FIGS. 1A and 1B can include a power down zone (which may also be referred to as a "sleeping zone"), bath suite zone, or get ready zone, or any combination thereof.

The power down zone of the one bed configuration can include a bed 10 (e.g., with an enveloping headboard with easy access to lighting and/or power), a desk chair and/or table and/or lamp 8 (e.g., an oval table with a desk chair and a floor lamp), a bench 6 (e.g., an upholstered for storage and/or lounging), or a lounge chair 9 (e.g., oversized and/or comfortable), or television 7 (e.g., a wall-mounted television with, e.g., digital art and/or sound-absorbing panels), or any combination thereof. The sleep zone of the two-bed configuration can be similar to the one-bed configuration, except two beds can be included. FIGS. 1A and 1B show example room measurements, but those of ordinary skill in the art will see that many other room measurements can be used. (Some example measurements are 12' wide×25½' for a king room; 12'×28¼' for double queen room.)

The bath suite zone can be spacious and/or bright to help guests recharge and renew. The bath suite zone layout can have a residential feel and can be larger than average. The bath suite zone can have intuitive controls. The bath suite zone can include a vanity 1 with a mirror (e.g., an illuminated mirror), a shower and/or a bath 2 (e.g., a shower with a fixed and/or hand-held shower head), or a toilet, or any combination thereof. The shower and/or bath area can be a large area. For example, in an approximately 300 square foot one-bed room, or an approximately 340 square foot two-bed room, the shower and/or bath can be approximately 36 inches by 60 inches. The shower can include a fixed and/or hand-held shower head. The shower and/or bath suite zone can be separated from the get ready zone by a door 3. For example, a barn door can be used such that it slides (e.g., in order to maximize space available in the bath suite zone and/or the get ready zone) to cover part of the wall that separates the bath suite zone from the get ready zone. The barn door can have a mirror (e.g., a full length mirror that covers an entire face of the door, a mirror that covers part of the door) on the side of the door facing the get ready zone, and/or the side of the door facing the bath suite zone.

The get ready zone can be a multi-functional space that can be used for grooming (e.g., with appropriate space and/or electric outlets for shaving, hair drying and/or styling, make-up application), exercise (e.g., with appropriate space for exercise (e.g., yoga, stretching, push-ups, etc.) and exercise equipment (e.g., a mat, etc.), work (e.g., with appropriate space and/or electric outlets to accommodate a phone, a computer, writing material, presentation preparation, etc.), or storage (e.g., unpack, organize, and/or pack clothes), or any combination thereof. The get ready zone can be clearly separated from the power down zone in that different flooring material can be used. (It should be noted that the term "material" as used within this document can comprise anything used to make something, such as wood, laminate, fabric, metal, plastic, tile, carpet, etc.) The get ready zone can also be clearly separated from the bath suite zone by walls and a door.

Figure 8A:
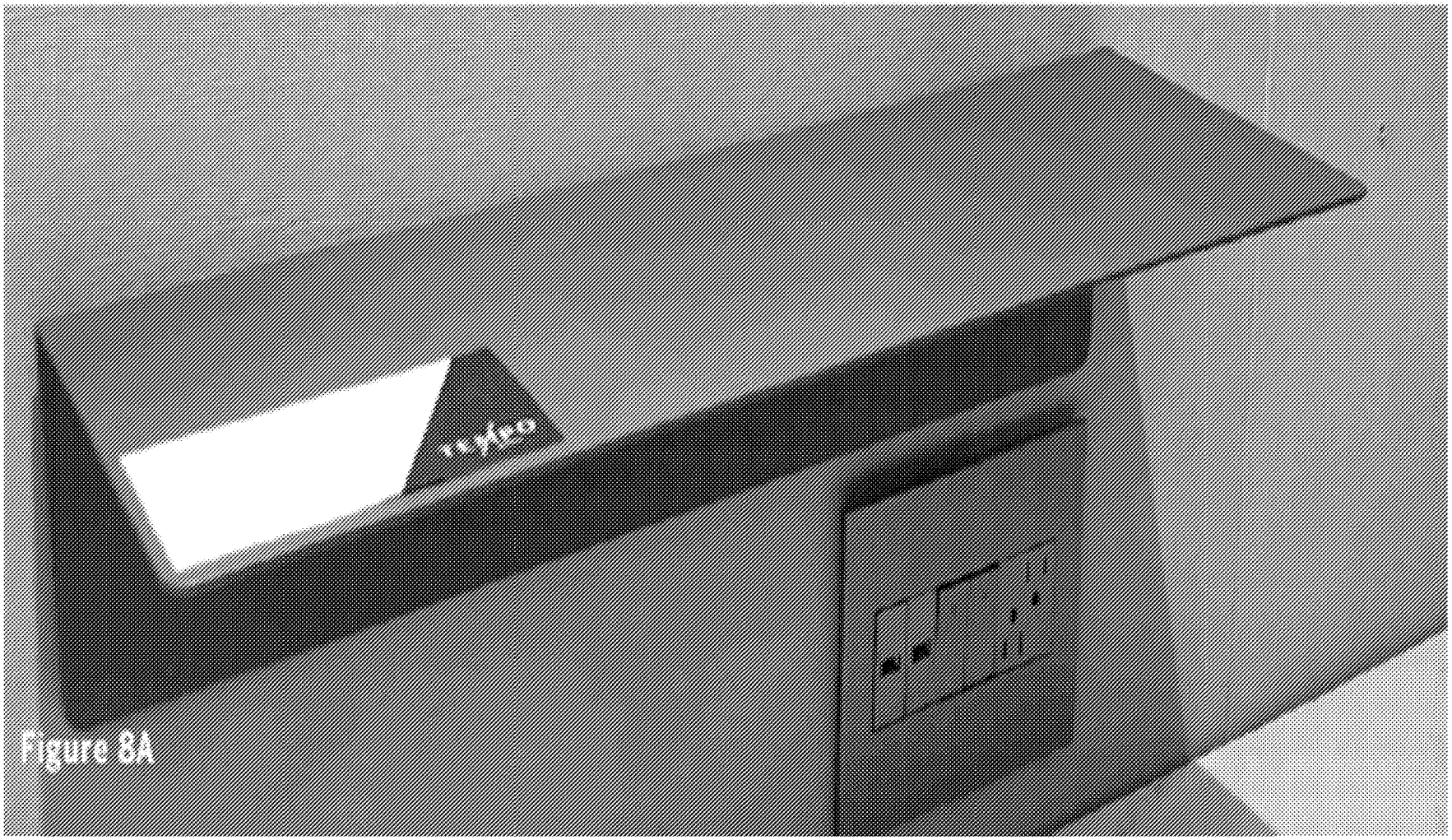
Figure 8B:
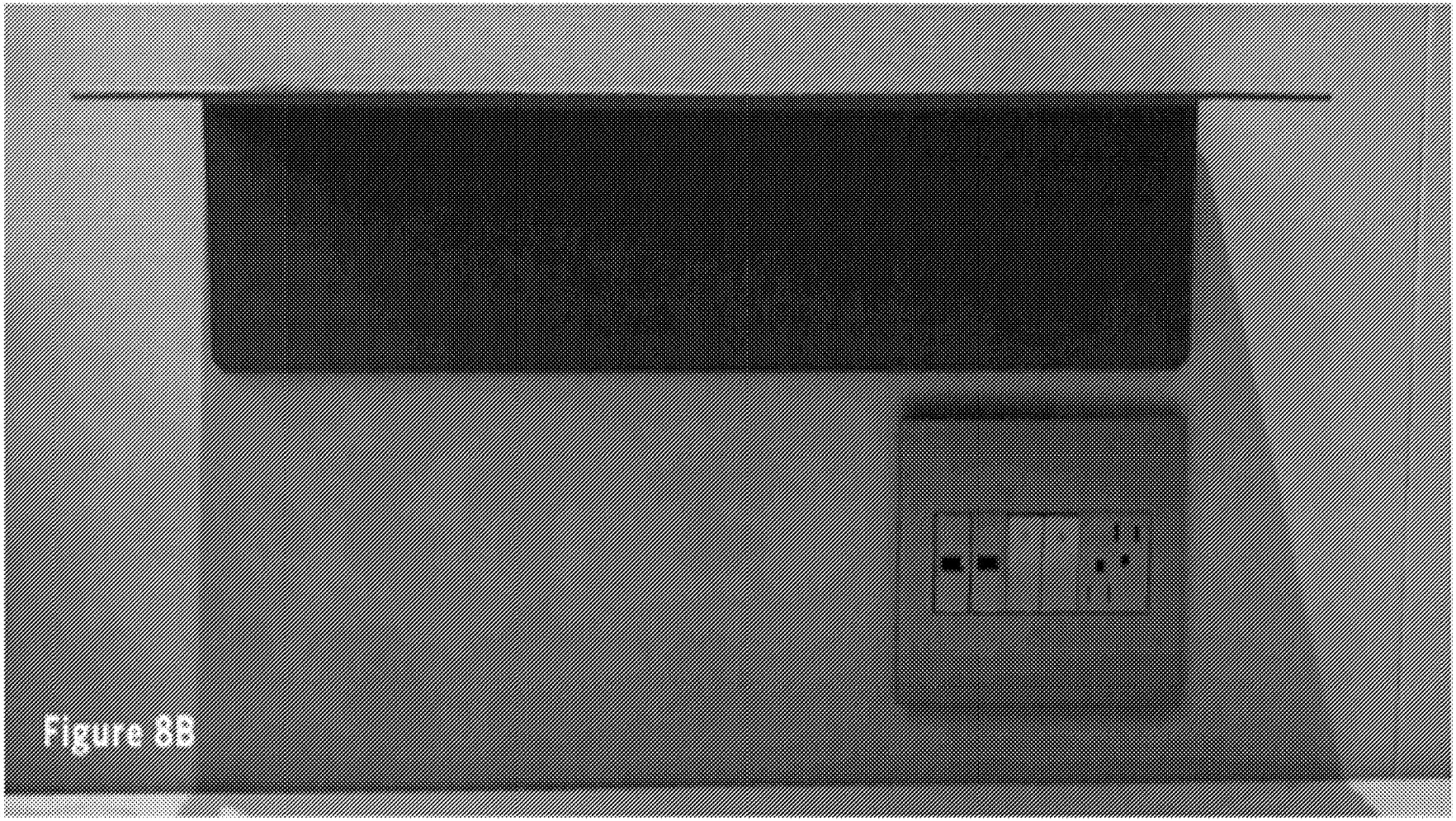
Figure 8C:
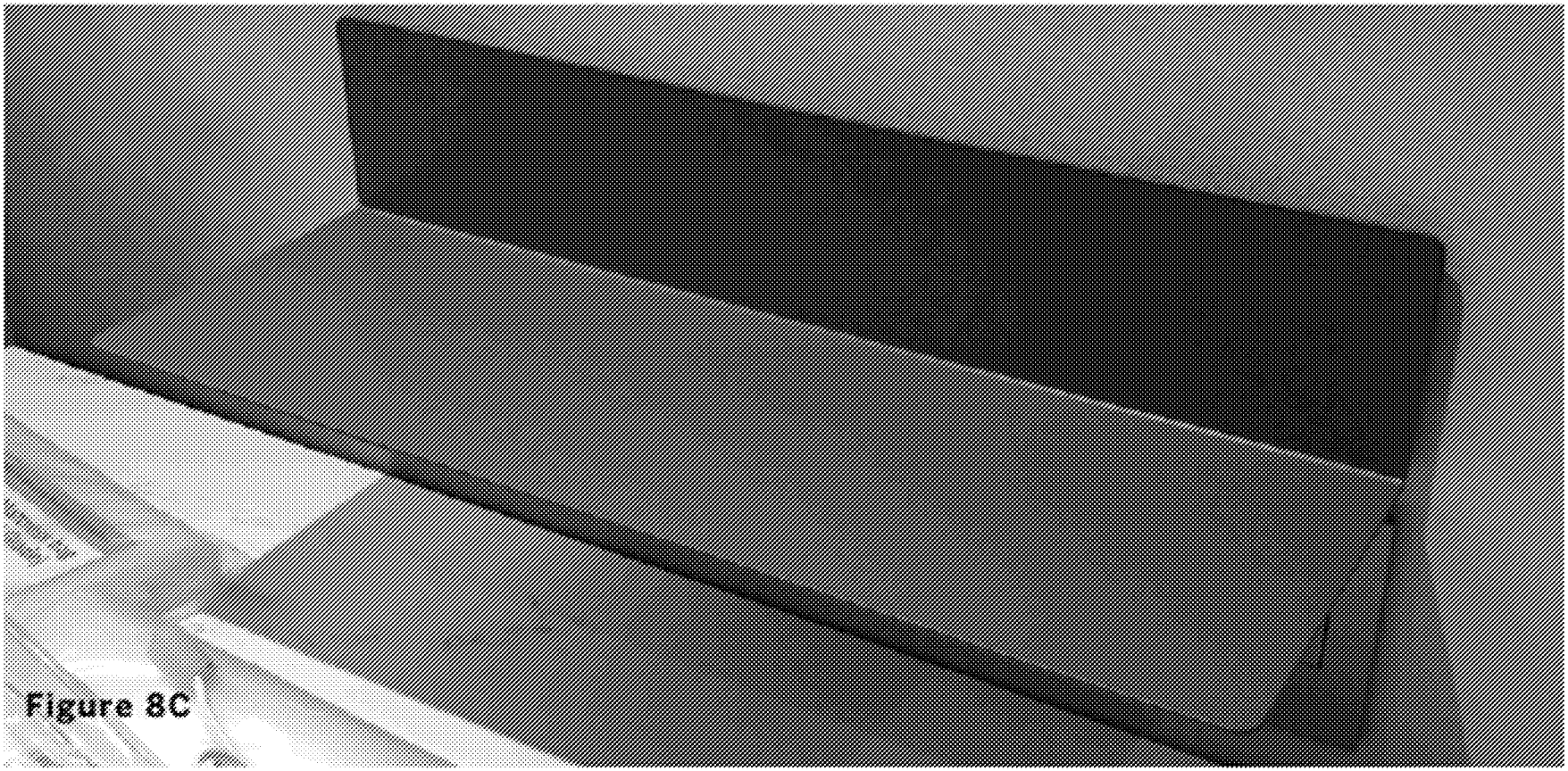
Figure 8D:
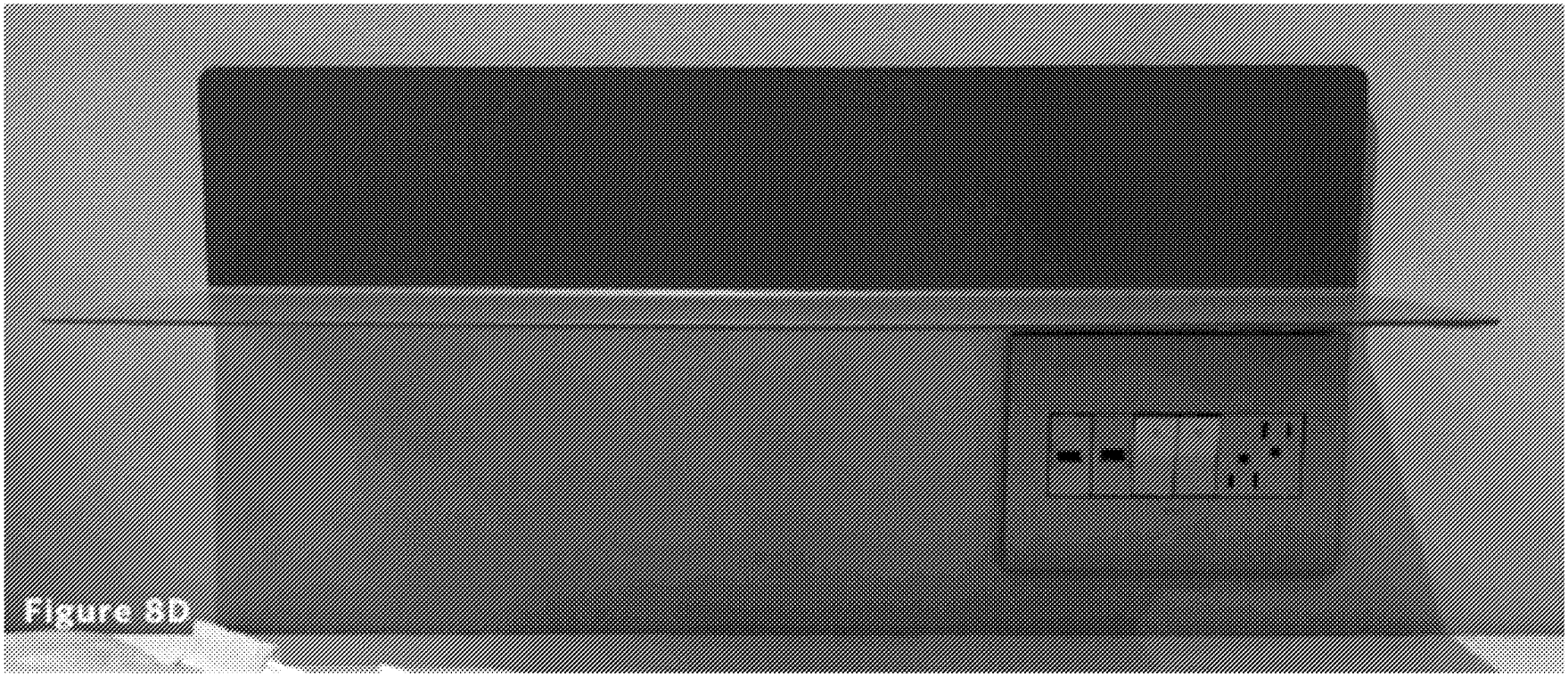

FIG. 1 illustrates the get ready zone. The get ready zone can include: an extended linear surface 5 (e.g., a desk) that can be used, for example, as a desk or grooming area. The get ready zone 5 can include an extended linear surface (e.g., with an illuminated mirror and/or a mini-fridge), and a space for: working, grooming, relaxing, or stretching, or any combination thereof. A shelf can be on, above, below, near, and/or incorporated into the extended linear surface 5. The shelf can be made of wood (or a wood laminate or a product made to look like wood), metal (e.g., powder coated steel), plastic, or any combination thereof. Those of ordinary skill in the art will see that the shelf can be made of many other types of material. The shelf can be used for: placement of cups or mugs, placement of a light (e.g., CASPER night light), placement of branded amenities (e.g., lotion, candy, etc.). FIG. 8A-8D illustrate various views of an example shelf. A power access component (e.g., plugs) can be used below or near the shelf. FIG. 8E illustrates details related to an example shelf called a WELF shelf. Note that any other type of shelf may also be used. A mirror (e.g., an illuminated mirror) can be above, near, on, and/or incorporated into the extended linear surface 5. A mini-fridge can be above, below, on, near and/or incorporated into the extended linear surface 5. The get ready zone can also include a closet 4 (e.g., an open closet) with hanging storage and a steamer and/or iron.

The get ready zone can have flooring material that is different than the flooring material of the power down zone and/or the bath suite zone. In some aspects of the disclosure, the get ready zone can have flooring material that is the same as the bath suite zone, but different than the power down zone. In some aspects of the disclosure, the get ready zone can have flooring material that is different from the flooring material of the bath suite zone and the power down zone (e.g., each zone can have flooring material different from the other zones). In some aspects of the disclosure, the power down zone, the bath suite zone, and the get ready zone can all have the same flooring material. The power down zone can have floor covering that is carpet (e.g., broadloom carpet and/or carpet tile, etc.), tile (e.g., porcelain and/or ceramic and/or stone and/or luxury vinyl tile), wood (e.g., or wood laminate and/or a material made to look like wood), or any combination thereof. Those of ordinary skill in the art will see that the floor covering can also be made of many other types of material. The bath suite zone and/or the get ready zone can have floor covering that can hold up under moisture and/or be resilient to moister. It can also be a material where a mat (e.g., an exercise mat such as a yoga mat) can be placed for exercise. For example, the bath suite zone can have a floor covering that is tile (e.g., porcelain and/or ceramic and/or stone and/or luxury vinyl tile, etc.) or wood (e.g., or wood laminate and/or a material made to look like wood). Having different floor covering between the zones can help delineate the zones from each other. Having the same floor covering in multiple zones can help make the zones seem bigger and connected.

Figure 9A:
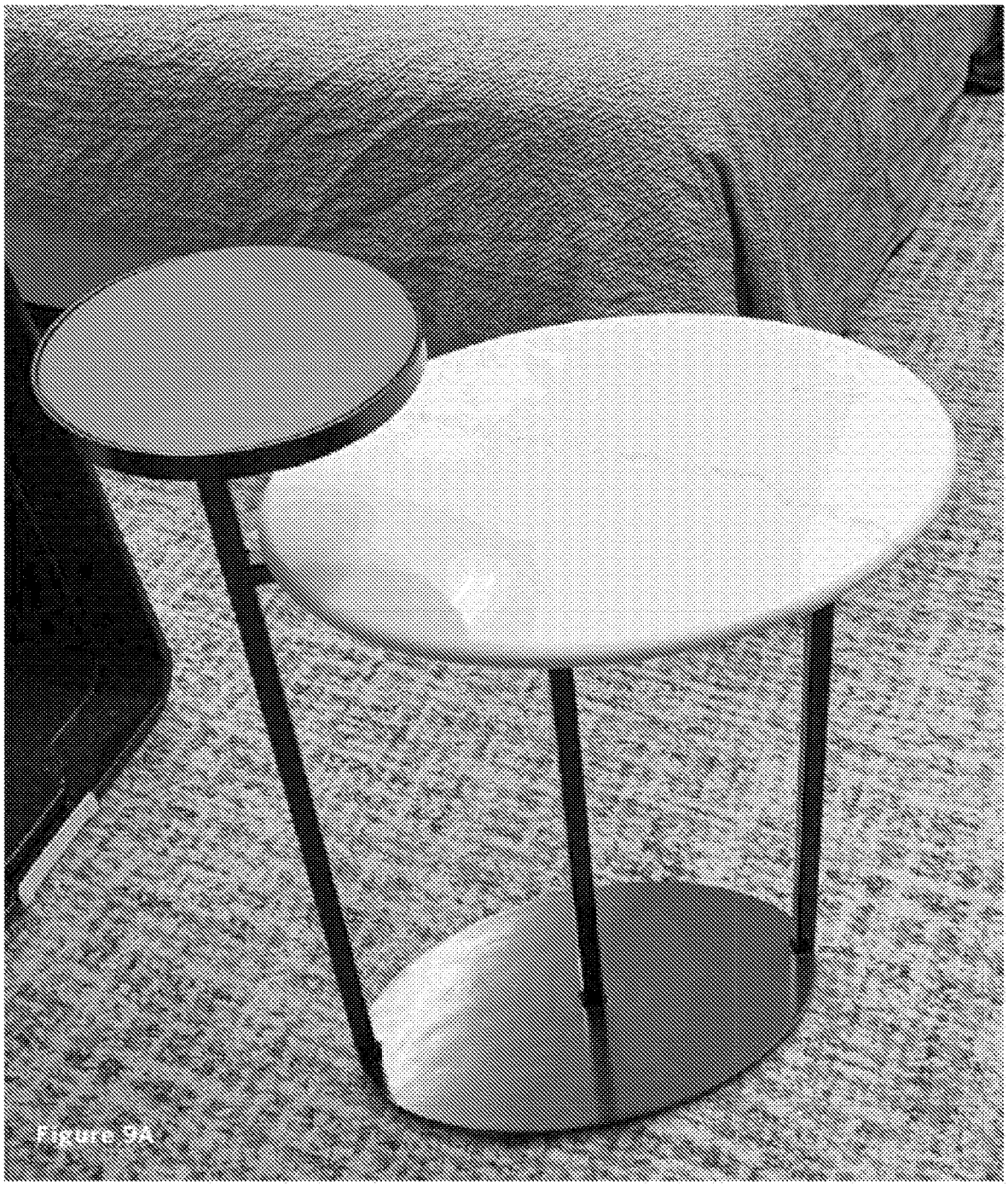
Figure 9B:
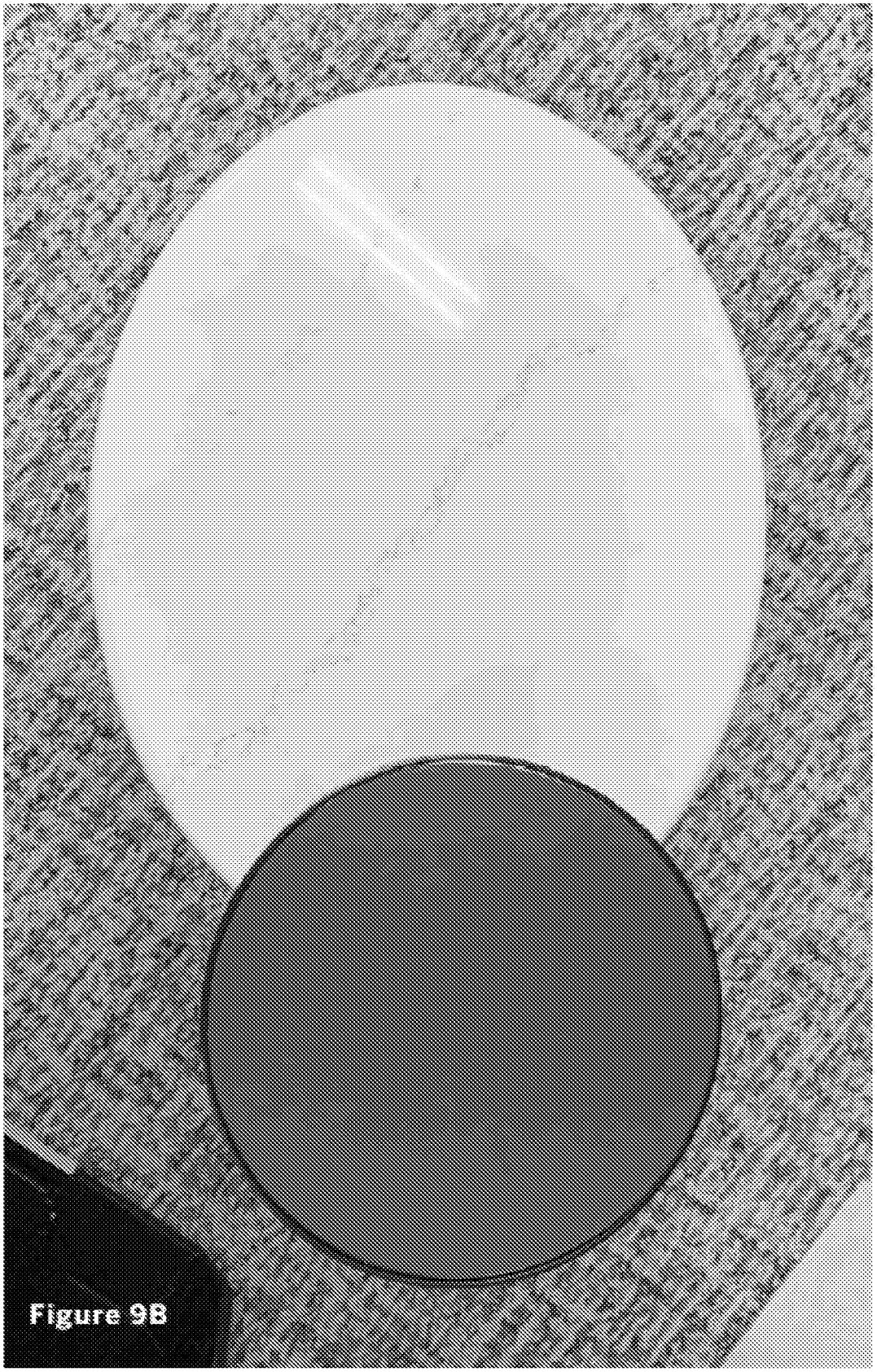
Figure 9C:
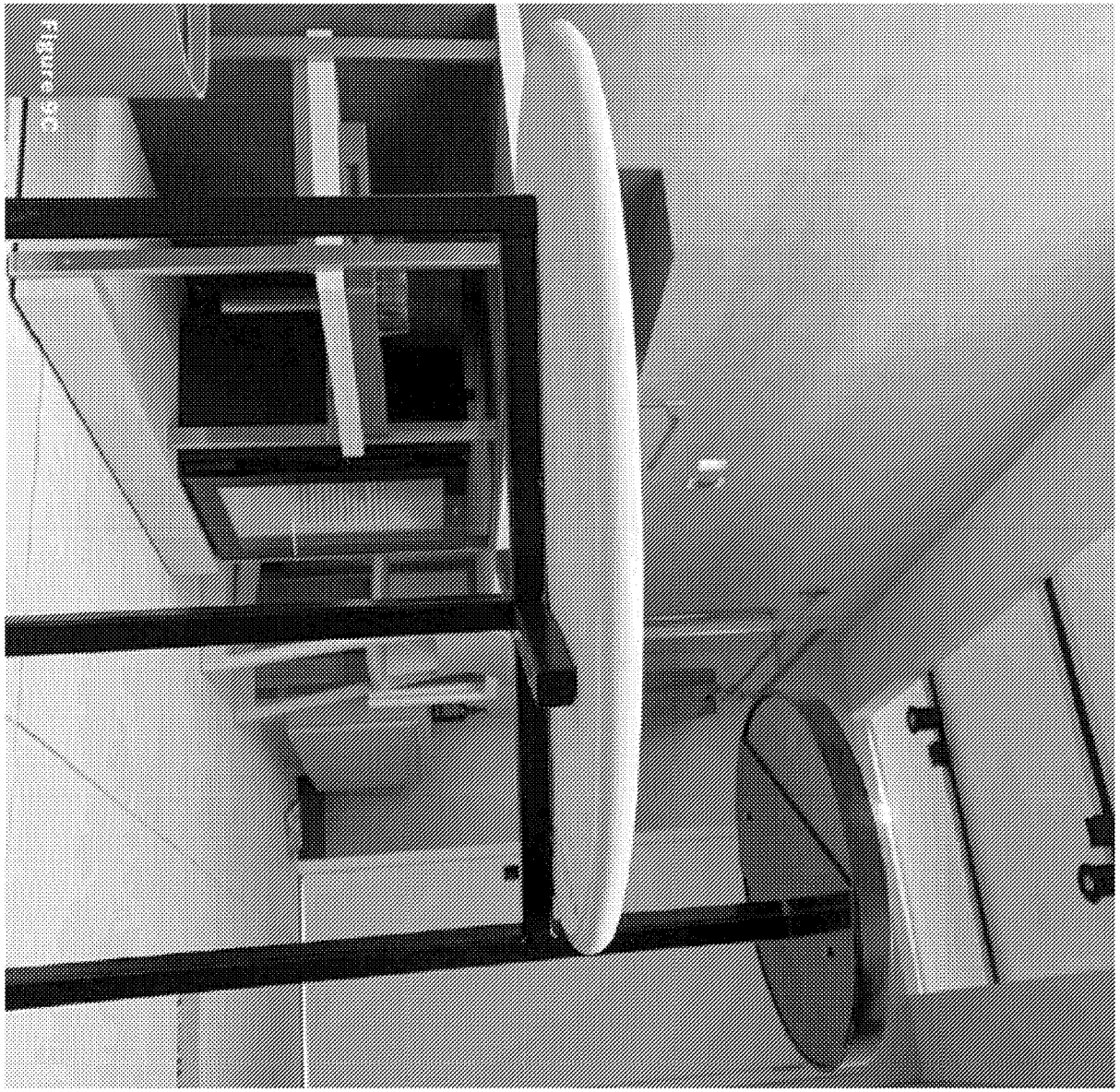

The power down zone can have a shelf and/or table near the bed. FIG. 9A-9C illustrates various views of an example power down table.

Figure 2:
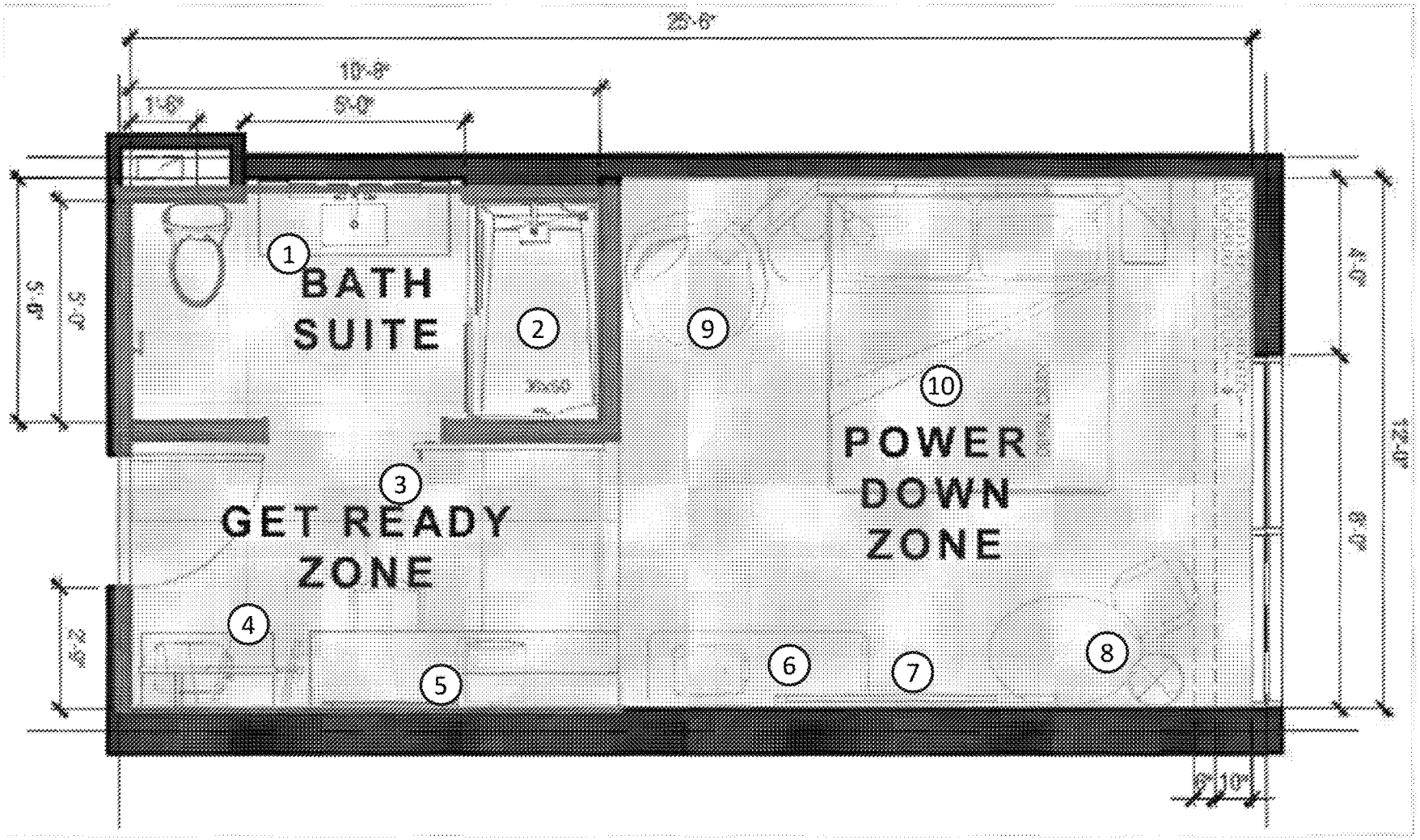

FIG. 2 illustrates another view of the one-bed configuration room and the bath suite zone, the get ready zone, and the power down zone. The bath suite zone can be larger than normal for a hotel room in a similar category, and can be, e.g., approximately 16%-25% of the room size. The shower and/or bath can also be larger than normal for a hotel room in a similar category, and can be, e.g., approximately 30% of the bath suite zone size. (For all the sizes provided in this document, note that these are only example sizes and that many other sizes may be used.)

The get ready zone can also be larger than normal for a hotel room in a similar category, and can be, e.g., approximately 16%-25% of the room size. This can be a multi-functional space where guests can do more (e.g., putting on make-up, grooming, practicing or giving work presentations or participating in meetings, organizing clothes, stretching).

The power down zone can be designed to help guests unwind, unplug, and get to sleep faster. The bed area of the power down zone can be a central command for lighting and power. A headboard can be used in the power down zone. For example, an enveloping headboard designed to "feel like a hug" can be included in the power down zone. Portable nightlight(s) and/or white noise machine(s) can be included in the power down zone. Mediation and soundbath videos can be shown in the power down zone.

Figure 3A:
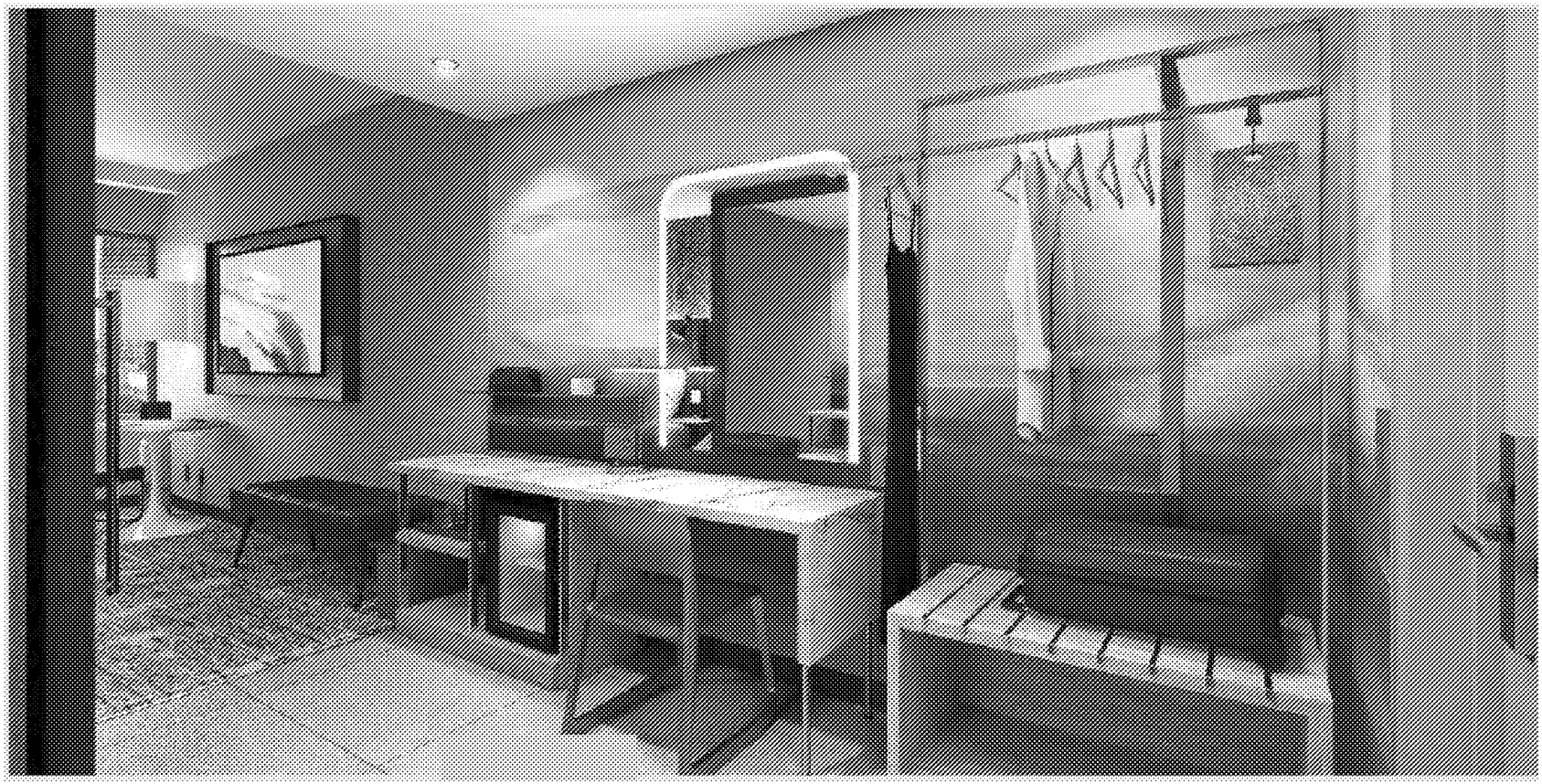
Figure 3B:
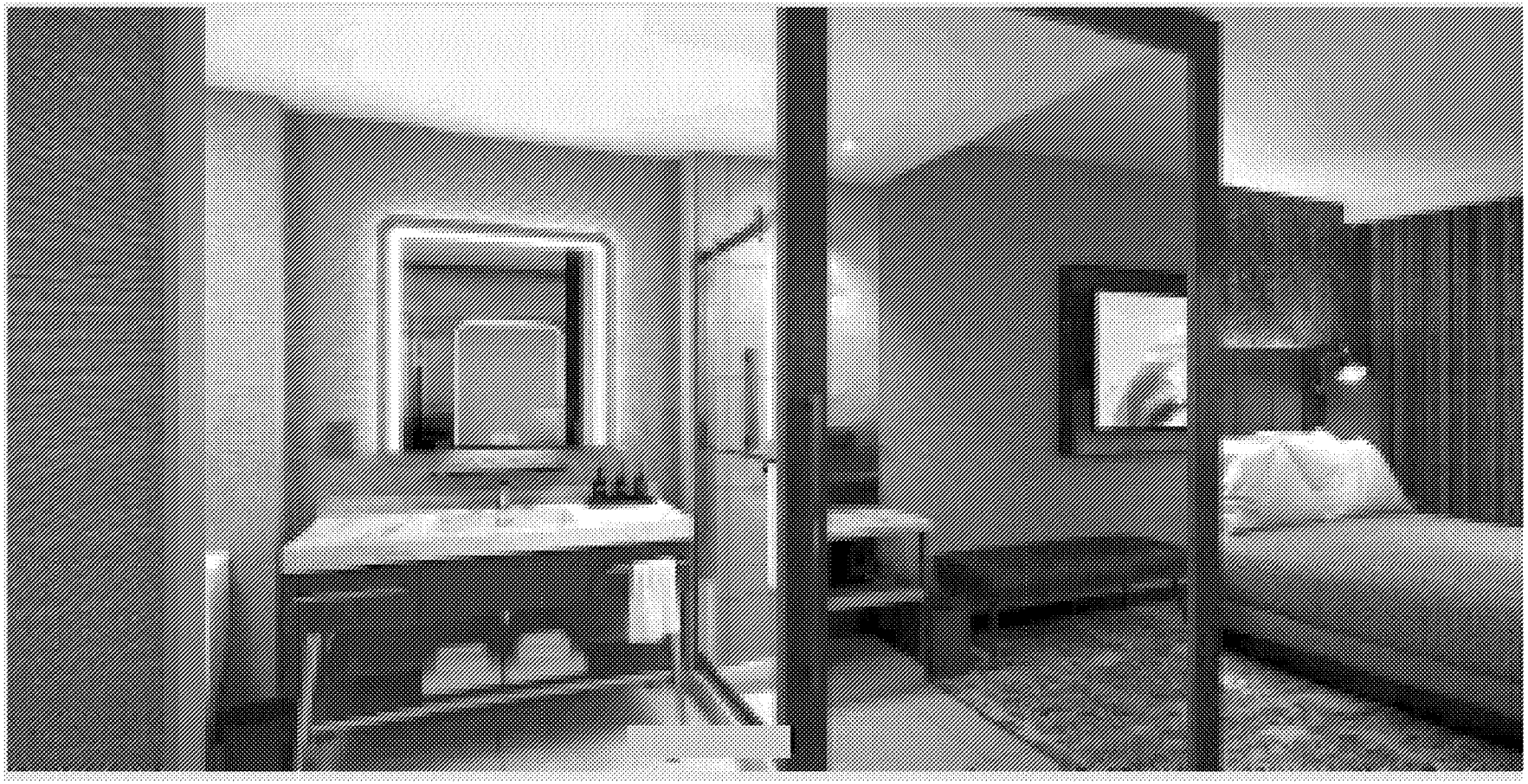
Figure 3C:
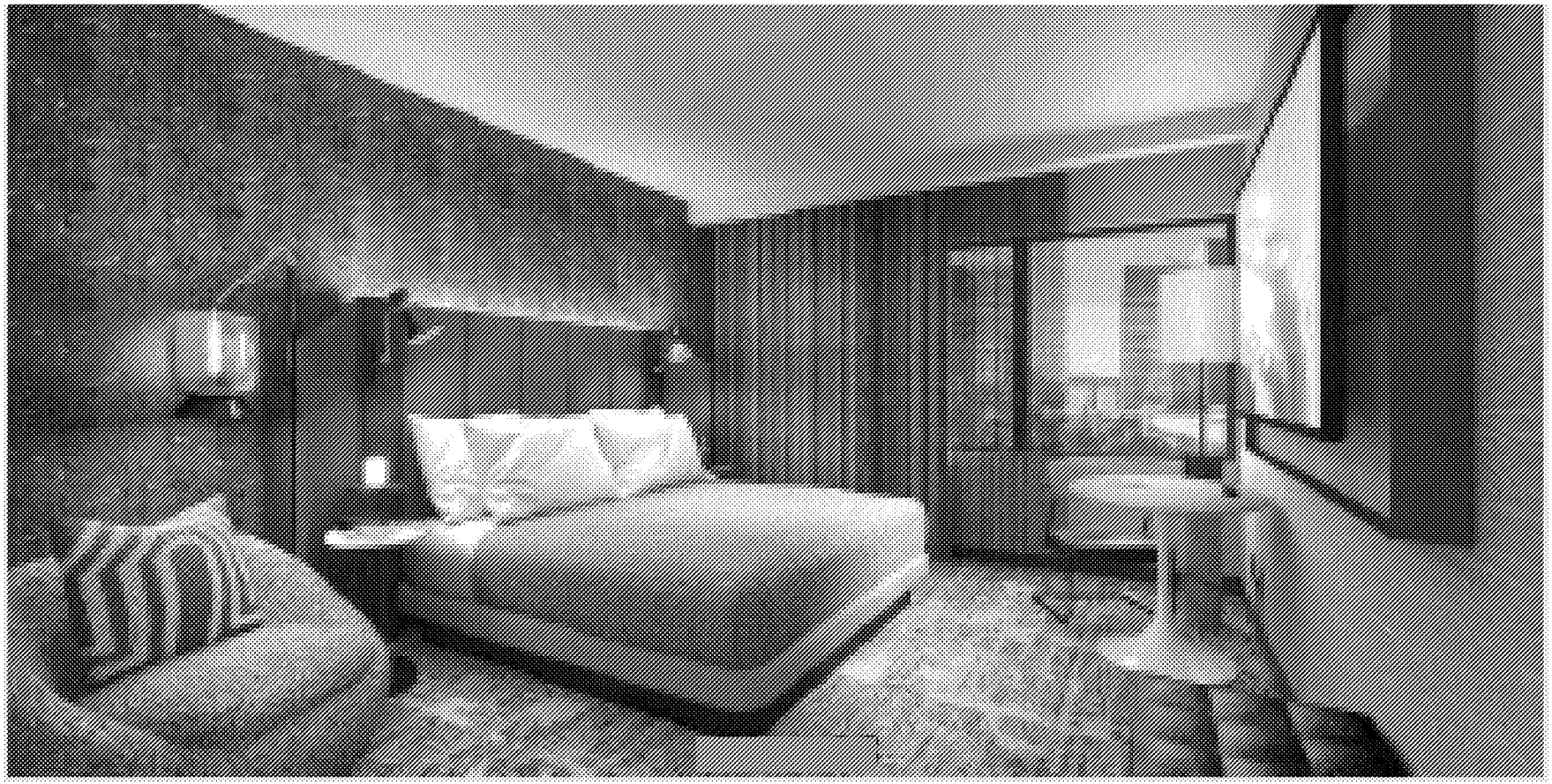
Figure 3D:
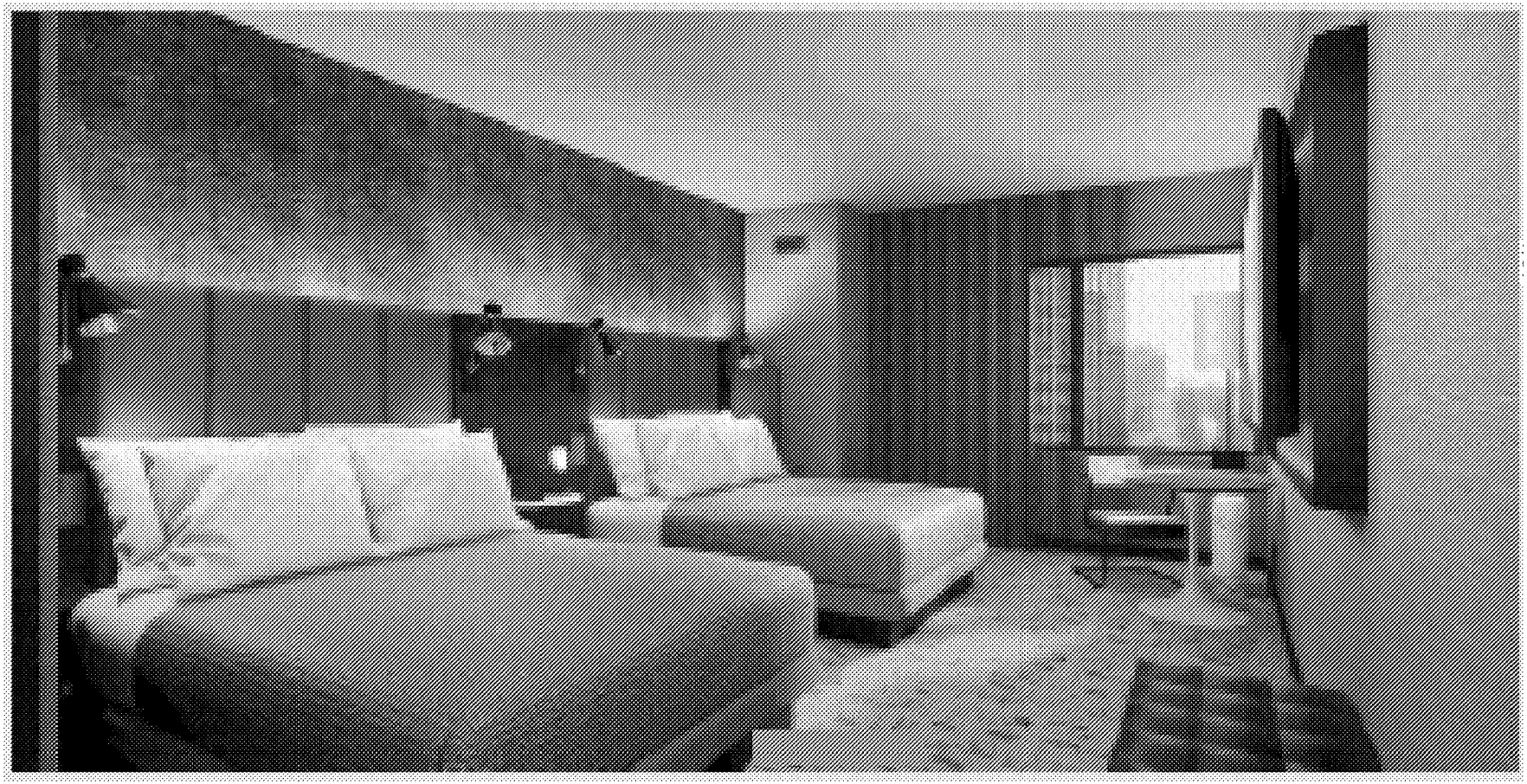

FIGS. 3A-3D illustrates additional views of the various zones. FIG. 3A illustrates an example get ready zone. FIG. 3B illustrates an example bath suite zone. FIG. 3C illustrates an example power down zone with one bed configuration. FIG. 3D illustrates an example power down zone with a two bed configuration.

Headboard

In some aspects of the disclosure, the bed can include a headboard. The headboard can help provide a sleep environment designed to help guests unwind, unplug, and/or fall asleep faster than normal. The headboard can be a central command with easy access to lighting and/or power. The headboard can be an enveloping headboard that tilts inward to help envelop the guest. The headboard can include lights 405 (e.g., a portable nightlight) and/or a noise machine. A task light can be attached to the front of the headboard. Integrated lighting (e.g., attached to the back of the headboard and/or to the wall) can be used to light a chair by the side of the bed. In some embodiments, various audio and/or video for meditation or relaxing audio and/or video can be incorporated into the headboard. Lights and/or noise machines and/or audio machines, and/or video machines can be plugged in at the chase, headboard panel, or side wing panel, or any combination thereof. By integrating plugs (e.g., for phones, curling irons, computers, etc.) and/or access to plugs into a component of the headboard can make it easier for a hotel manager to move the bed and/or headboard around without having to redo and/or move any plugs. In some embodiments, part or all of a headboard panel, side panel, or chase, or any other component of the headboard, can be magnetic, or accept tacks, or be of another material that allows printed material (e.g., meditation exercises, inspirational materials, etc.) to be attached to the headboard.

Figure 4A:
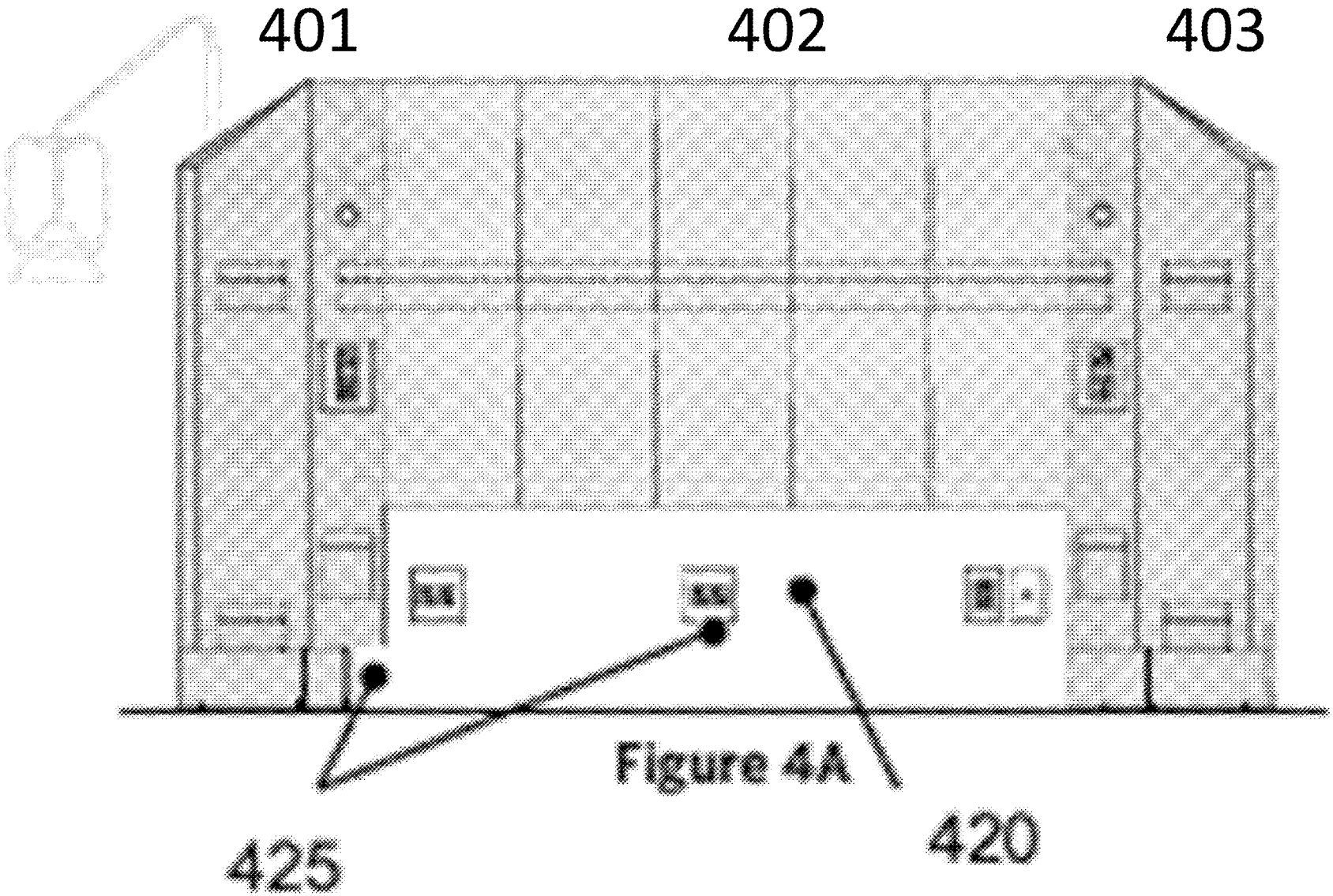
FIG. 4A-FIG. 10 illustrate an example headboards and example headboard components, according to aspects of the disclosure.
Figure 4B:
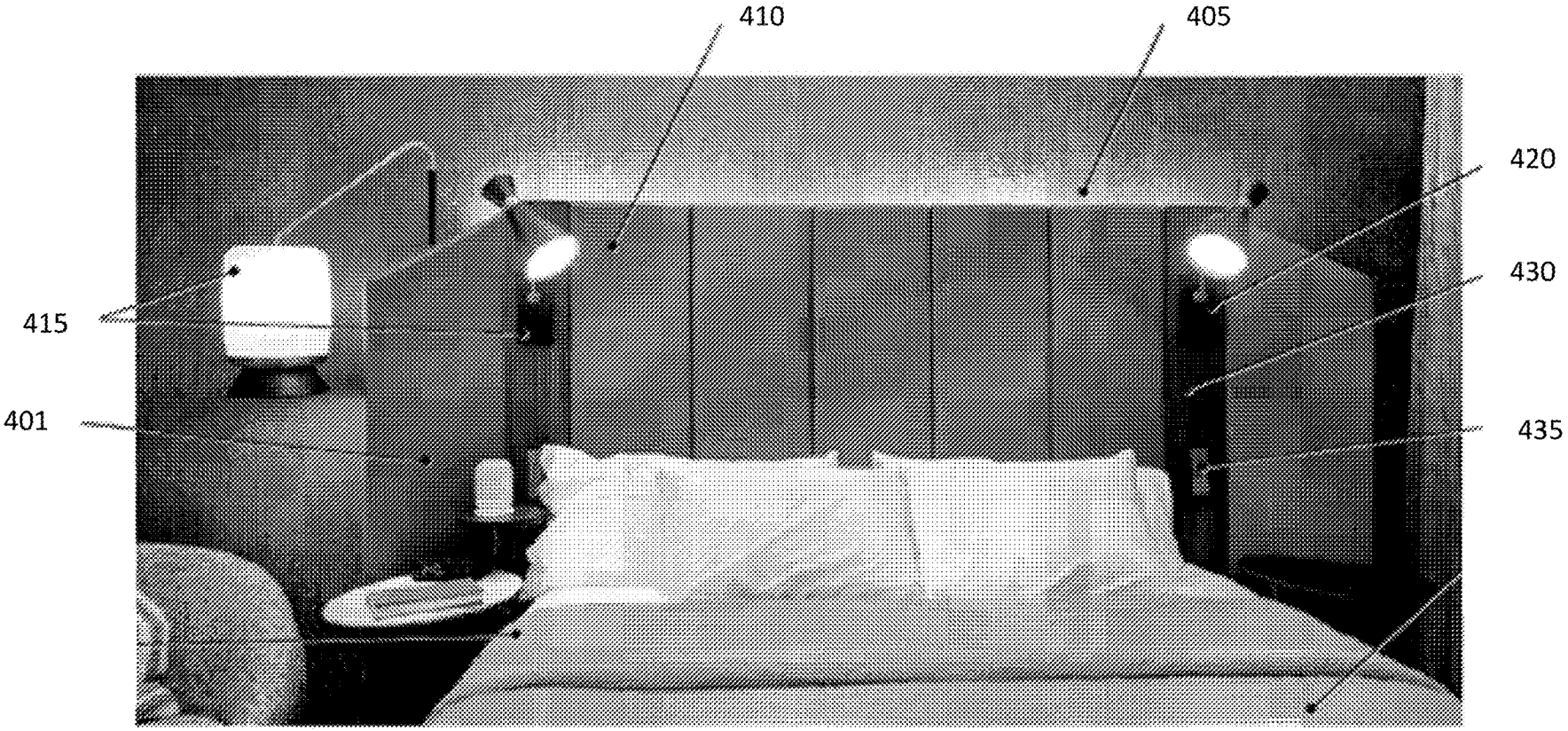
Figure 4C:
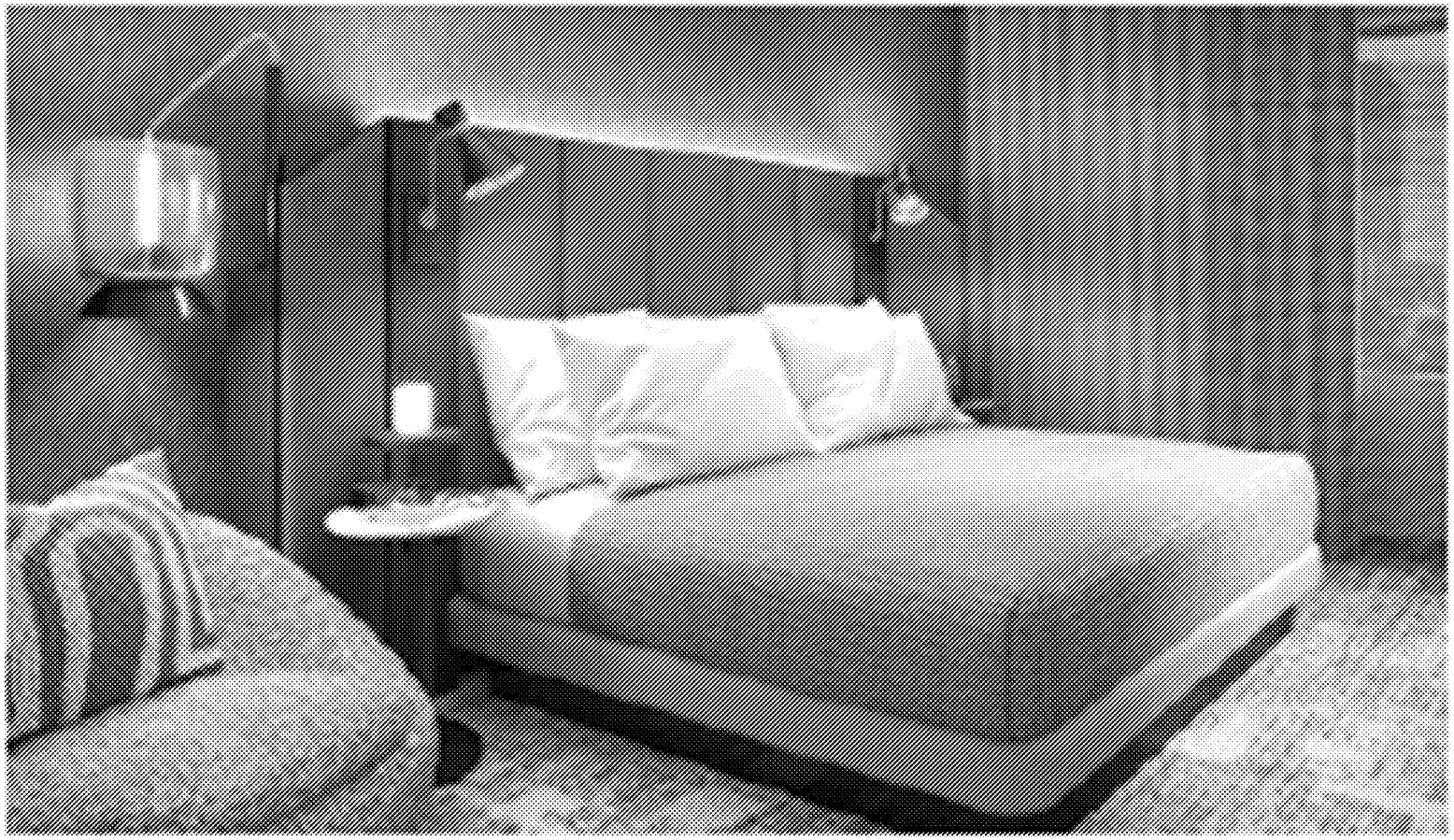

FIGS. 4A-4B illustrate a headboard, according to aspects of the disclosure. The design of the headboard can support any combination of the following: access to power and USB charging, ease of installation, cord management, and replacement and/or refreshment of upholstered panels. FIG. 4A illustrates a headboard made up of three primary pieces: two side wing panels 401 and 403, and a center frame 402 with individual upholstered panels that can each be separately removed and replaced. In some aspects of the disclosure, each side wing panel (401 and 403) can also be made up of multiple panels. The multiple panels can be easily updated with new covers. In some aspects of the disclosure, the material of 401, 402, 403 and 410 can be made of the same material or different material.

A light(s) for a lounge chair or desk can be included as part of the headboard or near the headboard. A light(s) (e.g., integrated into the headboard (e.g., on the chase)) can be included for task lighting in bed. Lighting (which can be integrated into the headboard and/or uplighting 405 over the headboard) can add light (e.g., ambient, direct) to the bed and/or headboard. Any of the lighting can be regular and/or LED and can plug into a standard duplex. The lighting can be plugged into wall outlets (e.g., 425) below the headboard 420 and/or on the back of the headboard (e.g., via the chase), and thus may increase the number of outlets available to guests.

One or more back panels can be attached to the headboard (e.g., cleated, attached in any way known to those of ordinary skill). For example, multiple panels 410 can be used for the center panel (402), and chases (e.g., made out of any material such as wood, or a laminate) 415 can be attached at both sides of the center panel 402. Each panel can be individually upholstered or otherwise made so that it can be easier and cheaper to fix, replace or refresh the headboard by replacing one or more individual panels instead of the full headboard. For example, if there is a special event (e.g., conference for a company or entity, sports event, music event), the panels can be changed to reflect or incorporate the event and/or event themes. The panels can be the same for different size beds (e.g., a king bed can have more panels than a queen, double or single bed so that the panels can be interchanged between the different bed sizes) and/or different panel sizes can be used for different size beds (e.g., a king bed can have panels that are bigger than panels for a double bed). Each panel can be attached to the headboard frame using cleating where two or more pieces of wood, wood laminate, wood substitute, metal, plastic, or any combination thereof, is attached at opposing angles. For example, a piece of wood (or a piece made of another type of material) attached horizontally on a back panel can slide onto a piece of wood (or a piece made of another type of material) placed vertically on a back frame. In some embodiments, the placement of the wood can be at other angles other than horizontal or vertical, such a diagonal or partially diagonal. In some embodiments multiple pieces on the back panels can attach to one or more pieces of the back frame. Those of ordinary skill in the art will see that other mechanisms can be used to attach the back panels to the back frame (e.g., velcro, nails, screws, etc.) The back frame can be attached to the wall using nails, screws, velcro or any other attachment mechanism known to those of ordinary skill in the art. In some aspects of the disclosure, a back panel can be made as a complete piece and does not need to be covered by any covering (e.g., material, etc.). Although multiple back panels are shown in FIG. 4B, any number of back panels (e.g., including a single back panel) can also be used.

Side panels 401 and 403 can be included in some aspects of the disclosure. Side panels can be flat or tilted to create a "wing." Side tilted wing panels can extend from the headboard wall to create a physical and visual "hug" for the guest. The side wing panels can reach out around the guest to help provide focus for a power down experience. In some aspects of the disclosure, each side can have one or more side panels that can be tilted inward. In some aspects of the disclosure, each side can have one or more side panels that can be tilted outward.

The headboard can include one or more chases 415. FIG. 4B illustrates two vertical chases 415, one on each side of the headboard, although multiple configurations are possible. There can be one or more chases 415 running vertically across the headboard. There can be one or more chases running horizontally across the headboard. There can be one or more chases running diagonally or in any pattern across the headboard. The chase can be made of any type of material known to those of ordinary skill in the art, including wood, a wood laminate, a material made to look like wood, metal, plastic, or any combination thereof. The chase(s) can be of any shape (e.g., circle, square, vertical or horizontal ellipse and/or rectangle).

An access panel(s) 420 can be integrated into the chase to help conceal cords (e.g., for a clock, phone, light (e.g., a casper light, etc.) Items can be plugged into wall outlets below the headboard and so not need to take up outlets that guests may want to use. A mechanism(s) (e.g., a grommet 430) of any size can be placed in the chase to help protect and/or insulate cords and/or cables, to help cord and/or cable management, and to help make replacement of a fixture and/or faceplate easier, and to help cord management. The chase can include lighting 415 (e.g., integrated task lighting), light switches and/or standard and/or USB outlets 435. The chase can be individually attached to the headboard (e.g., cleated or using any other method known to those of ordinary skill in the art) to help make it easy to replace and/or refresh the chase. Lighting can plug into a wall via the chase.

The integrated lighting and/or power units can use a standard plug-in-technique. This can make the lighting and/or power units easy to install on-site, and may not require electrical sub-contractor help. In this way, it may make it easy for an on-property maintenance team member to replace and/or refresh the lighting and/or power units. The integrated lighting and/or power units may not need to be individually Underwriters Laboratories (U/L) listed, so the headboard may not need to be U/L listed as a unit. This can make fabrication costs less and avoid U/L testing costs.

An opening(s) at the bottom of the chase can allow easy coordination of cords and realities of outlet locations. The headboard can be open below the top of a mattress (e.g., 420) for easy access to power and/or cord management. Note that 420 can represent an open area or a piece of the headboard.

FIGS. 4A and 4B illustrates how the back panel(s) and/or the side panel(s) can have a base/toe-kick near the bottom of the panels and/or the floor to help prevent damage (e.g., by housekeeping, guests, etc.) and can help guests to not lose personal items. In some aspects of the disclosure, the base and/or toe-kick can be closed. The base and/or toe-kick can be made of any material known to those of ordinary skill in the art (e.g., wood, a wood laminate, a material made to look like wood, plastic, or metal, material, or any combination thereof).

Figure 5A:
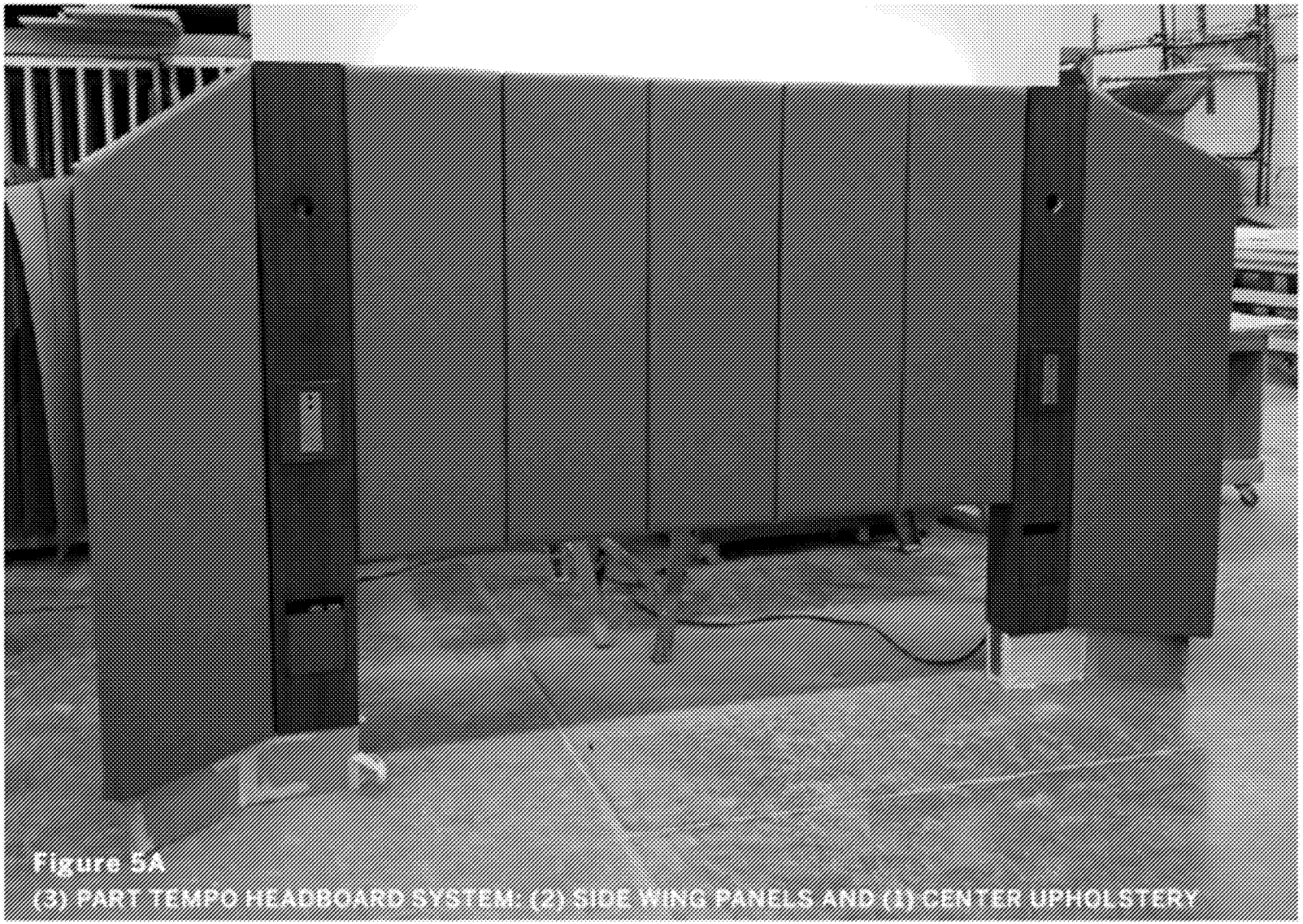
Figure 5B:
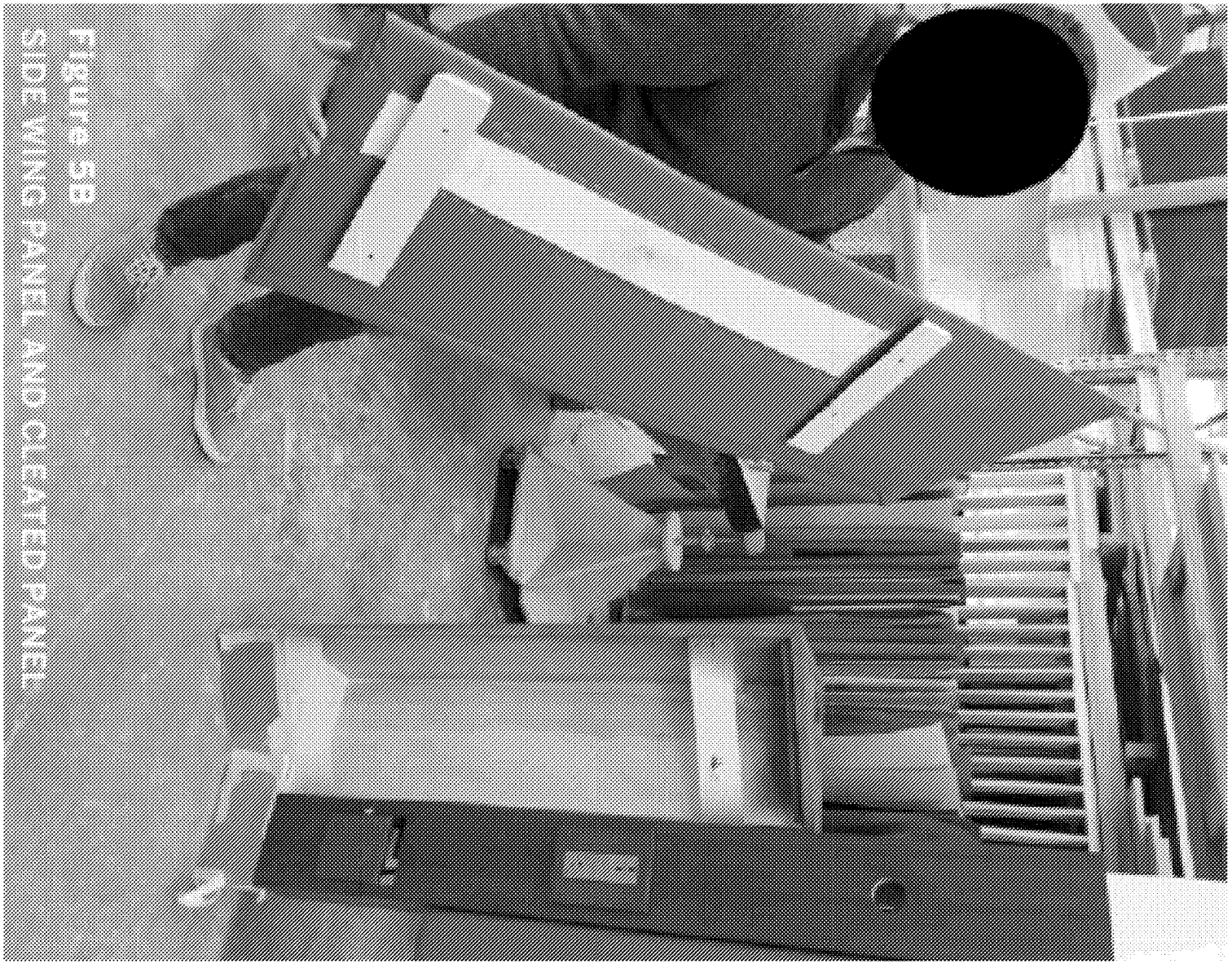
Figure 5C:
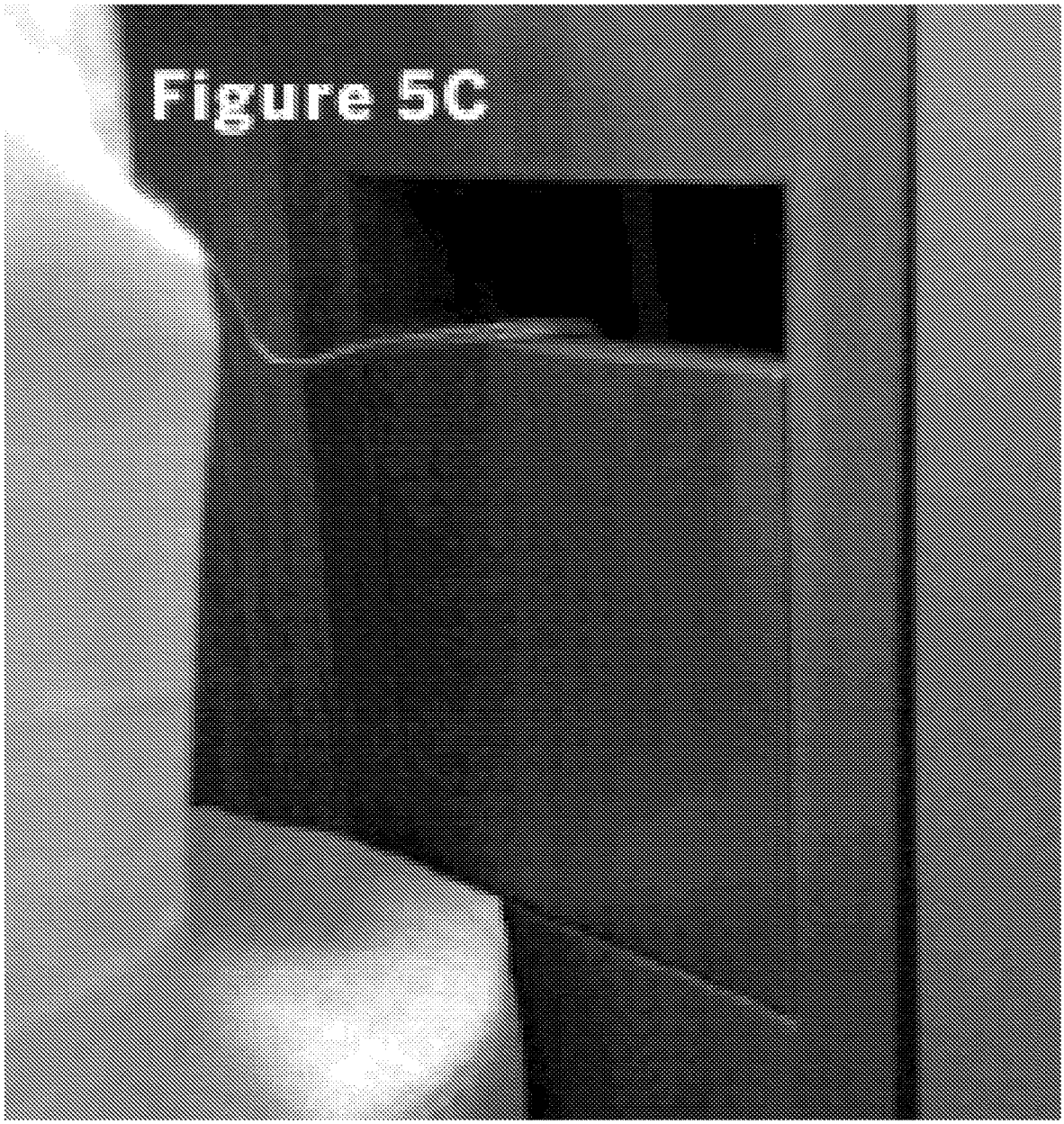
Figure 5D:
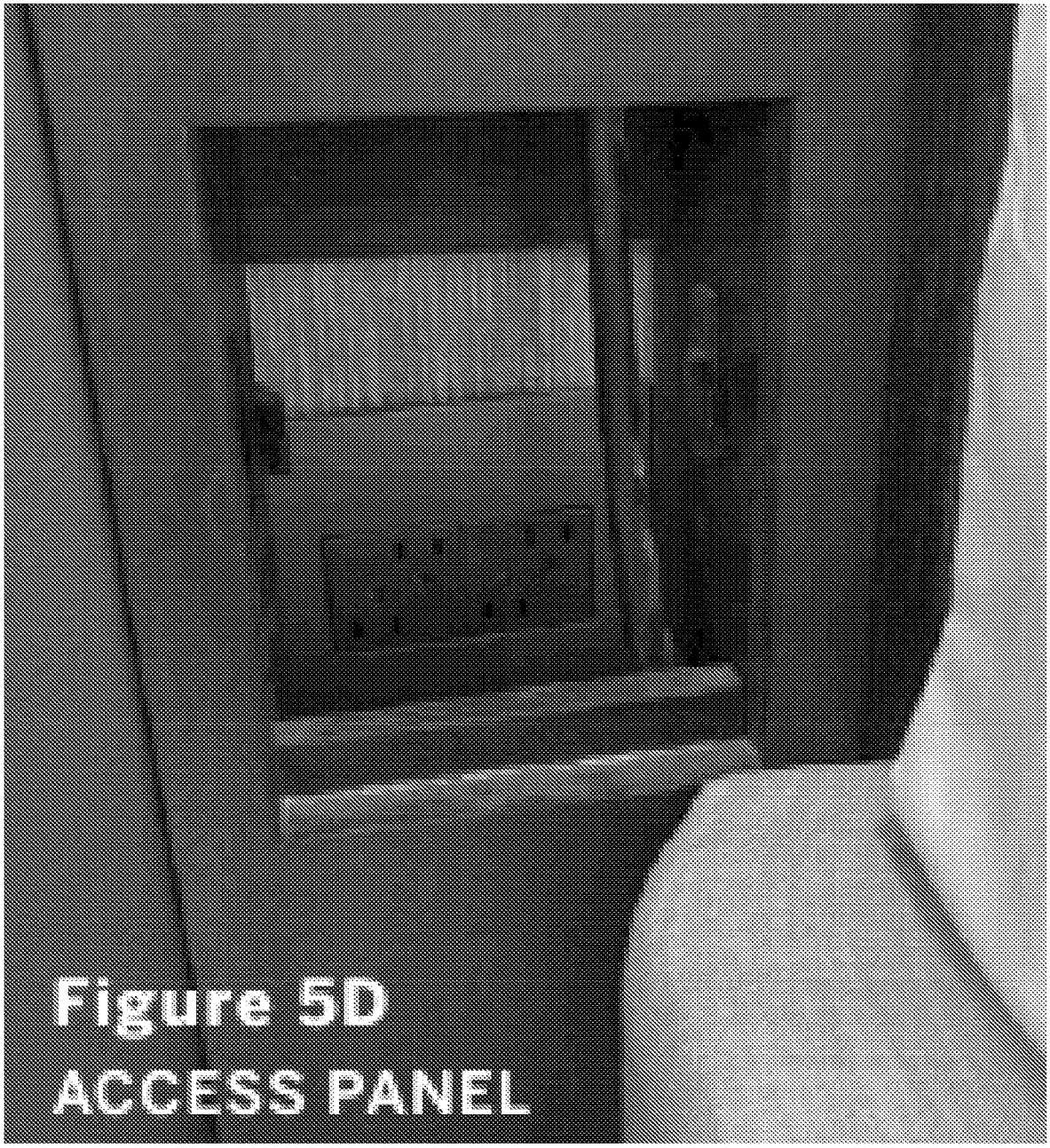

FIG. 5A illustrates an example perspective view of the headboard. FIG. 5B illustrates an example of how a panel may be cleated using any material known to those of ordinary skill in the art. FIGS. 5C and 5D illustrate example access panels that can be in a chase.

Figure 5E:
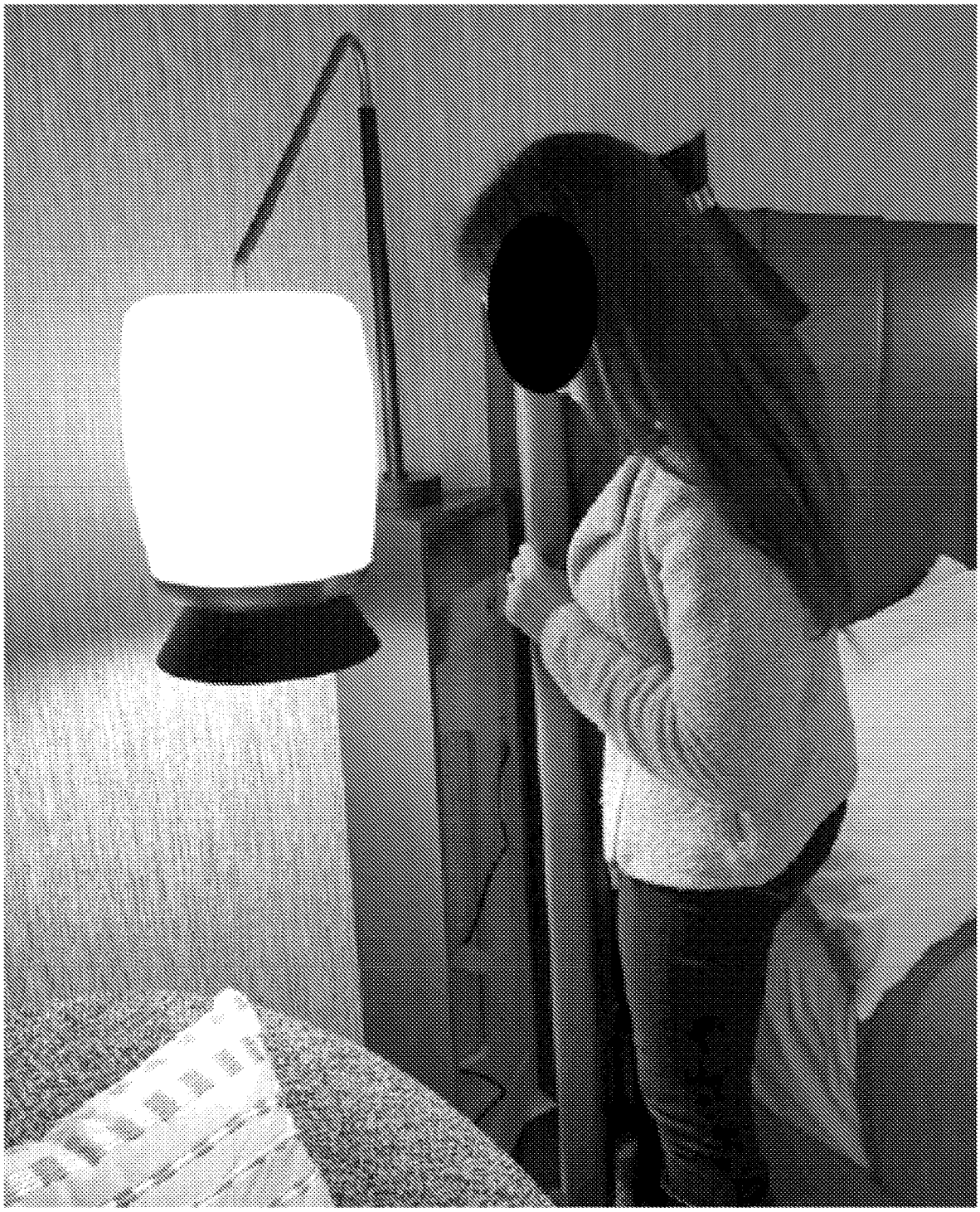
Figure 5F:
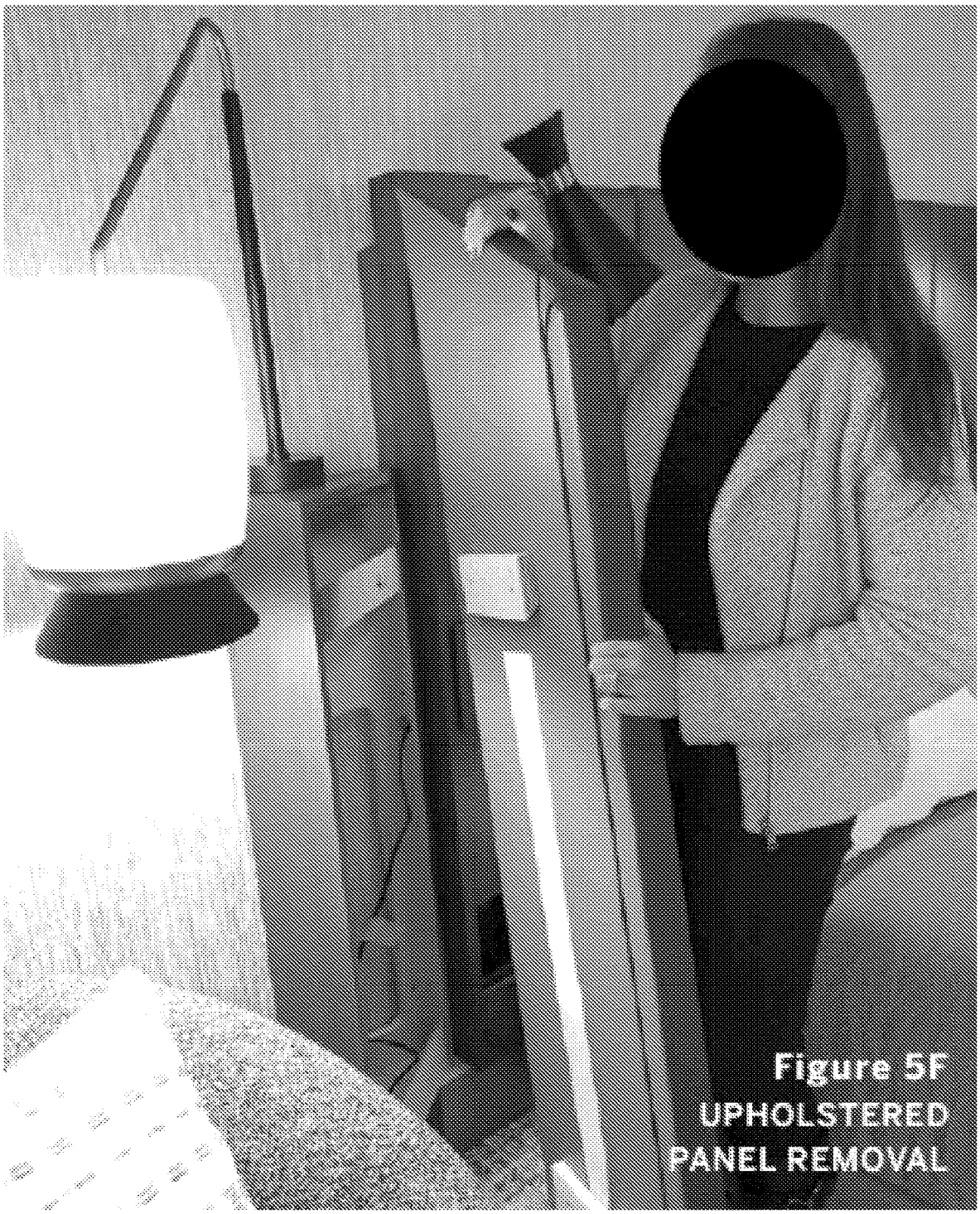

FIGS. 5E-5F illustrates an example how a side panel can incorporate cleating, such as a block (e.g., made of wood or another type of material) that can be attached to a side frame (which side panel back can be attached to a wall). For example, a piece of wood (or a piece made of another type of material) attached horizontally on a side panel can slide onto a piece of wood (or a piece made of another type of material) placed vertically on a side frame. In some embodiments, the placement of the wood can be at other angles other than horizontal or vertical, such a diagonal or partially diagonal. In some embodiments multiple pieces on the side panels can attach to one or more pieces of the side frame. Those of ordinary skill in the art will see that other mechanisms can be used to attach the side panels to the side frame (e.g., velcro, nails, screws, etc.) The side frame can be attached to the wall using nails, screws, velcro or any other attachment mechanism known to those of ordinary skill in the art.

Figure 5G:
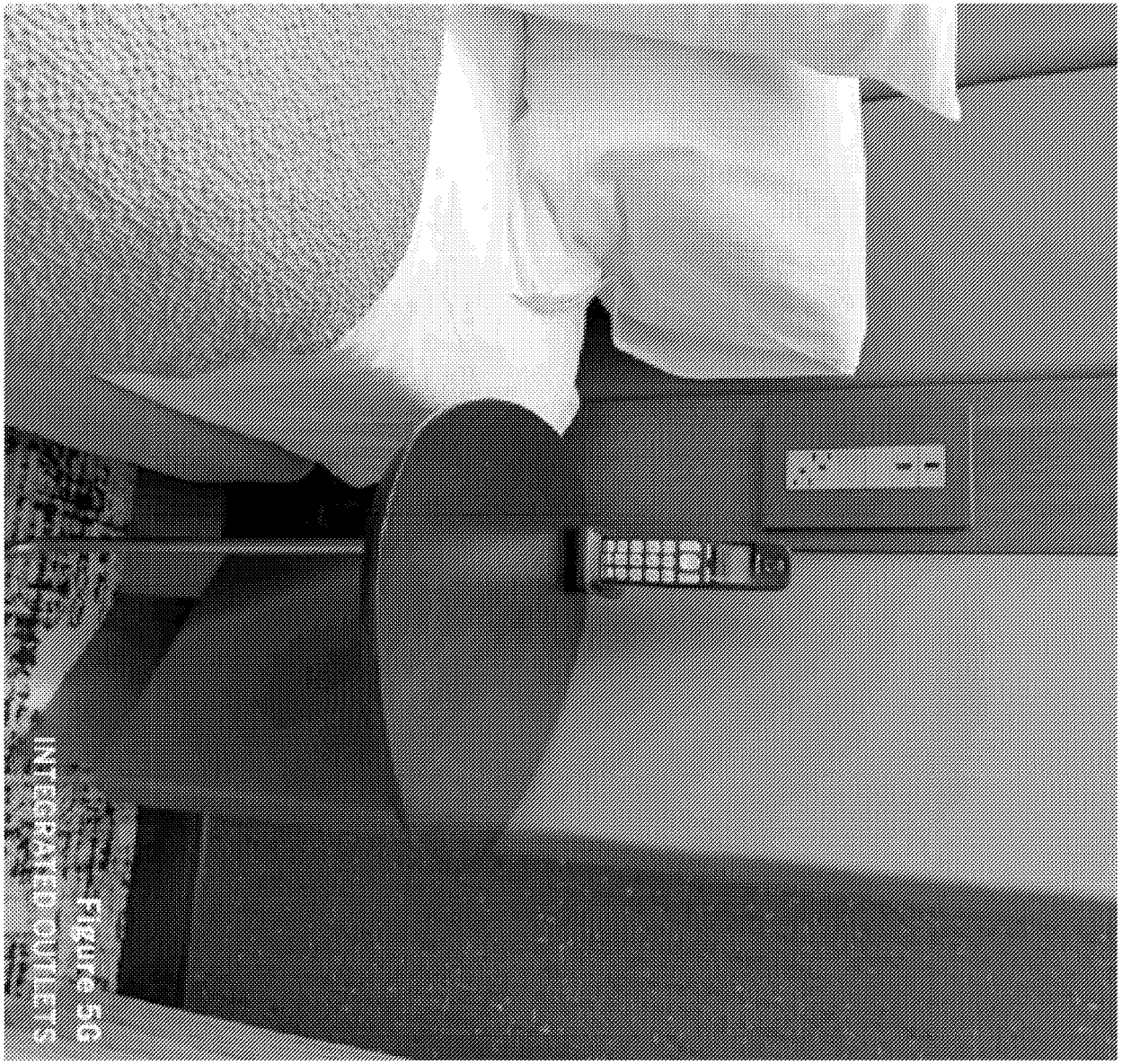
Figure 5H:
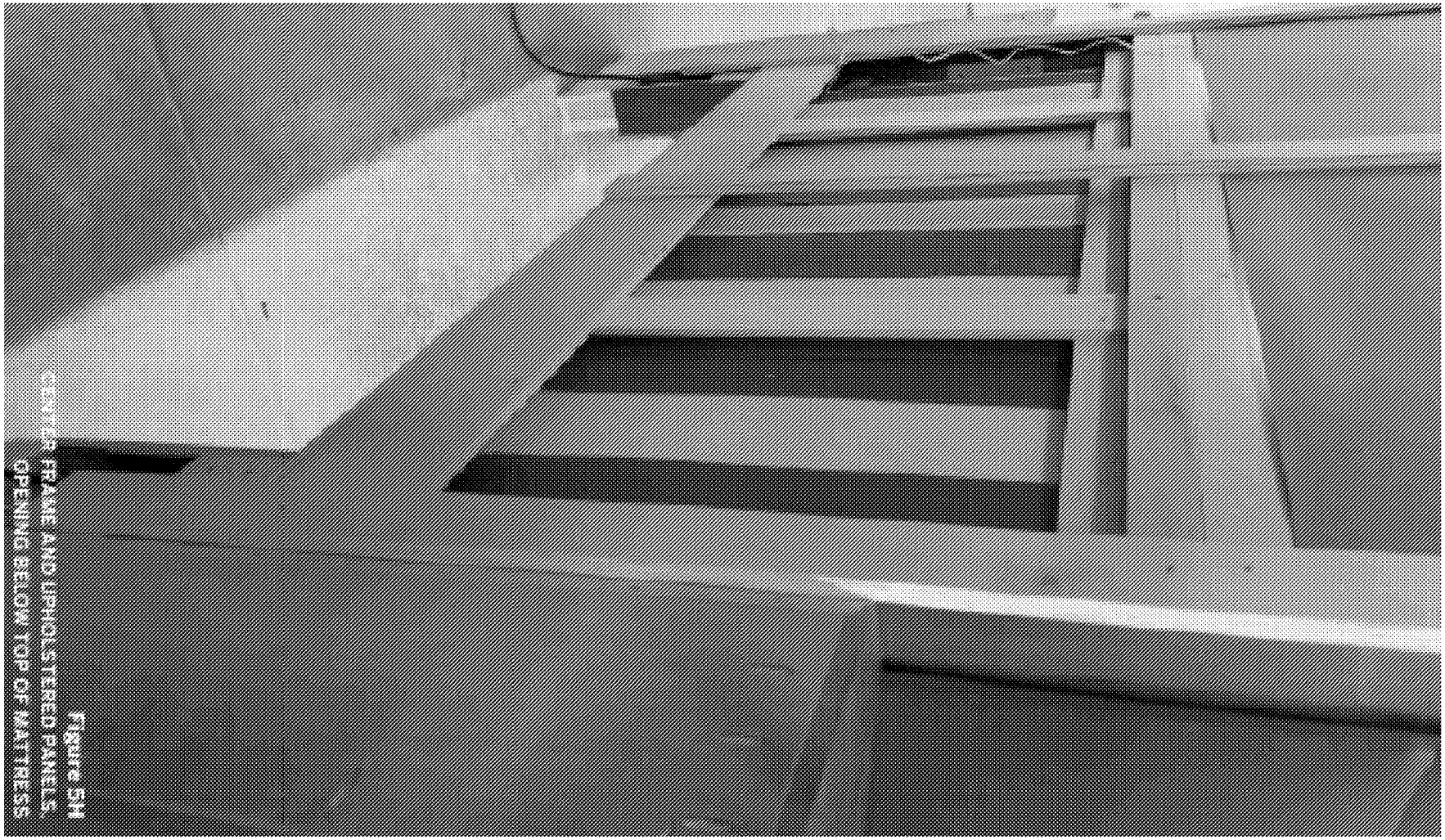
Figure 24:
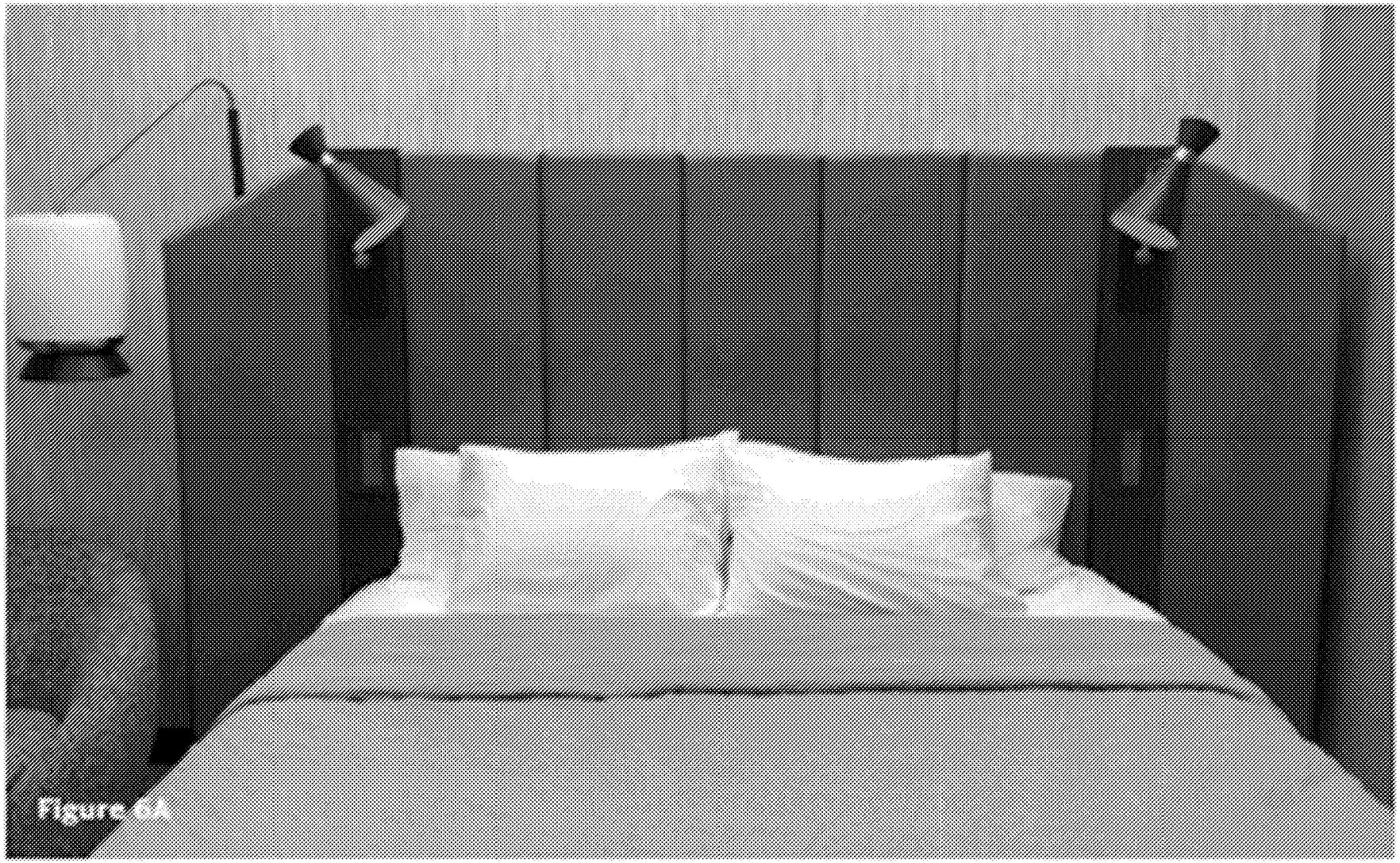

FIG. 5G illustrates an example of power plugs that can be incorporated into a chase. FIG. 5H illustrates an example back frame back for the back panels.

Figure 6B:
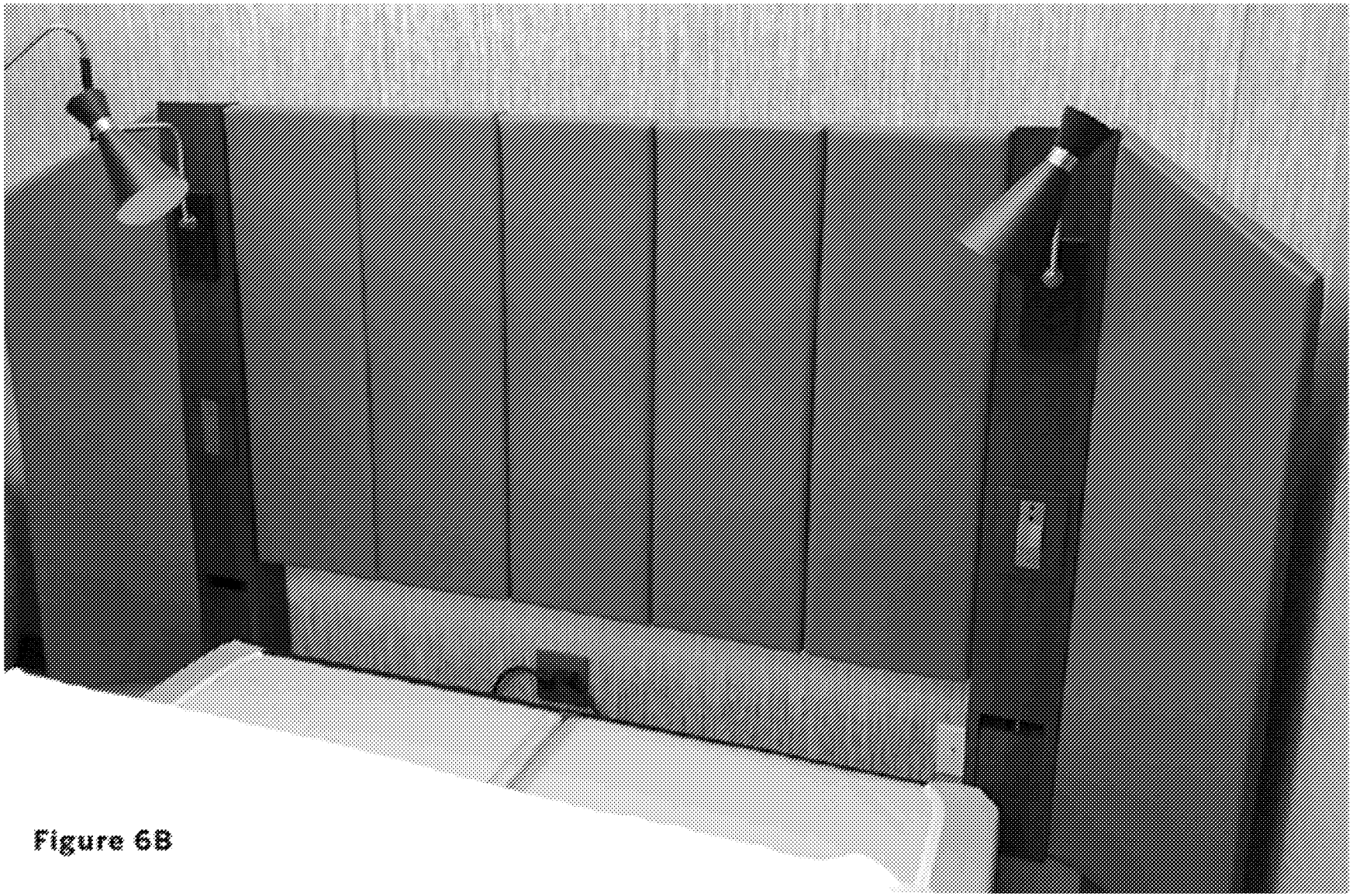
Figure 6C:
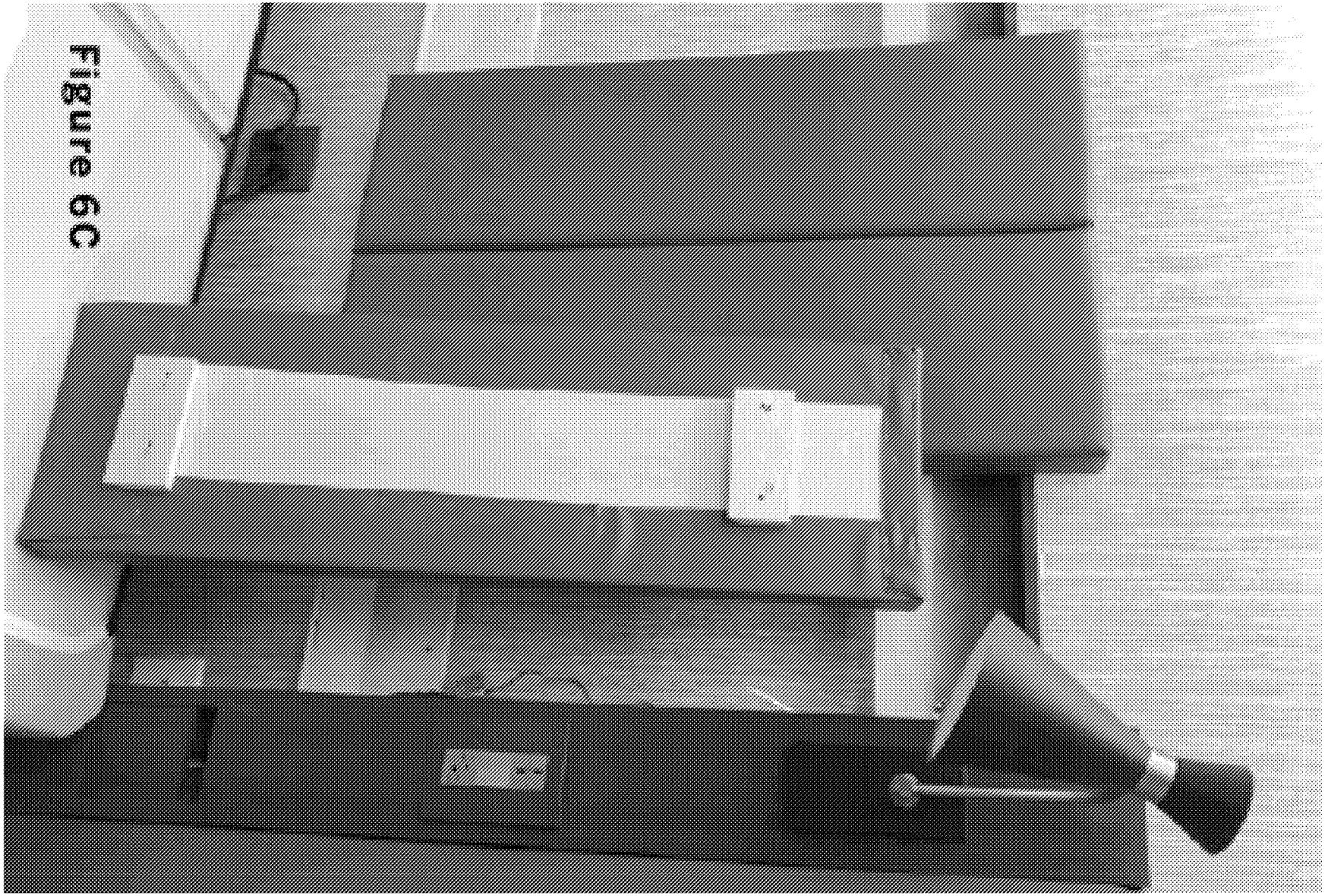
Figure 6B:
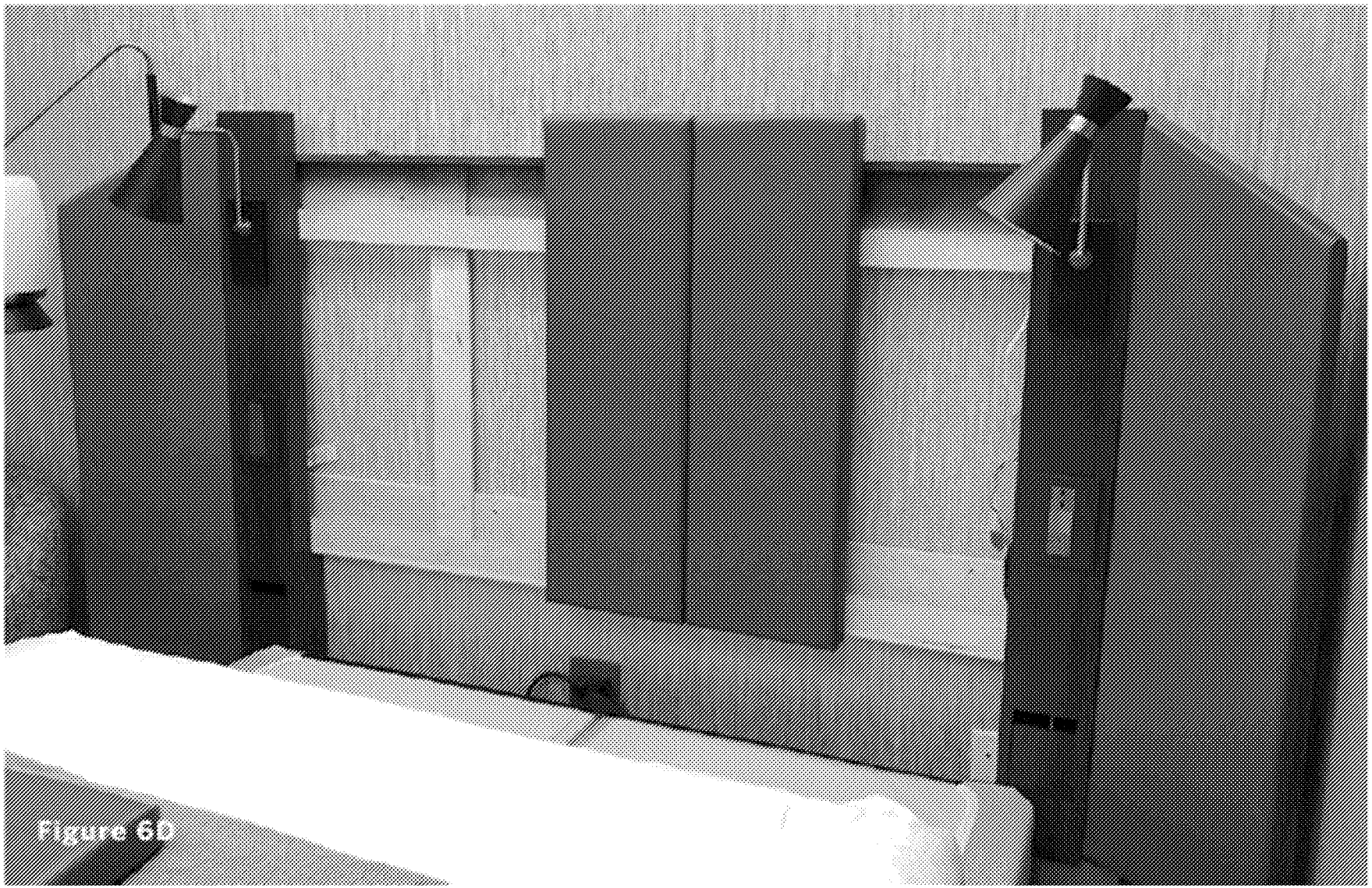
Figure 6E:
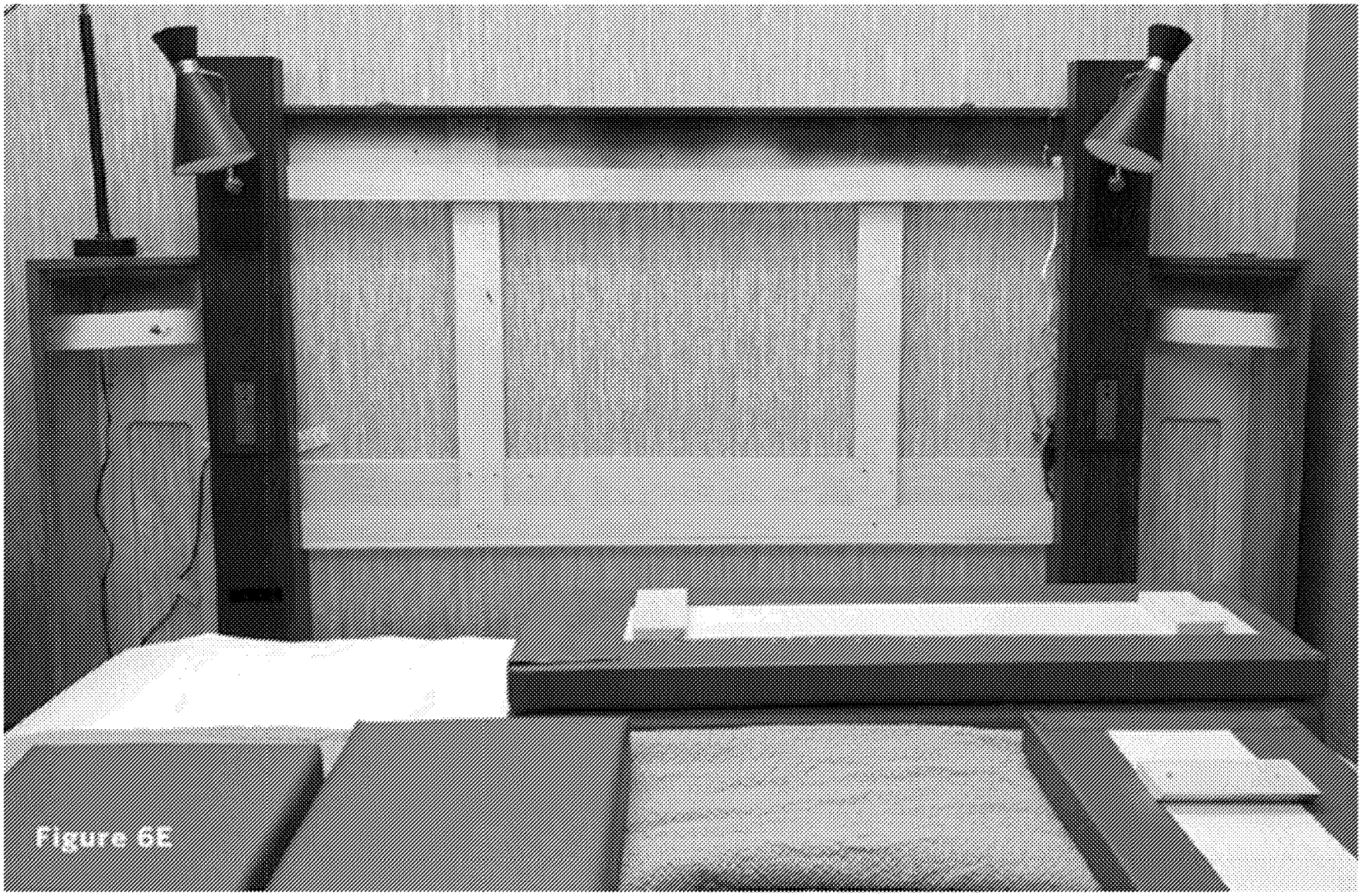
Figure 6F:
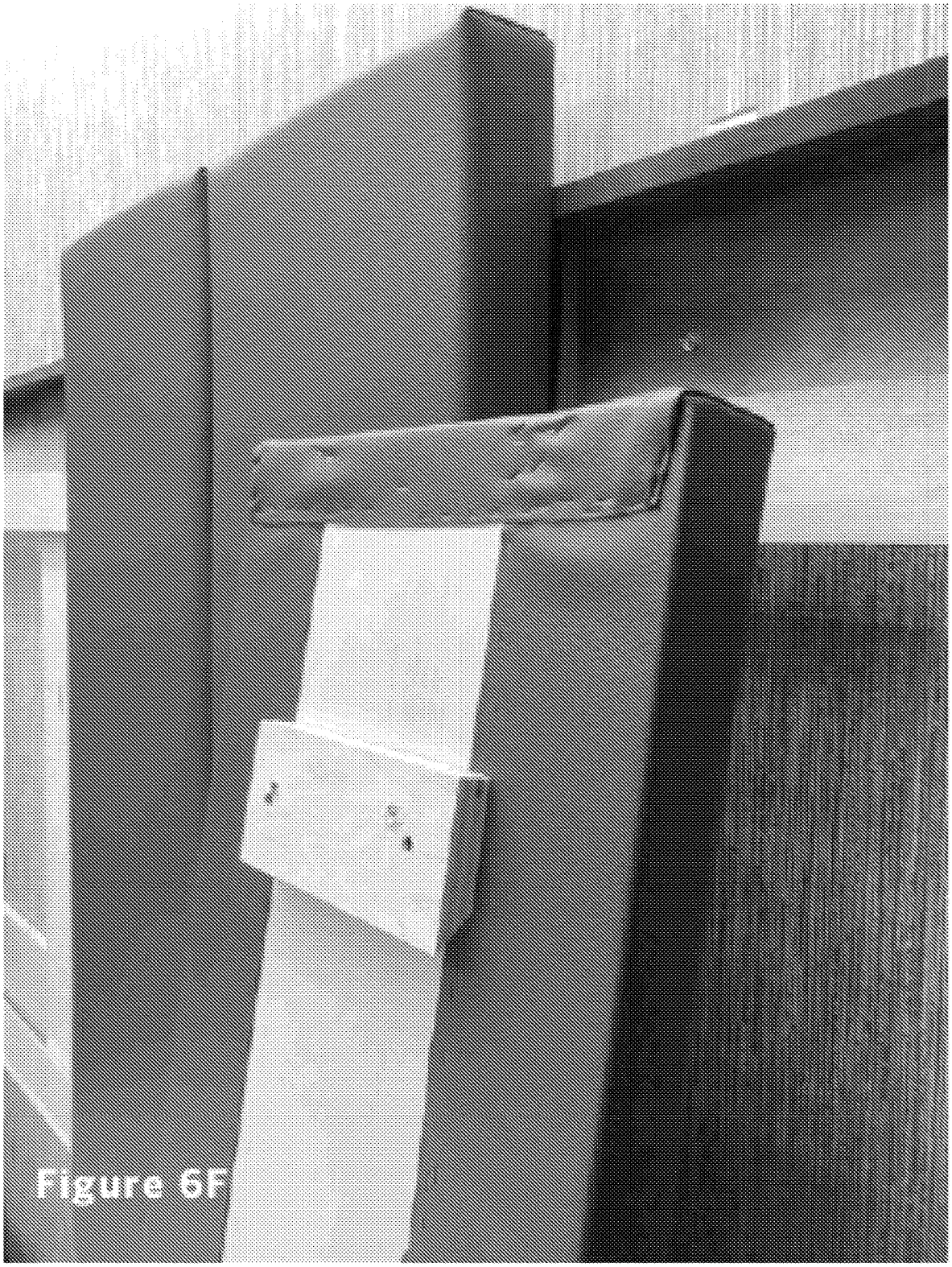

FIG. 6A illustrates a front view of an example headboard with a mattress. FIG. 6B illustrates a perspective view of an example headboard with a mattress pulled back. In this view, example access to wall power underneath the headboard is shown. FIG. 6C illustrates an example back panel with cleating elements. FIG. 6D illustrates an example back frame with a few example headboard back panels attached. FIG. 6E illustrates an example back frame.

Figure 7A:
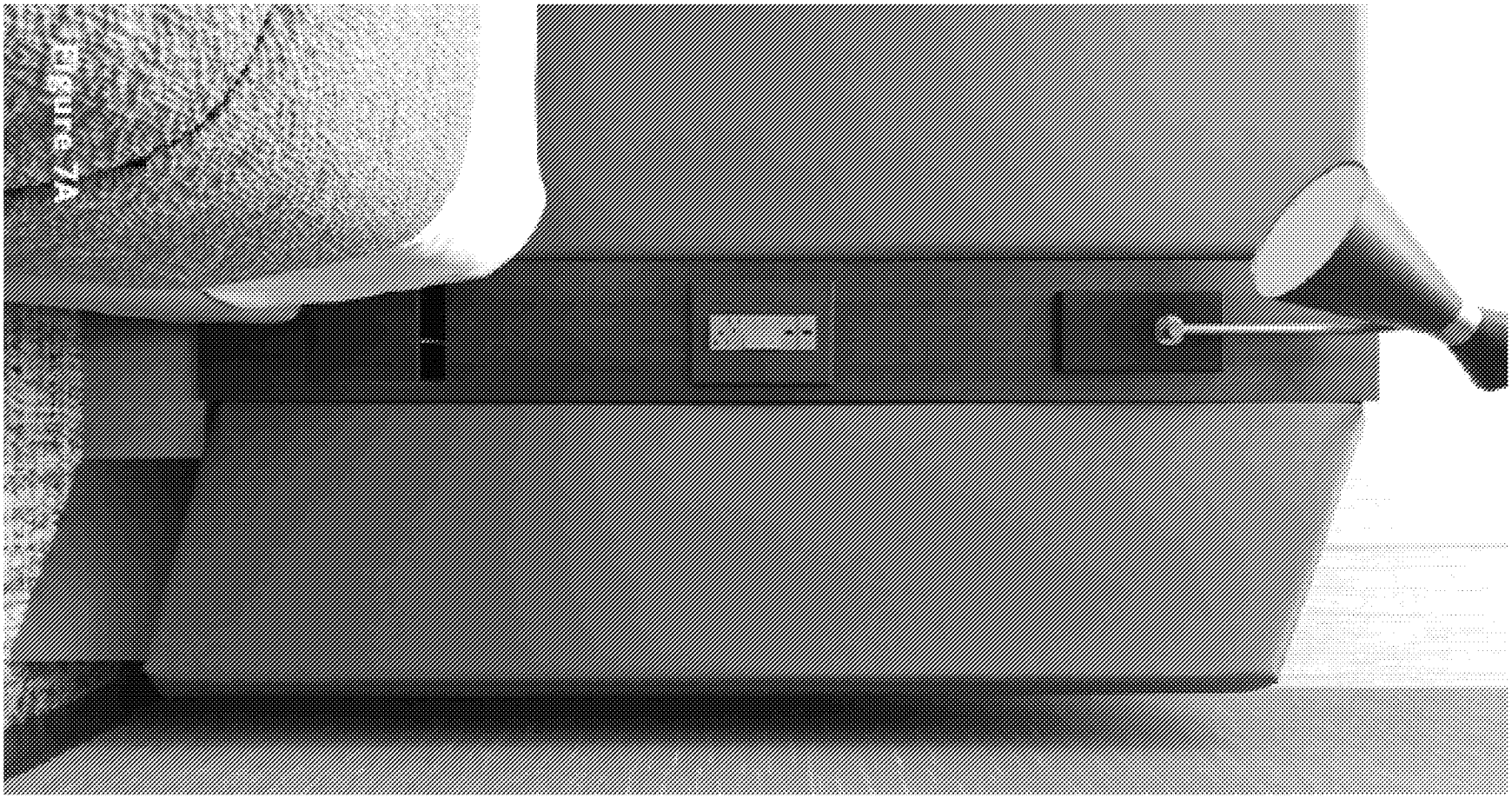
Figure 78:
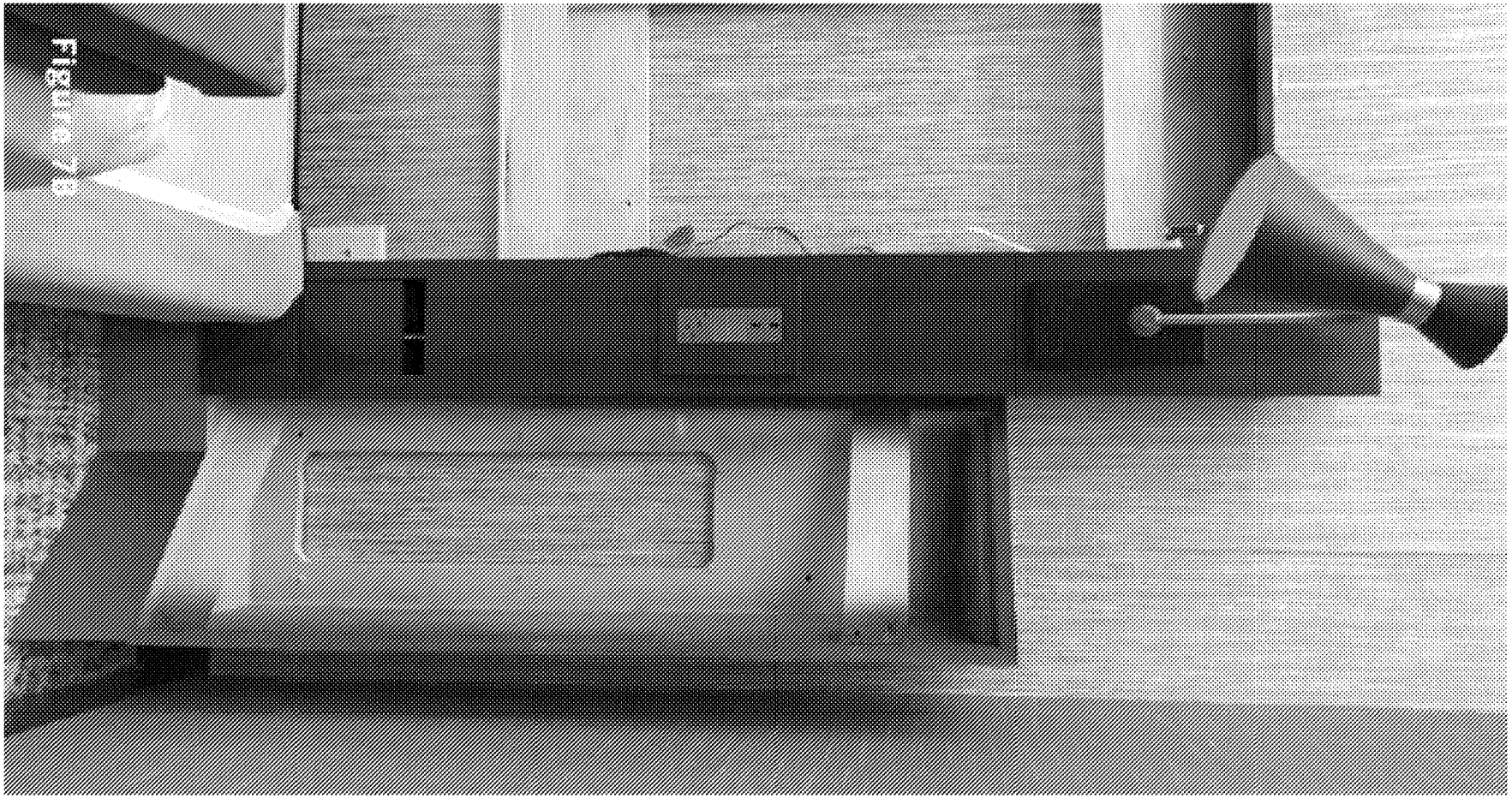
Figure 7C:
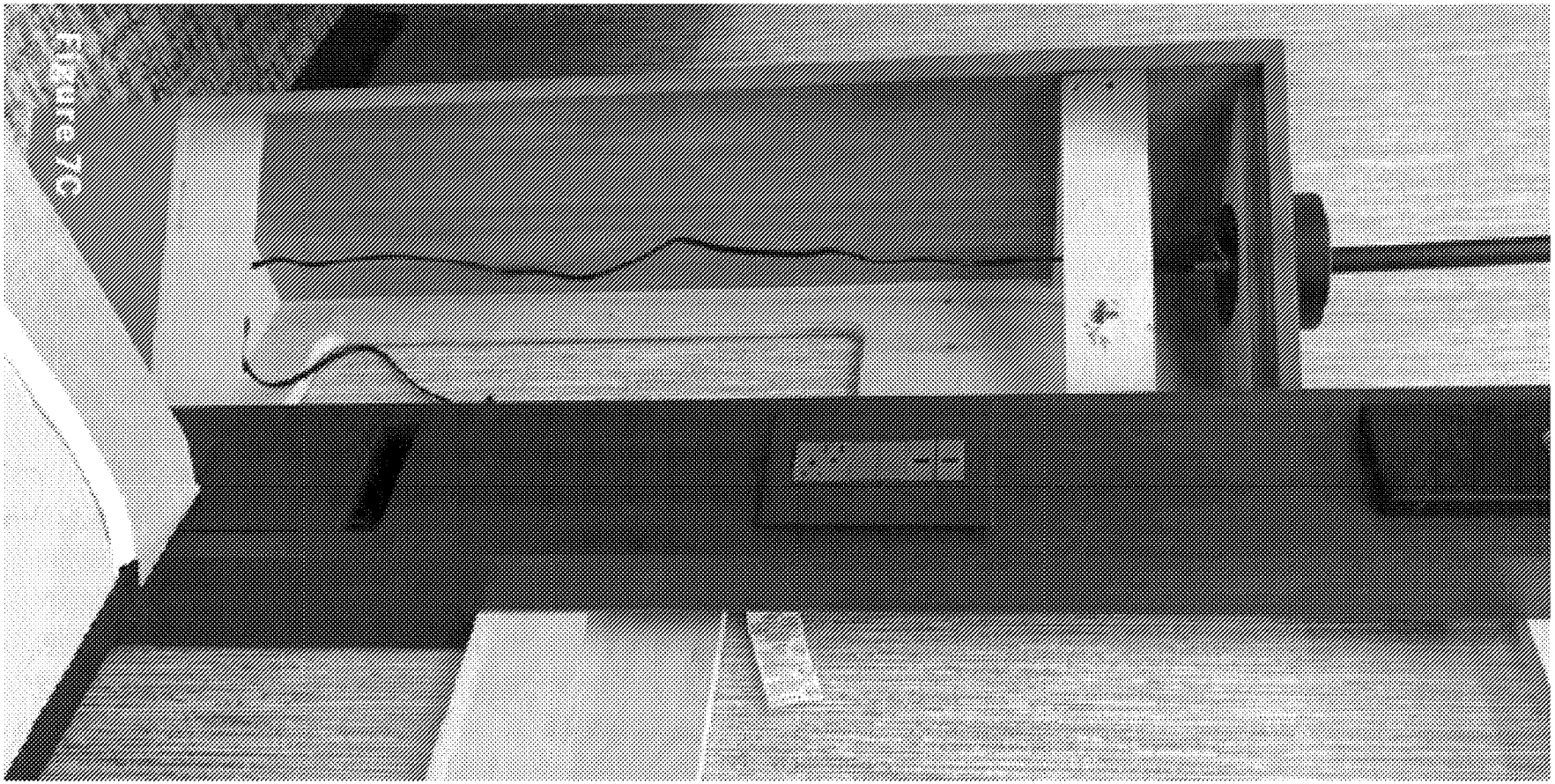
Figure 7D:
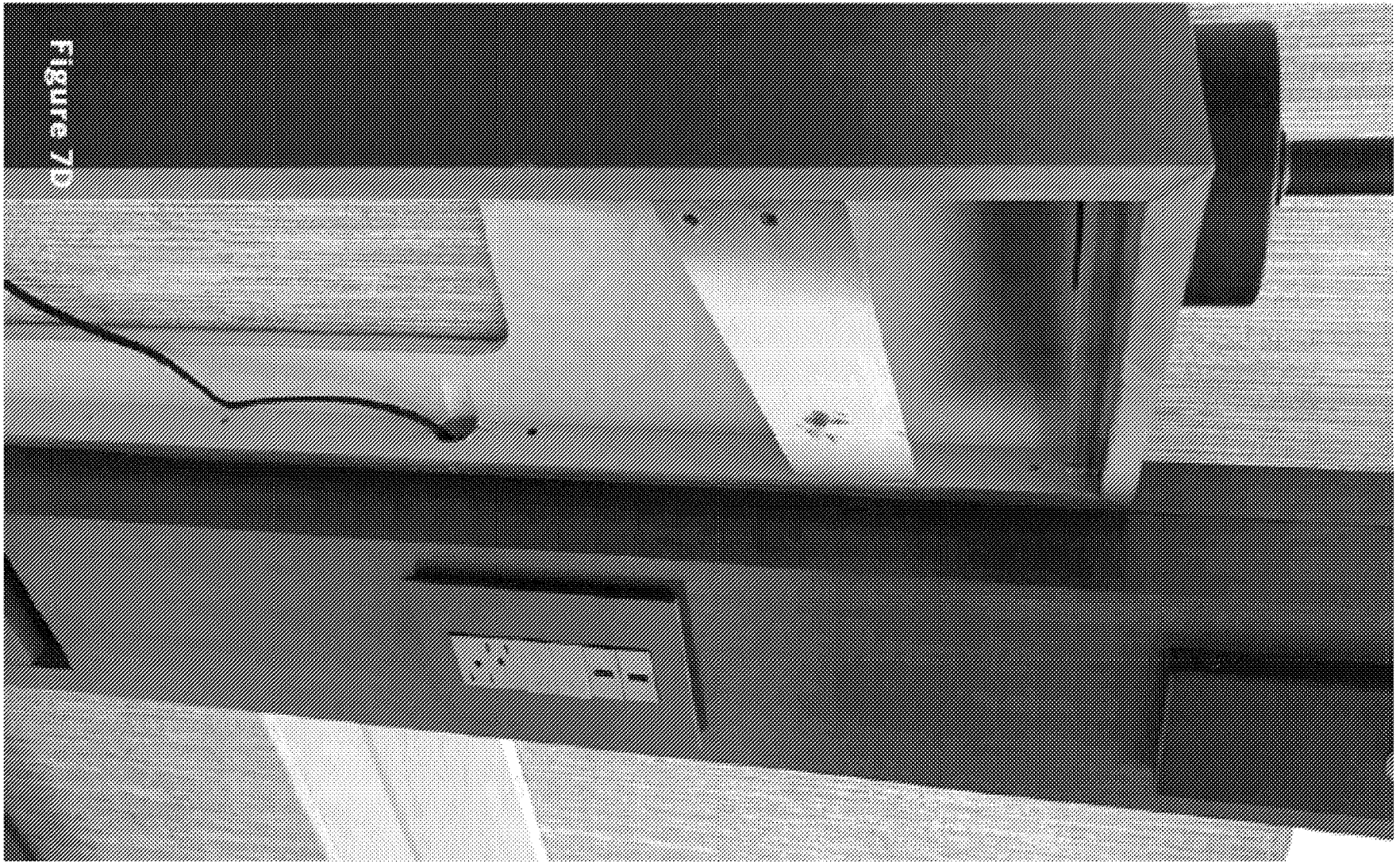
Figure 7E:
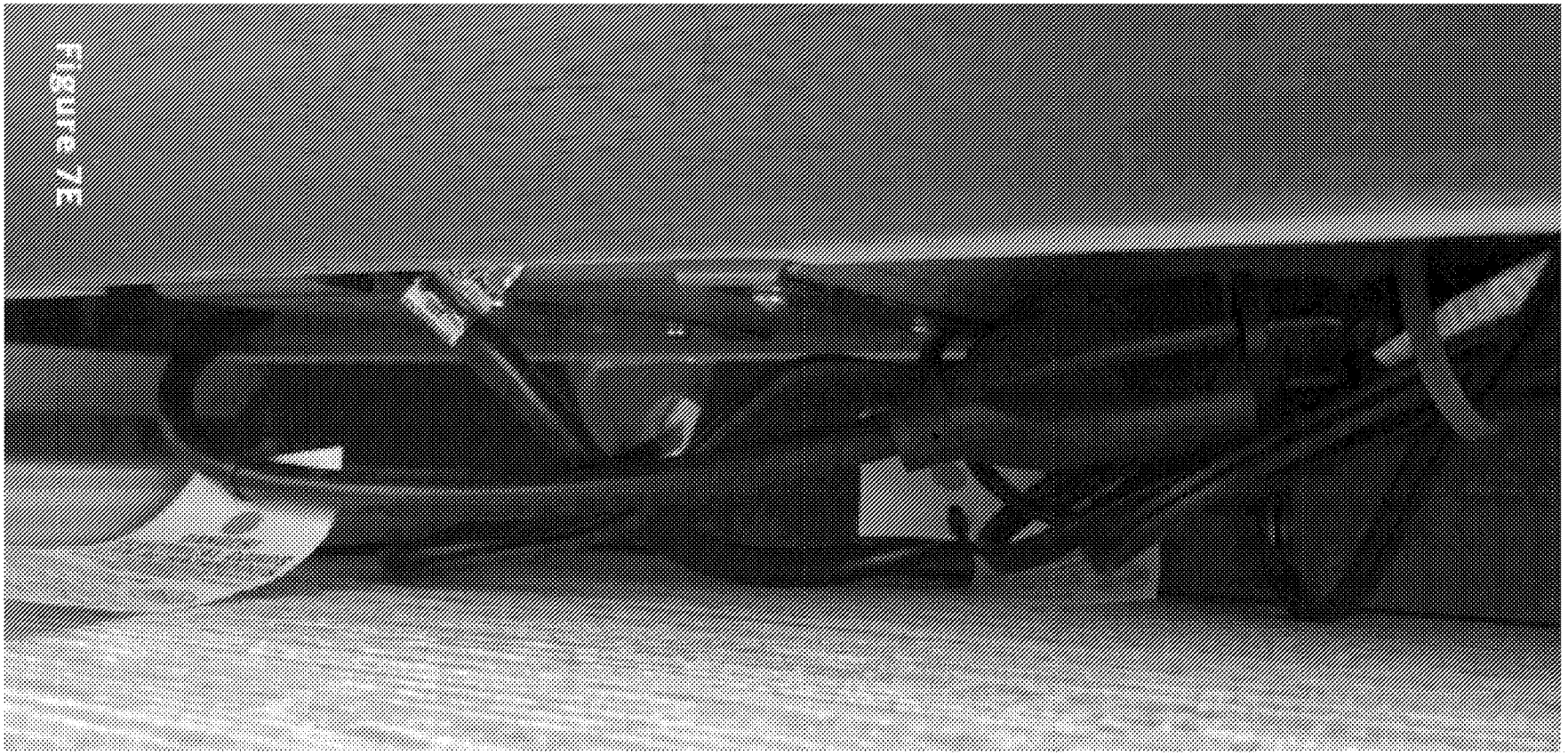
Figure 7F:
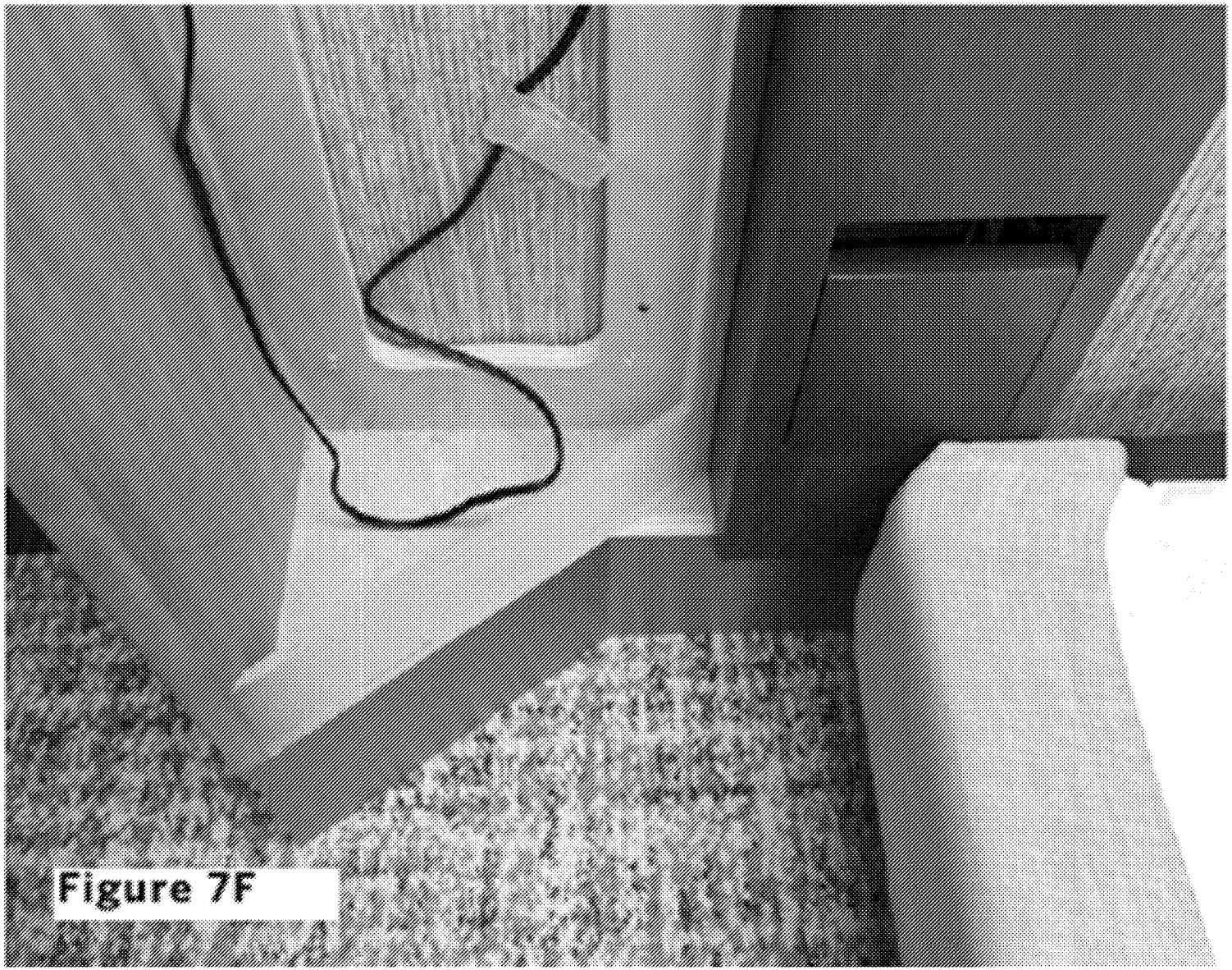
Figure 7G:
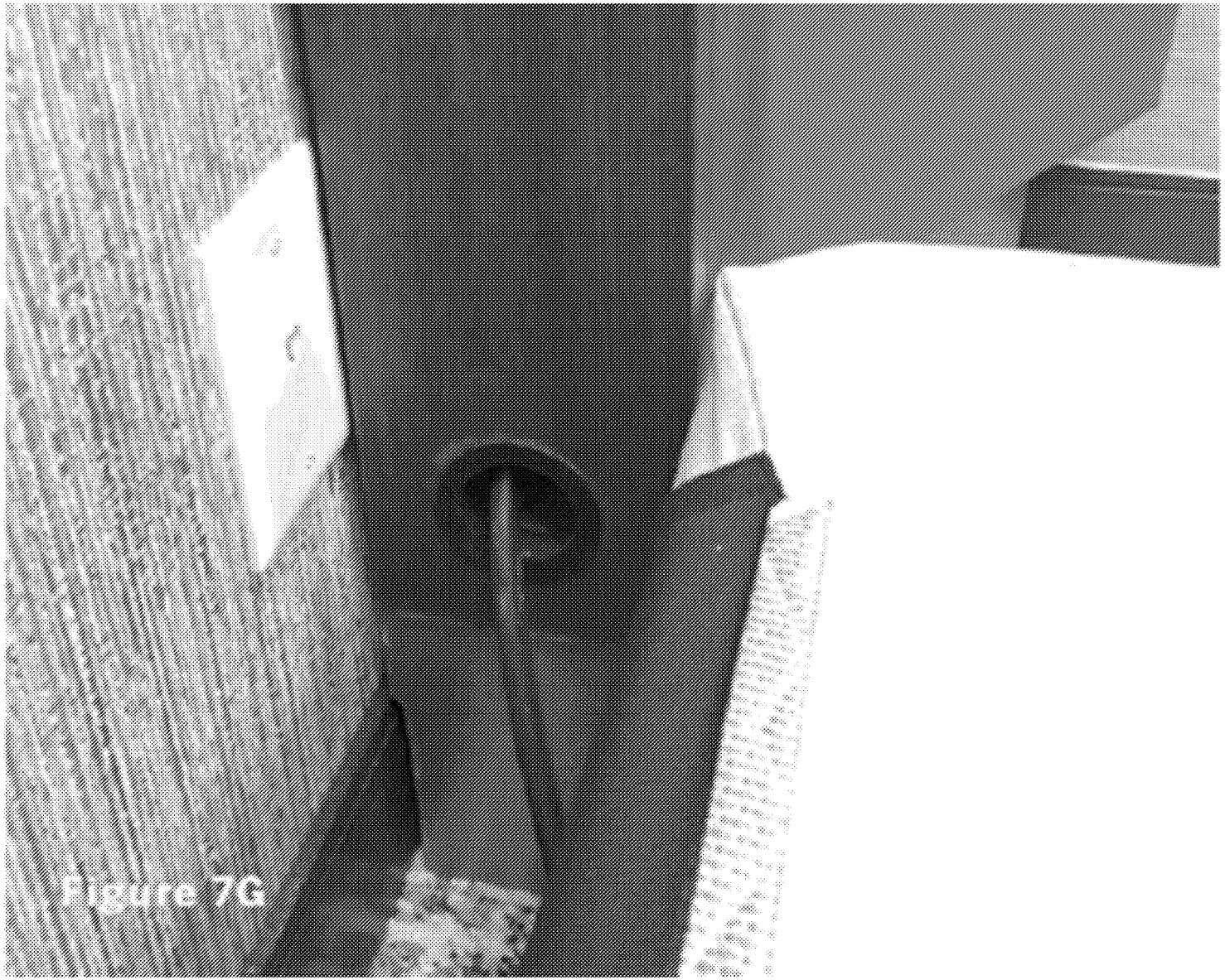
Figure 7H:
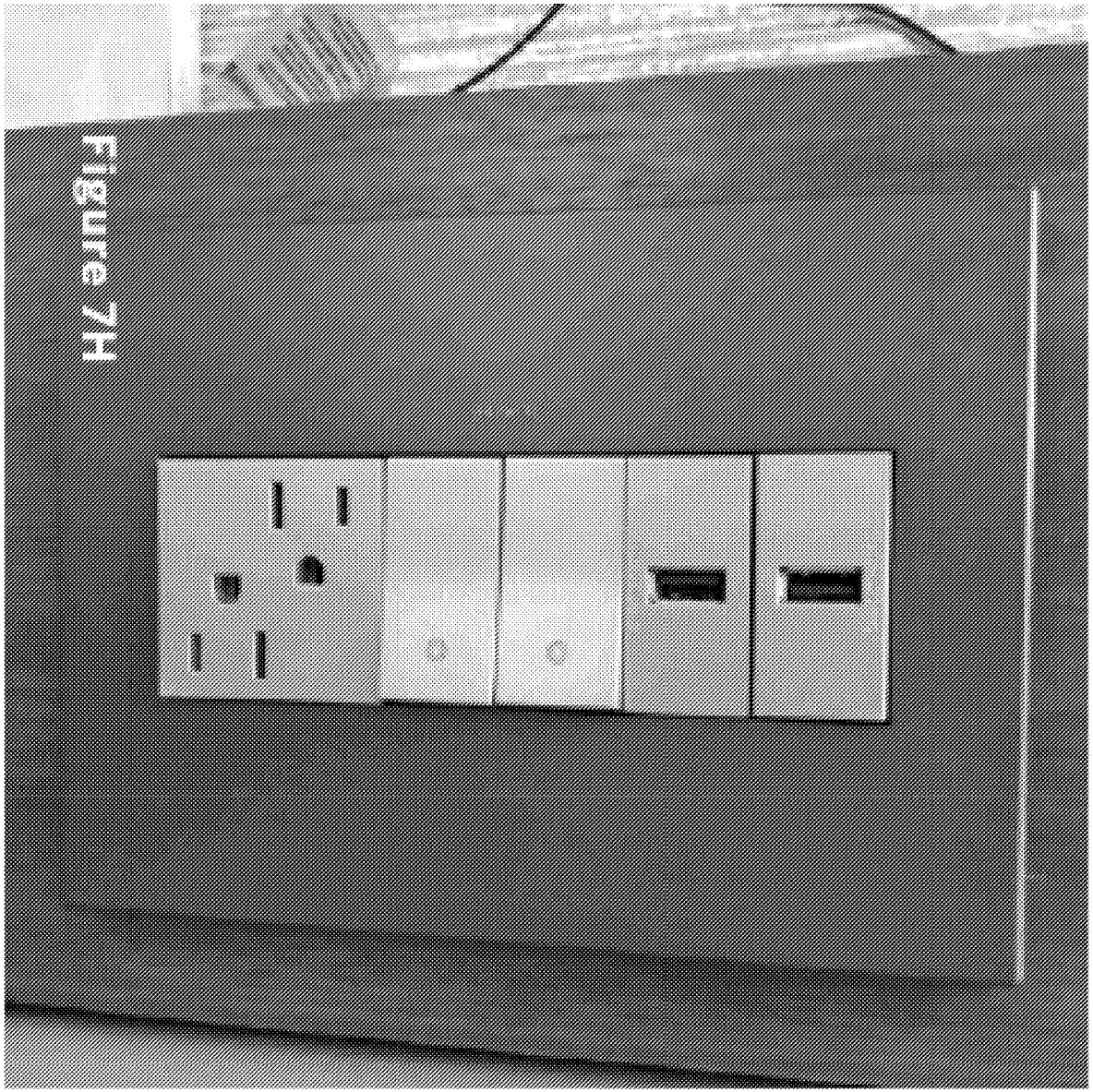

FIG. 7A illustrates an example side panel and chase. FIGS. 7B-7D illustrates an example side frame. FIG. 7E illustrates an example inside of an example chase with an example power unit. FIG. 7F illustrates an example inside of an example side frame where wall power can be accessed. FIG. 7G illustrates an example access area for power in a chase. FIG. 7H illustrates an example power area on a chase.

Figure 7J:
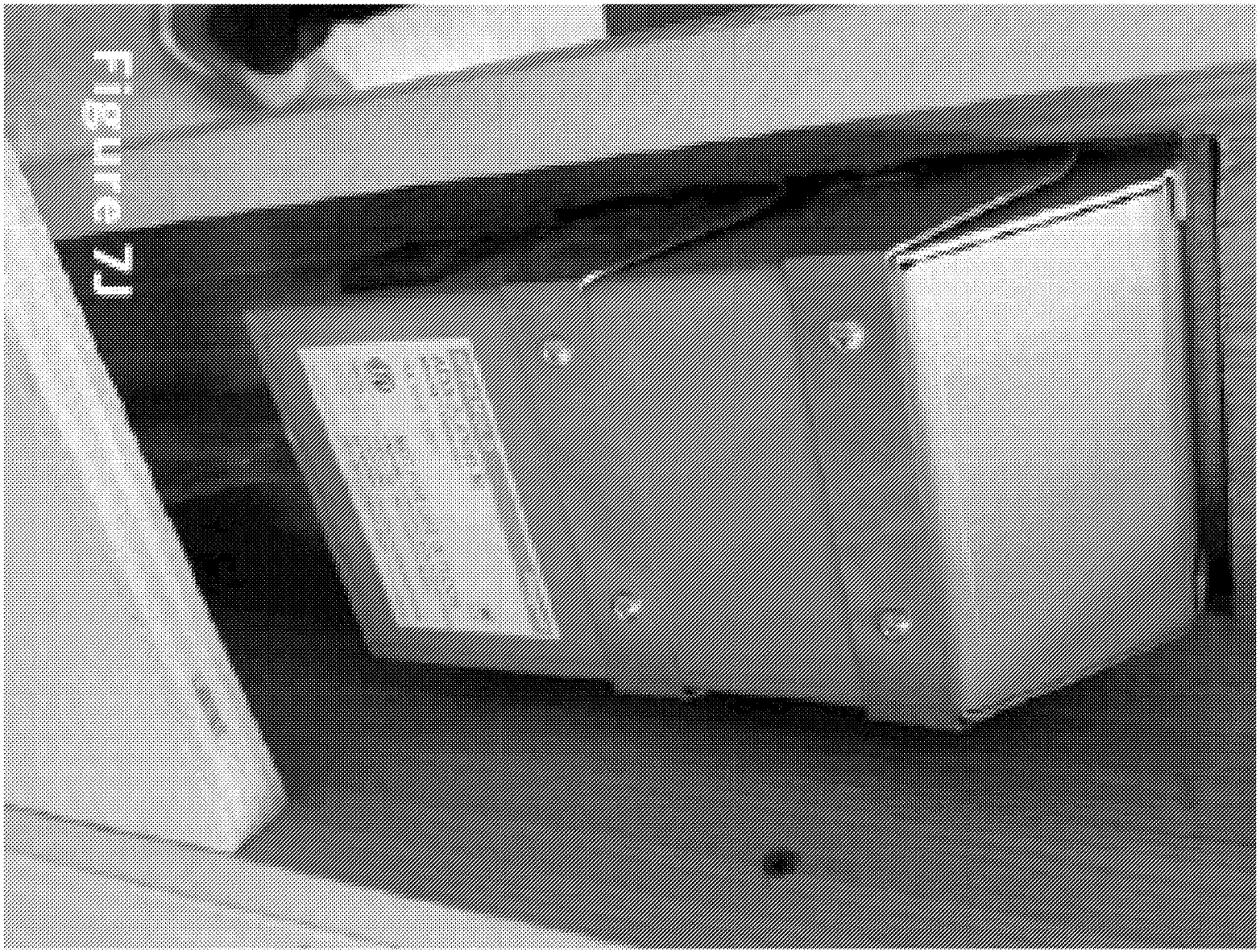

FIGS. 7E, 7H and 7J illustrate an example power unit (e.g., LE GRAND power unit) that can be in a side frame, a back frame, or a chase.

Figure 10:
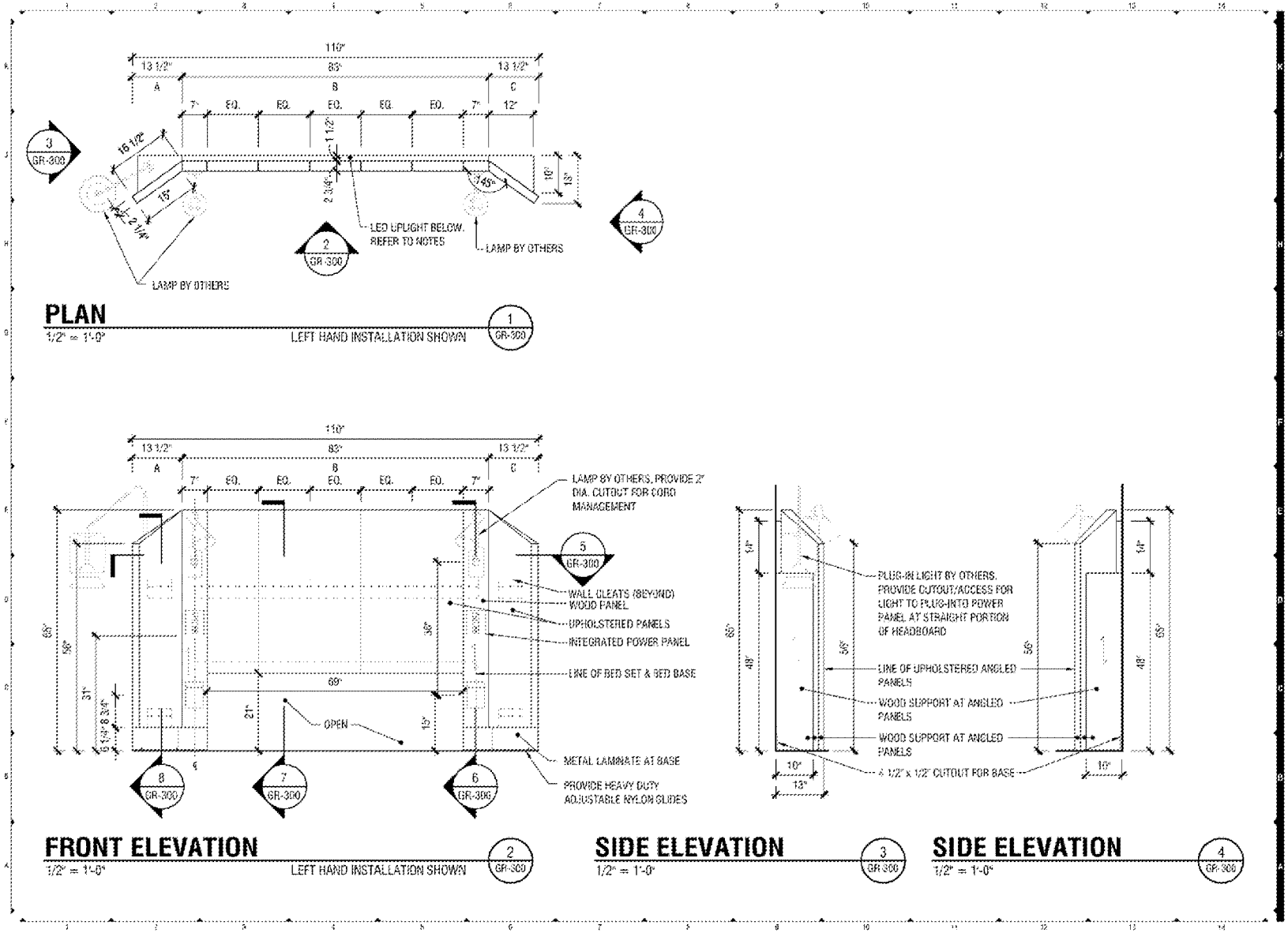

FIG. 10 illustrates various example details related to an example headboard and example headboard components, according to aspects of the disclosure. These details are for example purposes only, and many variations may be used. A wood finish can be used on part or all of the headboard elements. The headboard elements can be flat cut and quartersawn. A metal laminate can also be used for some or all of the headboard elements. Exposed wood finish surfaces can comprise a durable acrylic and/or polyurethane sealant that can be scratch, moisture, or burn resistant, or any combination thereof. The headboard and/or headboard elements (e.g., panels, sideboards, etc.) can be securely attached to the wall to prevent tipping. Lights may be attached to the headboard and/or to the wall. A light fixture (e.g., LED uplight) can be used, and can comprise, for example: 24V tape light, an aluminum channel with diffuser and end caps, LED driver and controller, clips, cables, or other accessories, or any combination thereof. A plug-in fixture can be integrated into a headboard panel (e.g., center panel and/or another panel) to uplight the wall behind the headboard with end to end connection and/or smooth continuous light. Power panel controls can include switching for plug-in furniture lights. For example, switching on one side of the headboard can control a nightstand sconce above and/or a lounge chair task lamp. Switching on the other side can control a nightstand sconce above and/or an LED headboard uplight. Alternatively, one switch panel and/or switch can be used that controls everything (e.g., nightstand sconce, task lamp, headboard uplight, etc.). Any switch panel and/or switch can control any light elements. Various types of plug-ins (e.g., for any type of device such as phone, computer, mobile device, or any other electronic device) can be provided on any headboard panel (e.g., the center panels or the side panels where the panel controls are shown in FIG. 10). In addition, an access panel can be provided so that it is easy to access wall plug-ins. In some aspects of the disclosure, non-LED lights may also be used for any light element described in this document.

Figure 11A:
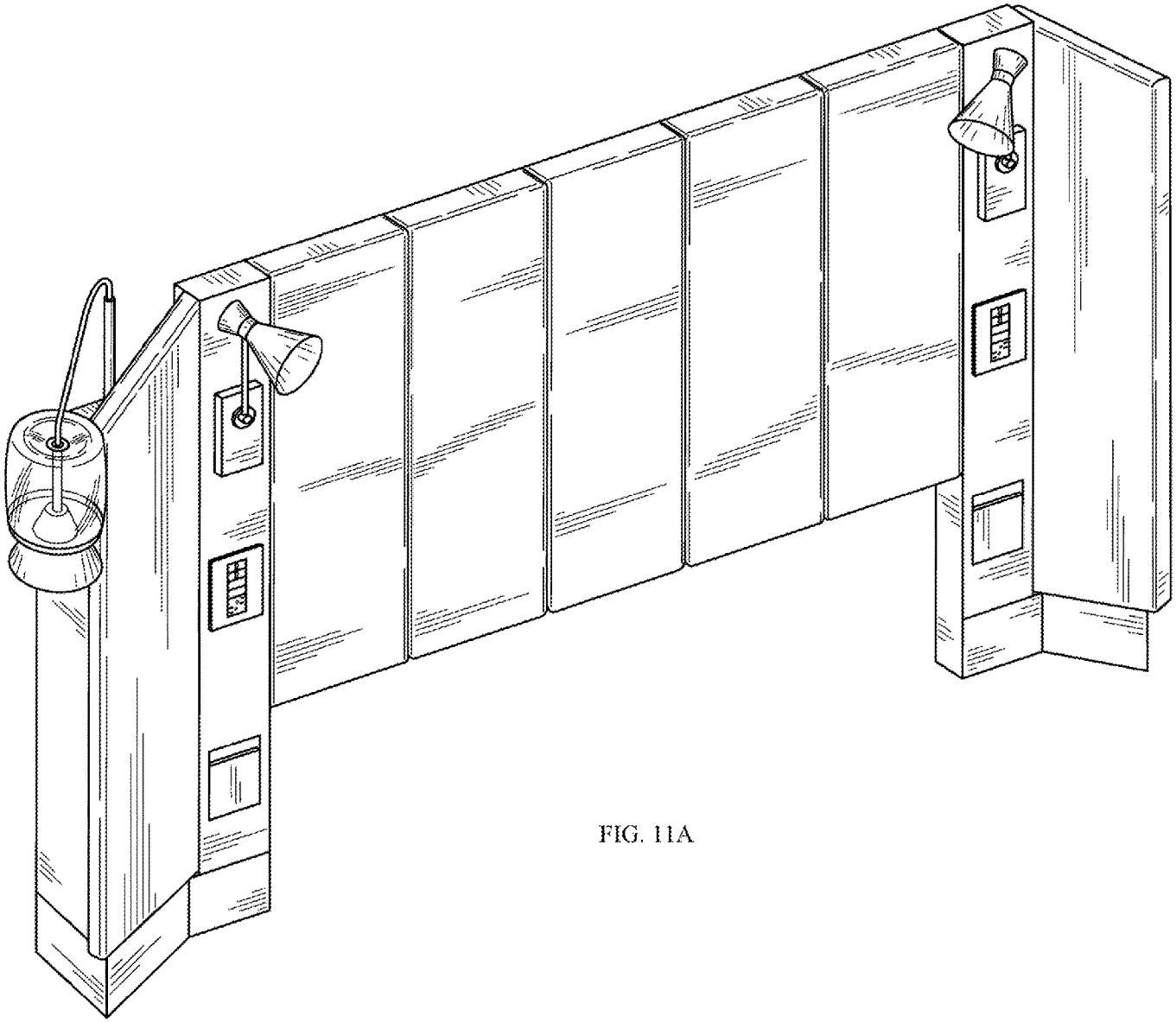
FIG. 11A-FIG. 11AJ illustrate example headboards and example headboard components, according to aspects of the disclosure.
Figure 11B:
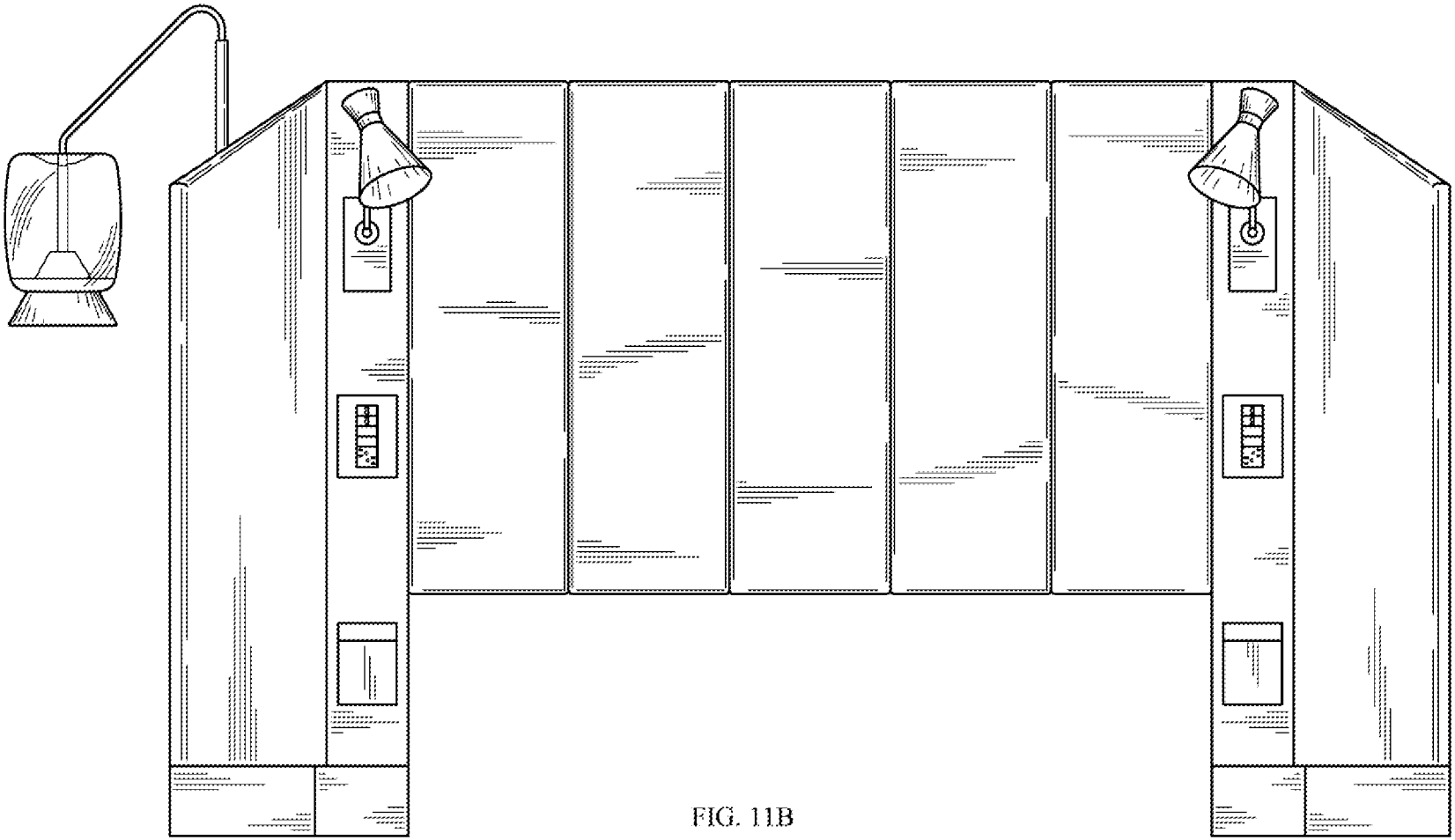
Figure 11C:
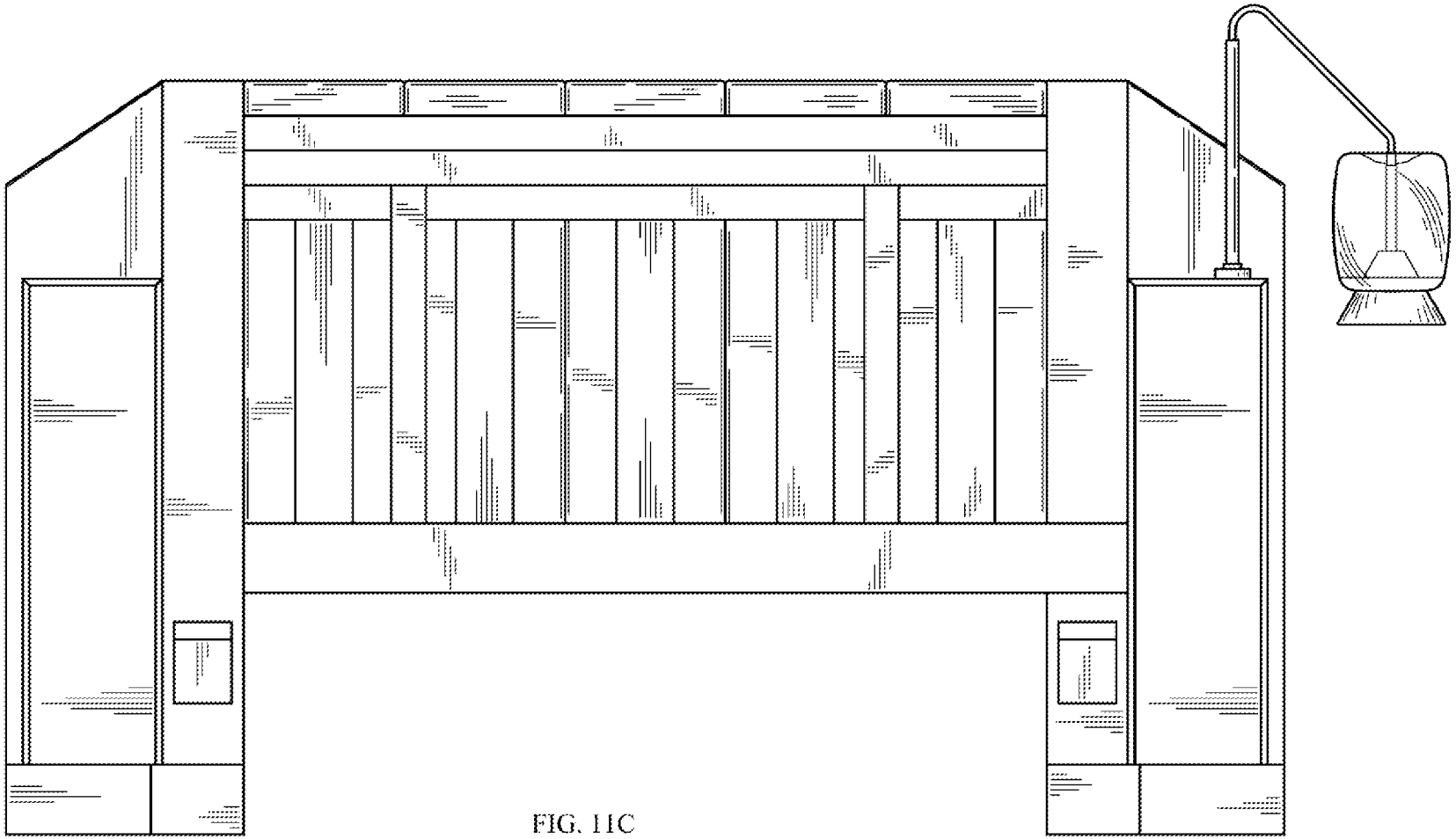
Figure 11E:
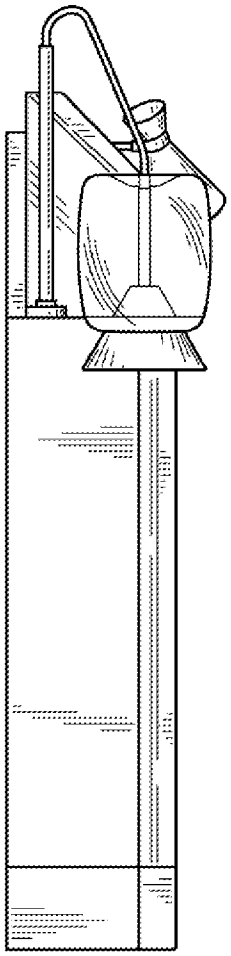
Figure 11D:
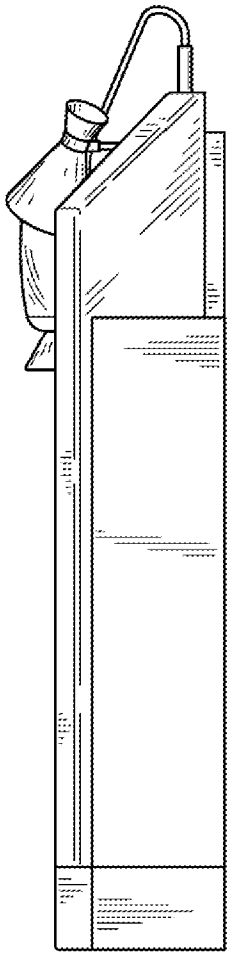
Figure 11F:
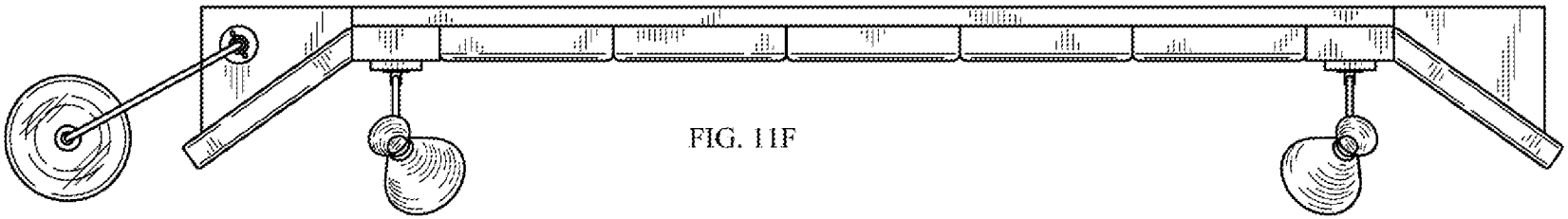
Figure 11G:
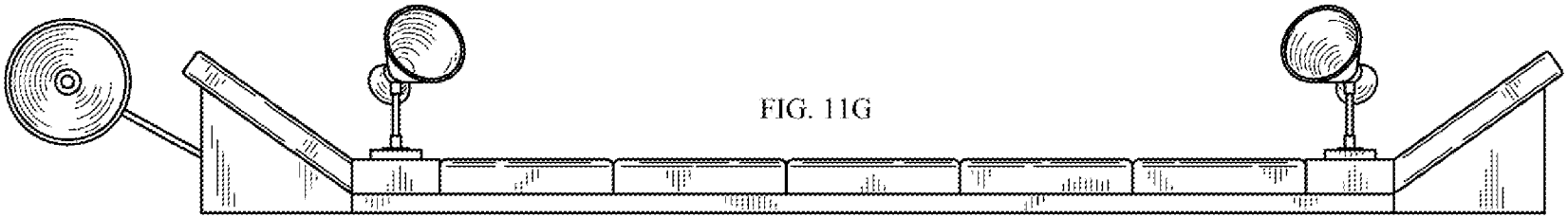
Figure 11B:
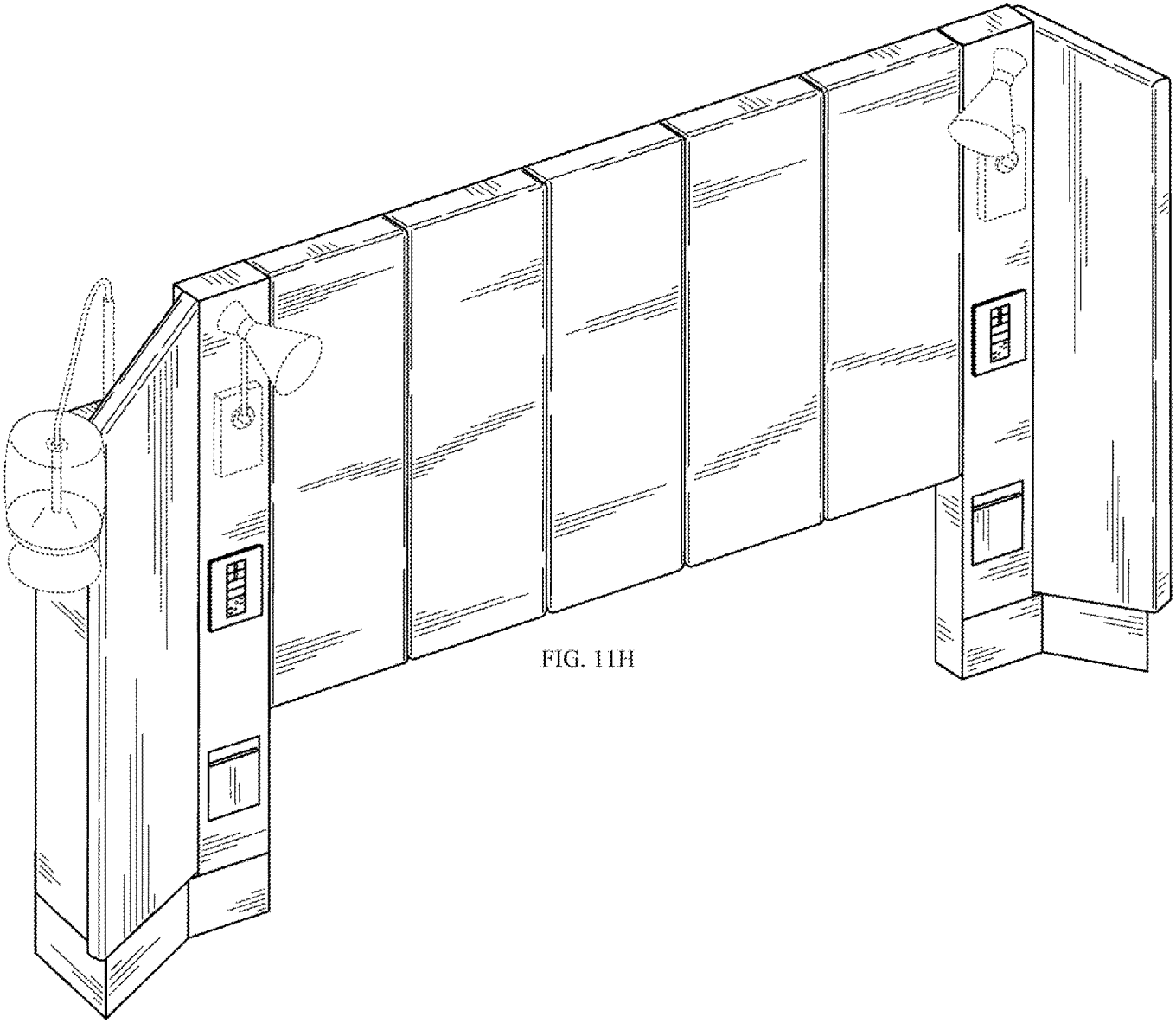
Figure 111:
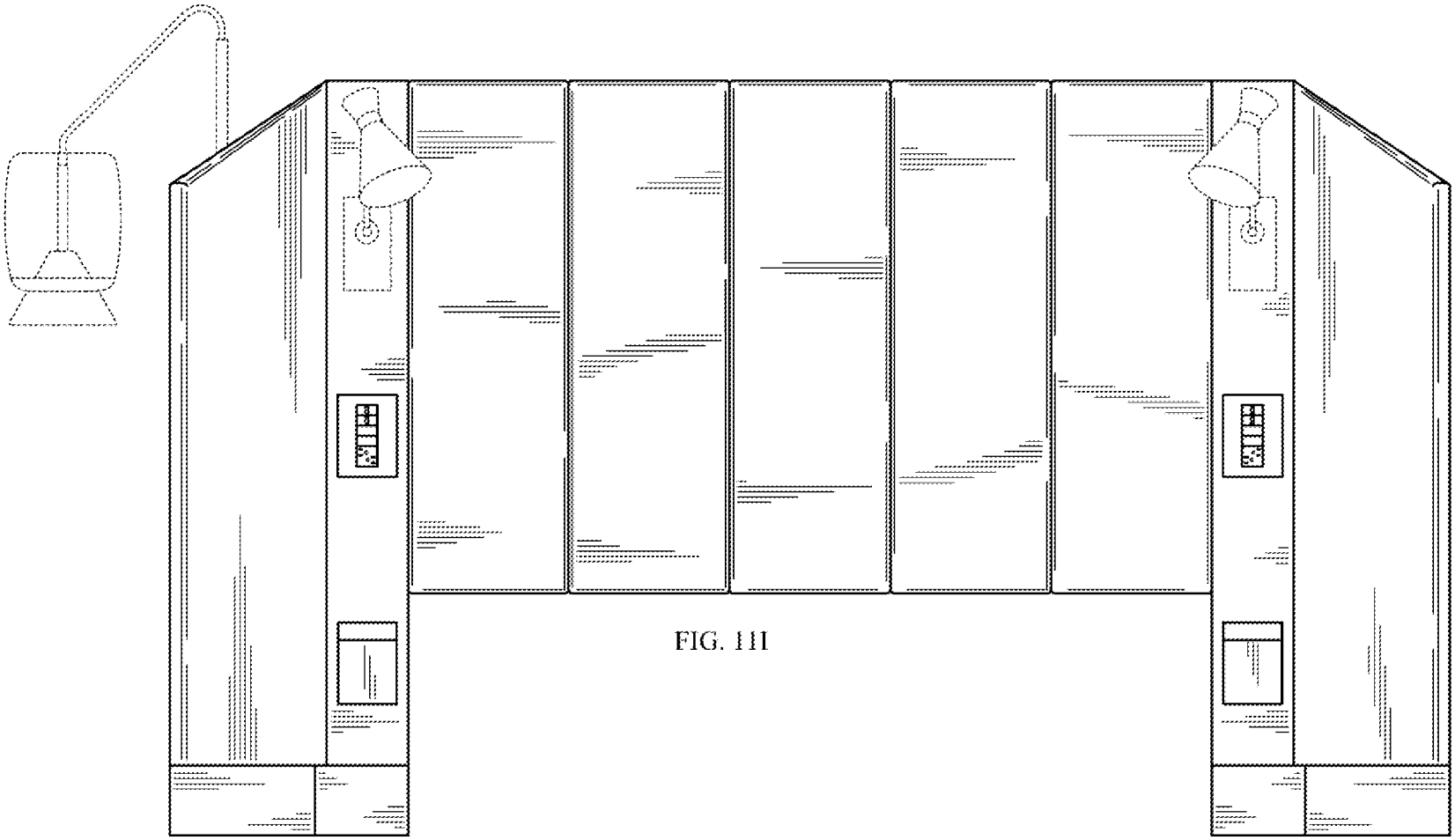
Figure 11J:
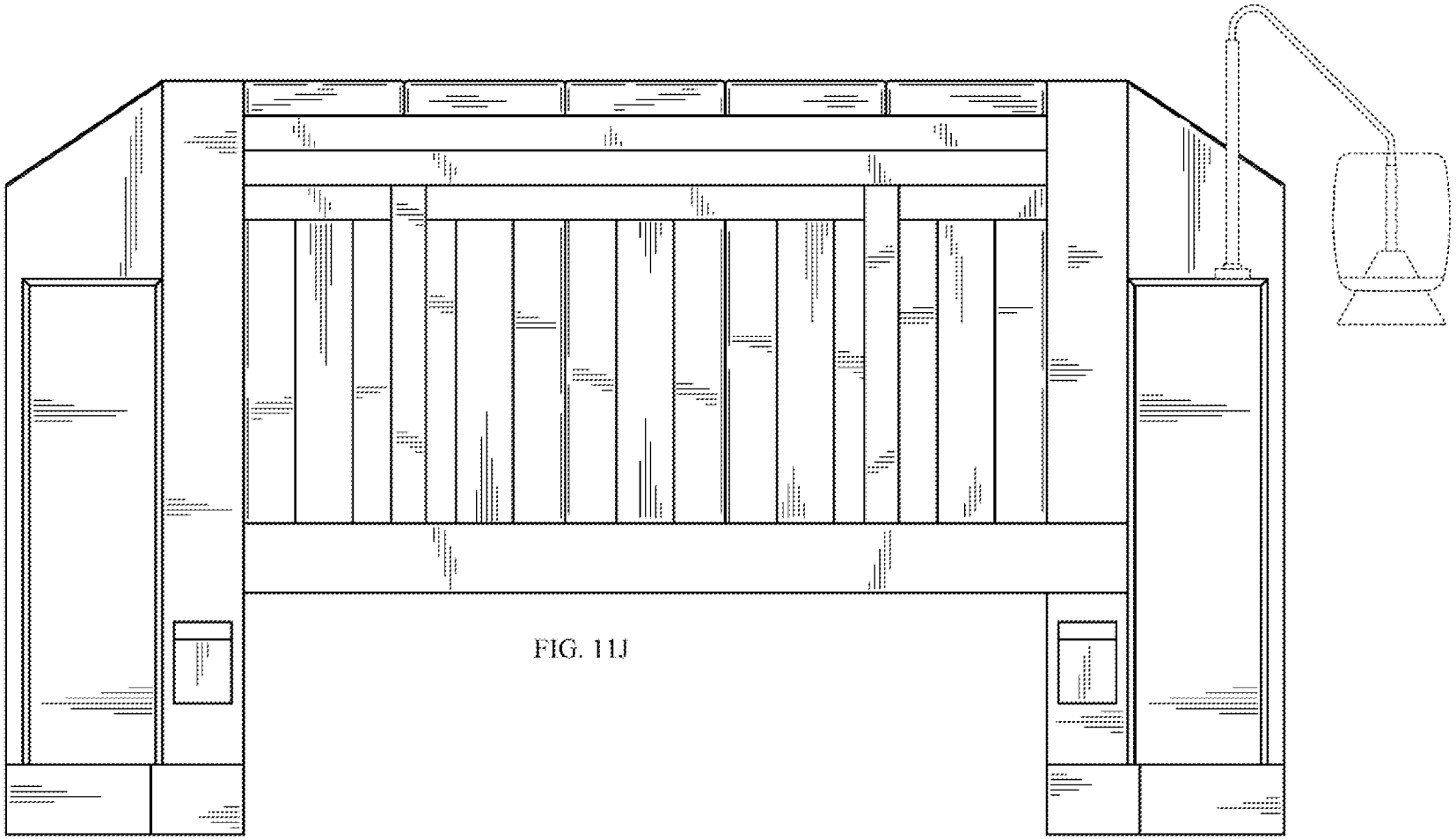
Figure 11L:
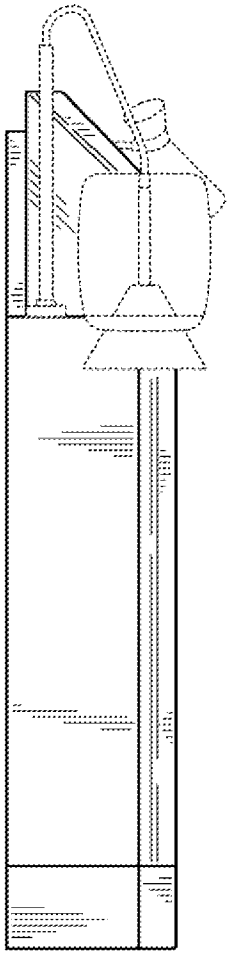
Figure 11K:
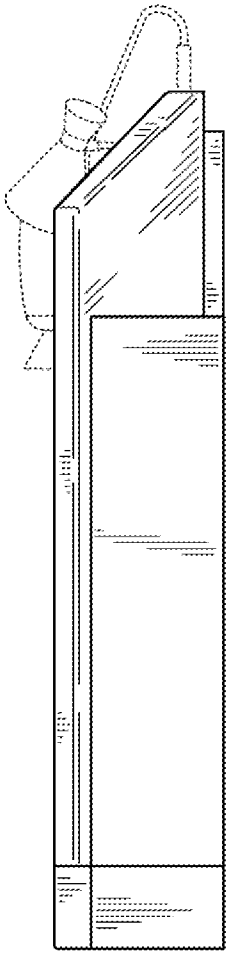
Figure 11M:
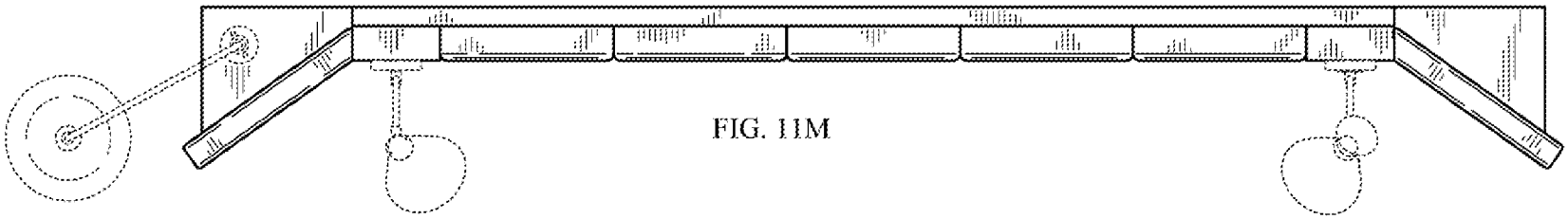
Figure 11N:
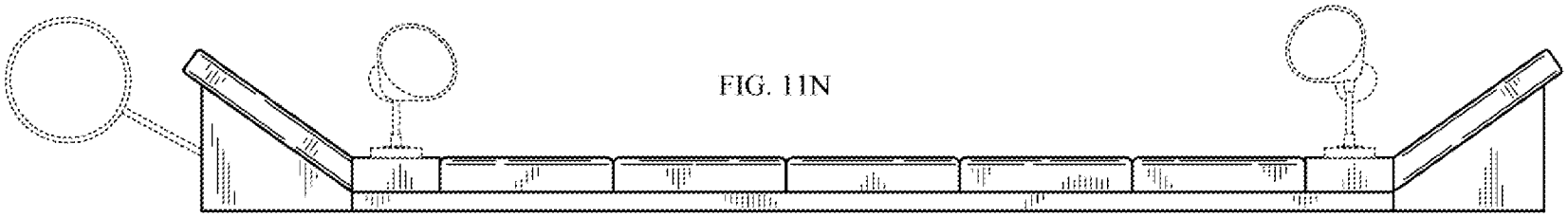
Figure 11O:
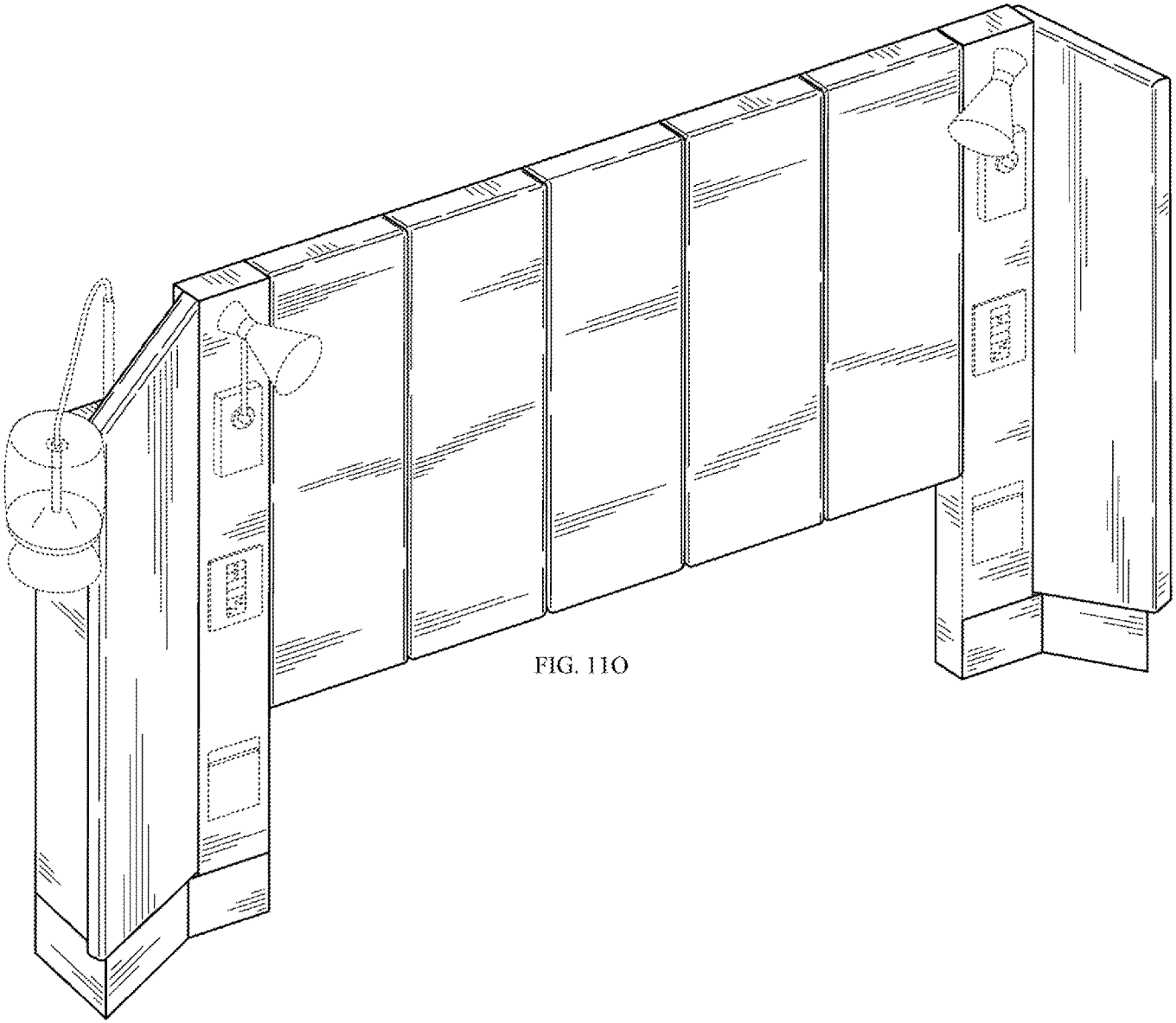
Figure 11P:
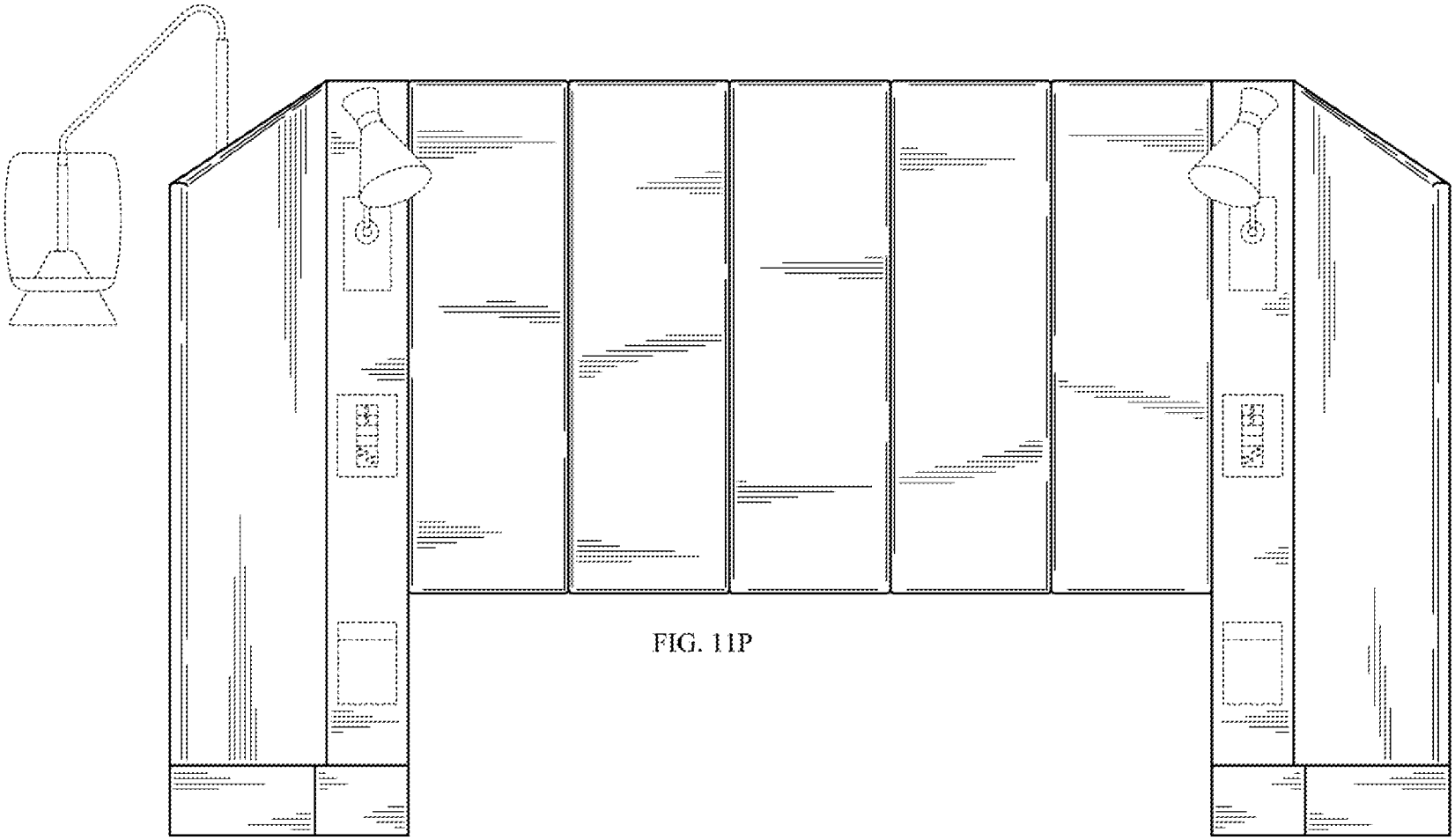
Figure 11Q:
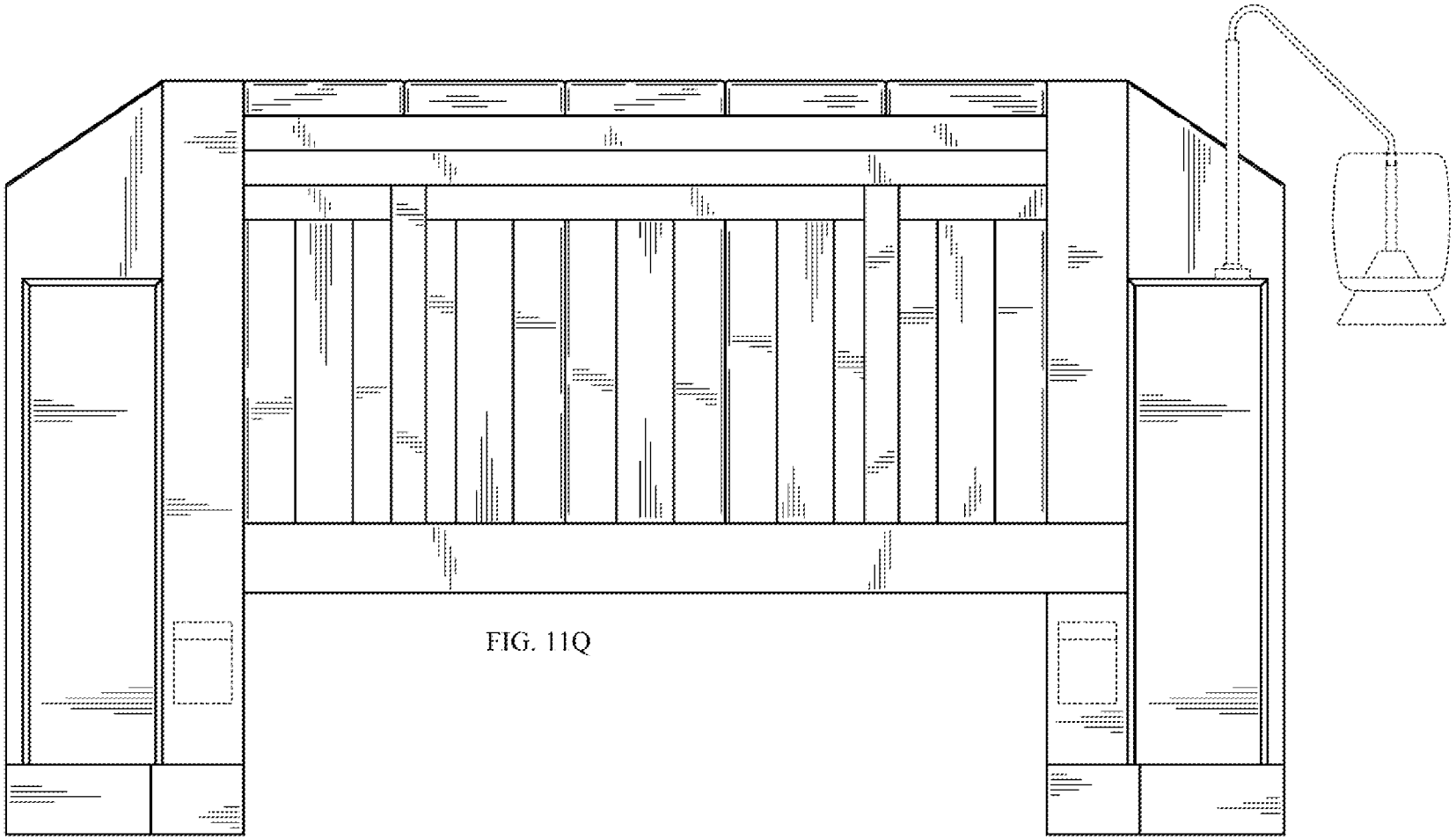
Figure 11S:
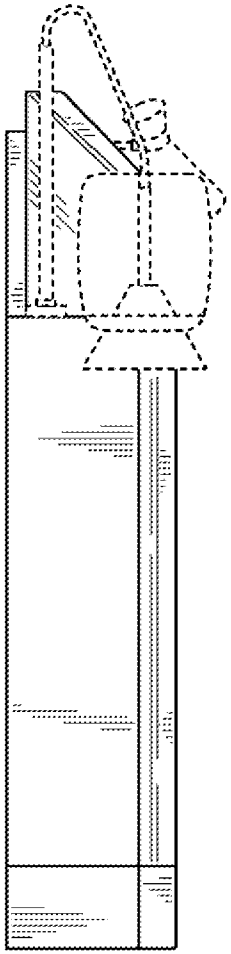
Figure 11R:
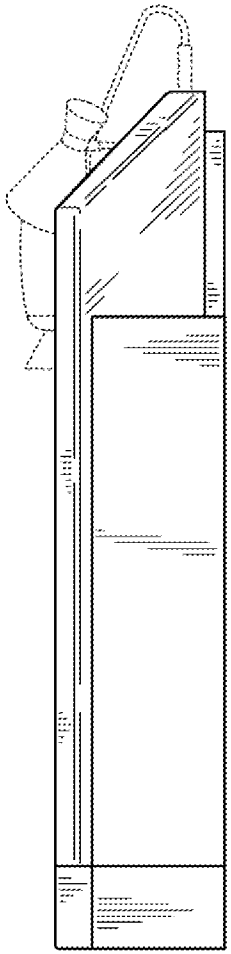
Figure 11T:
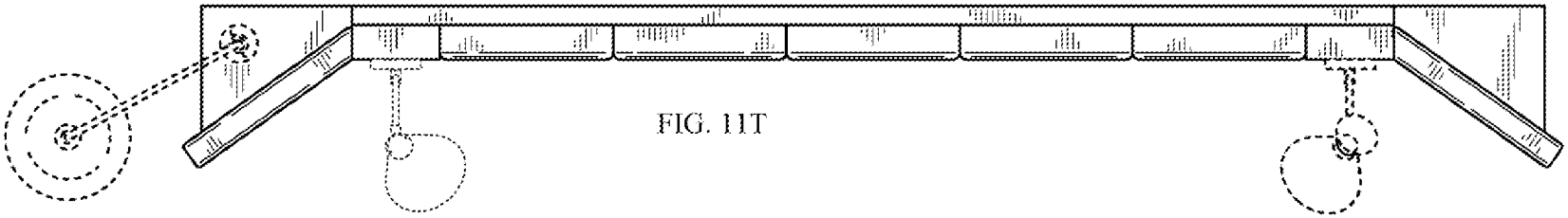
Figure 11U:
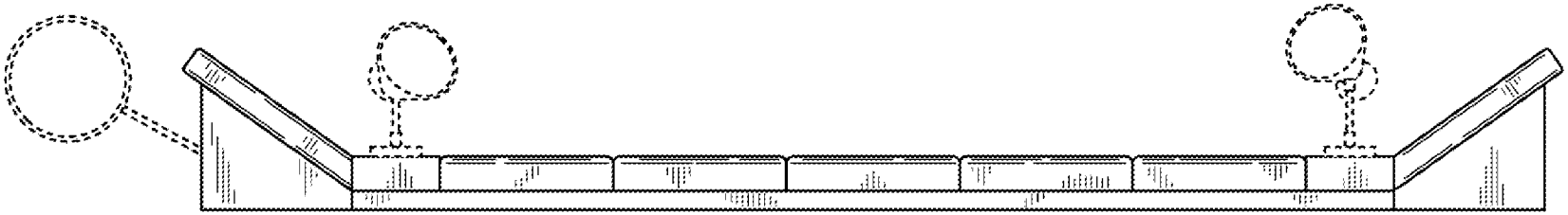
Figure 11V:
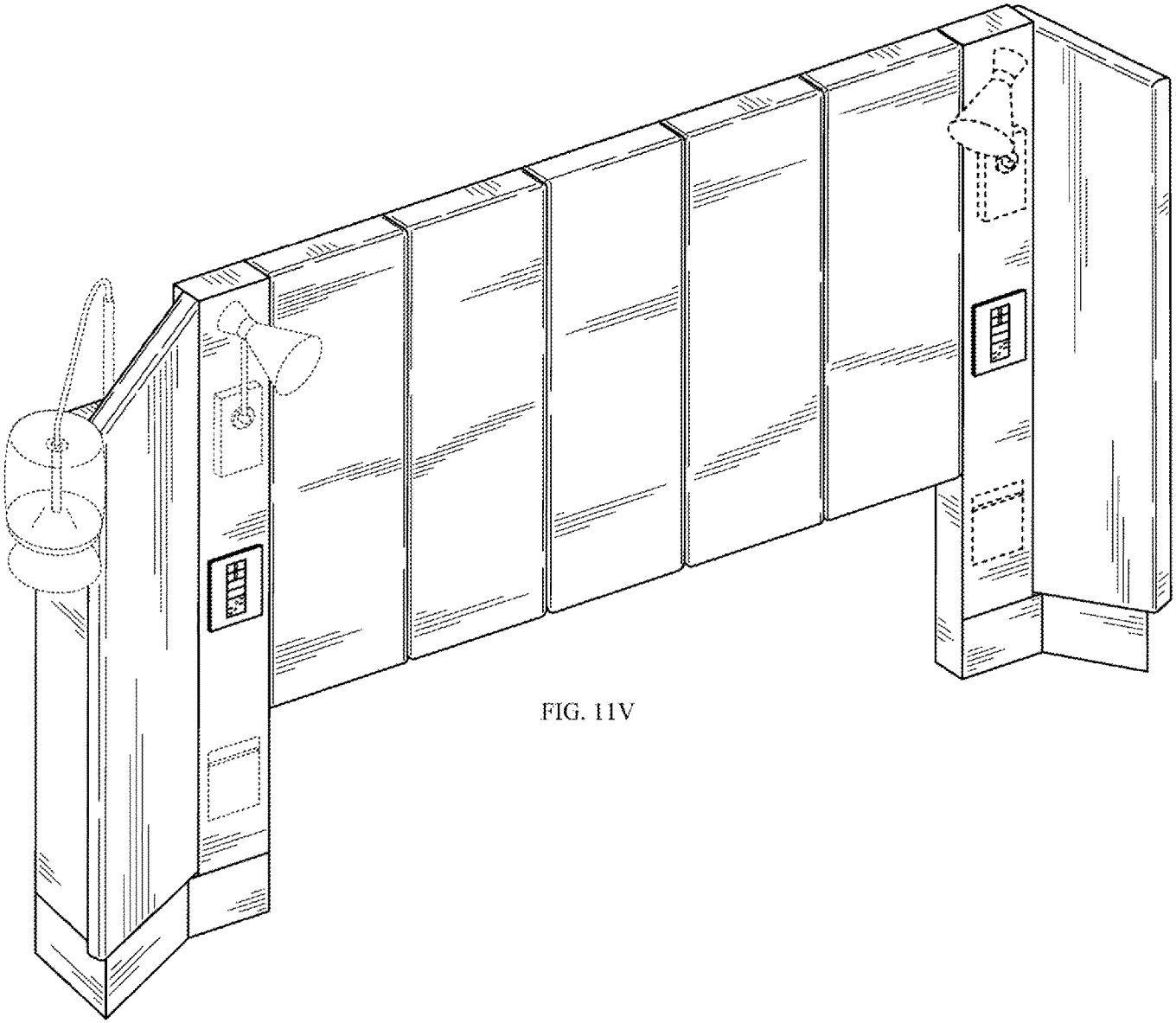
Figure 11W:
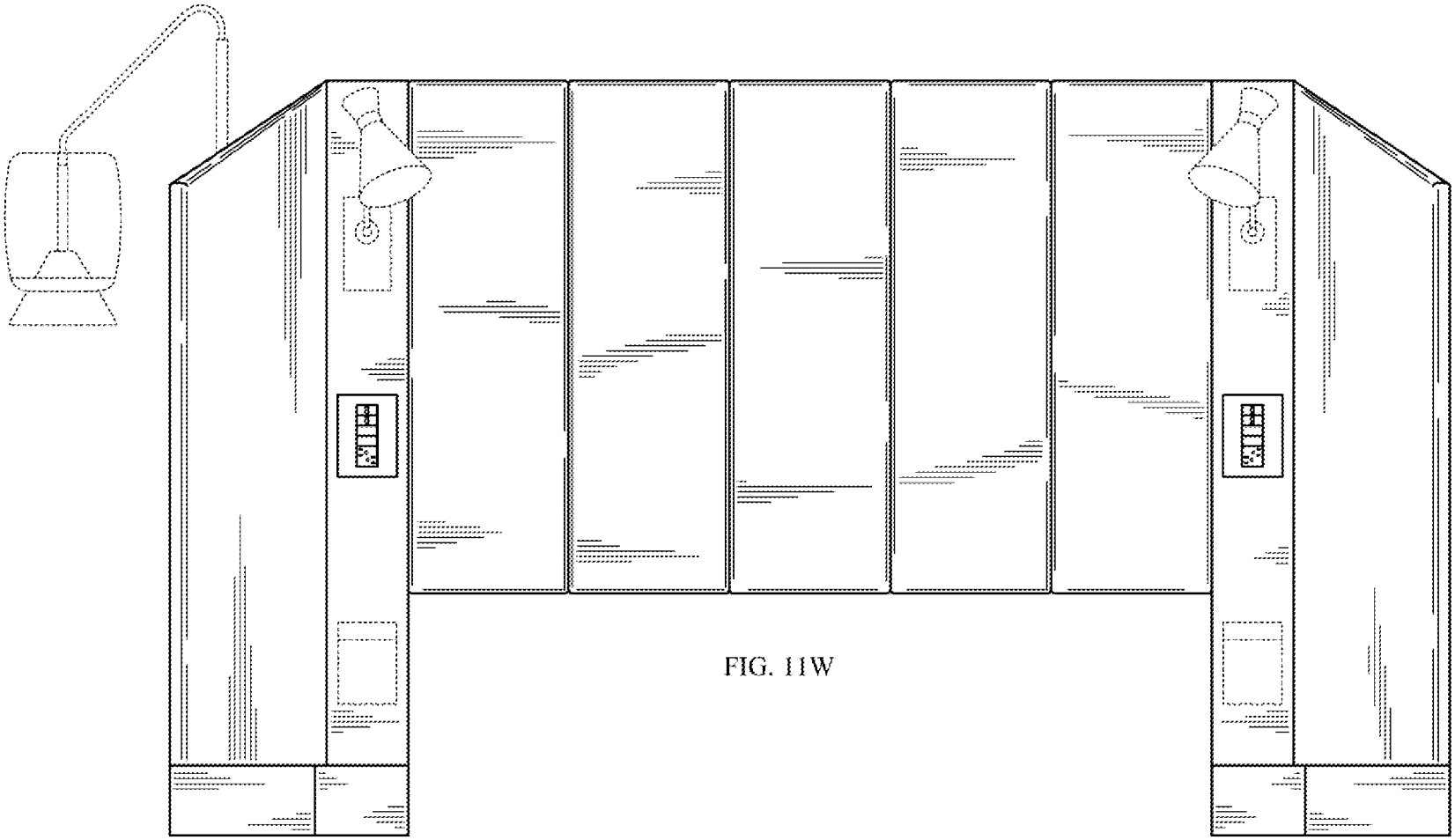
Figure 11X:
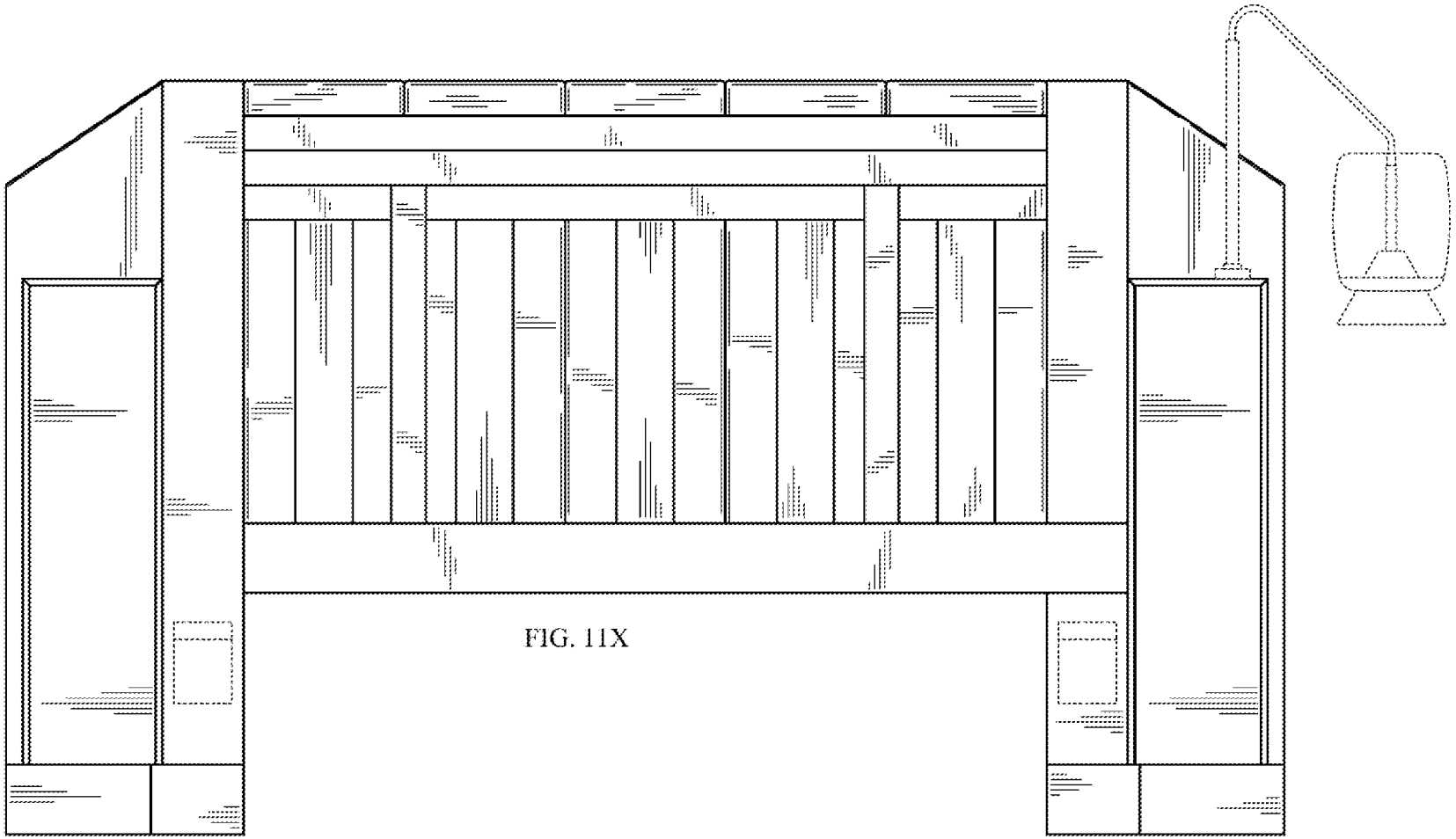
Figure 11Z:
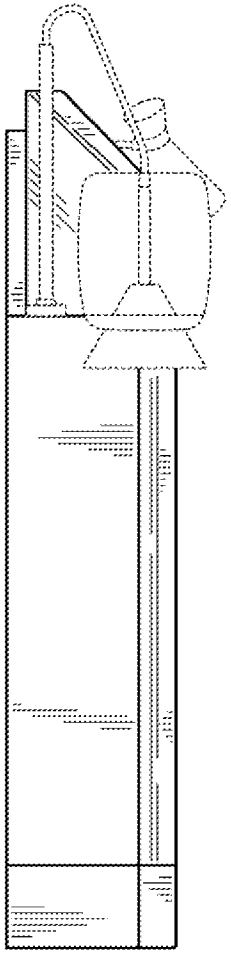
Figure 11Y:
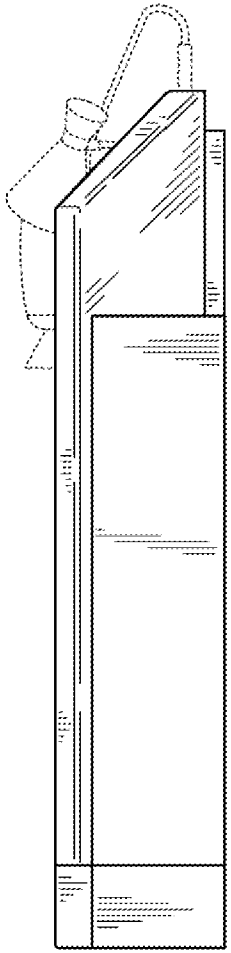
Figure 11A:
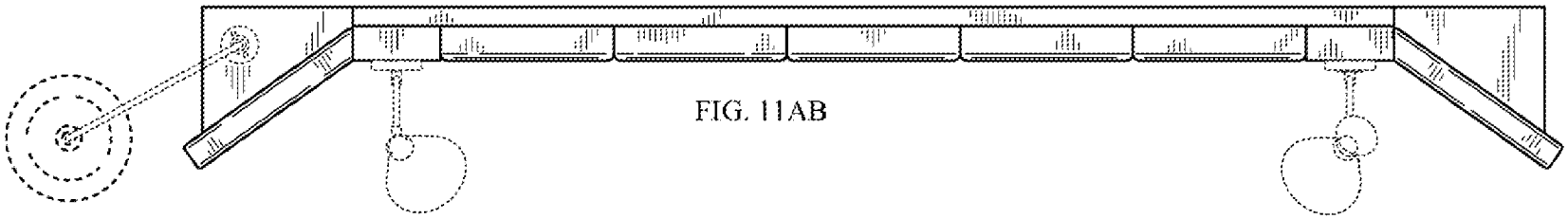
Figure 11A:
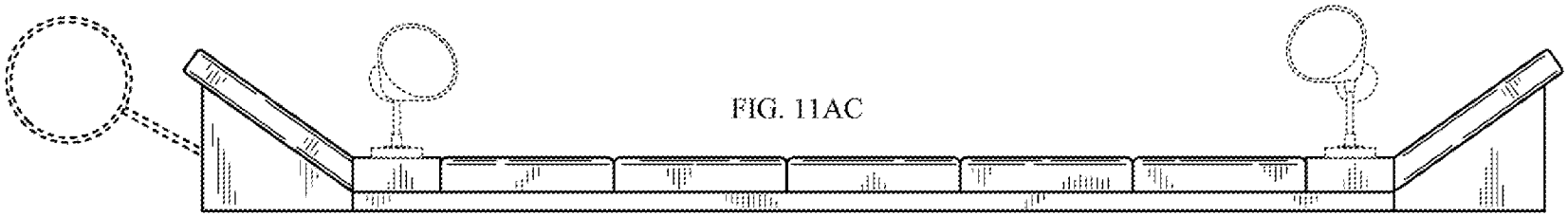
Figure 11A:
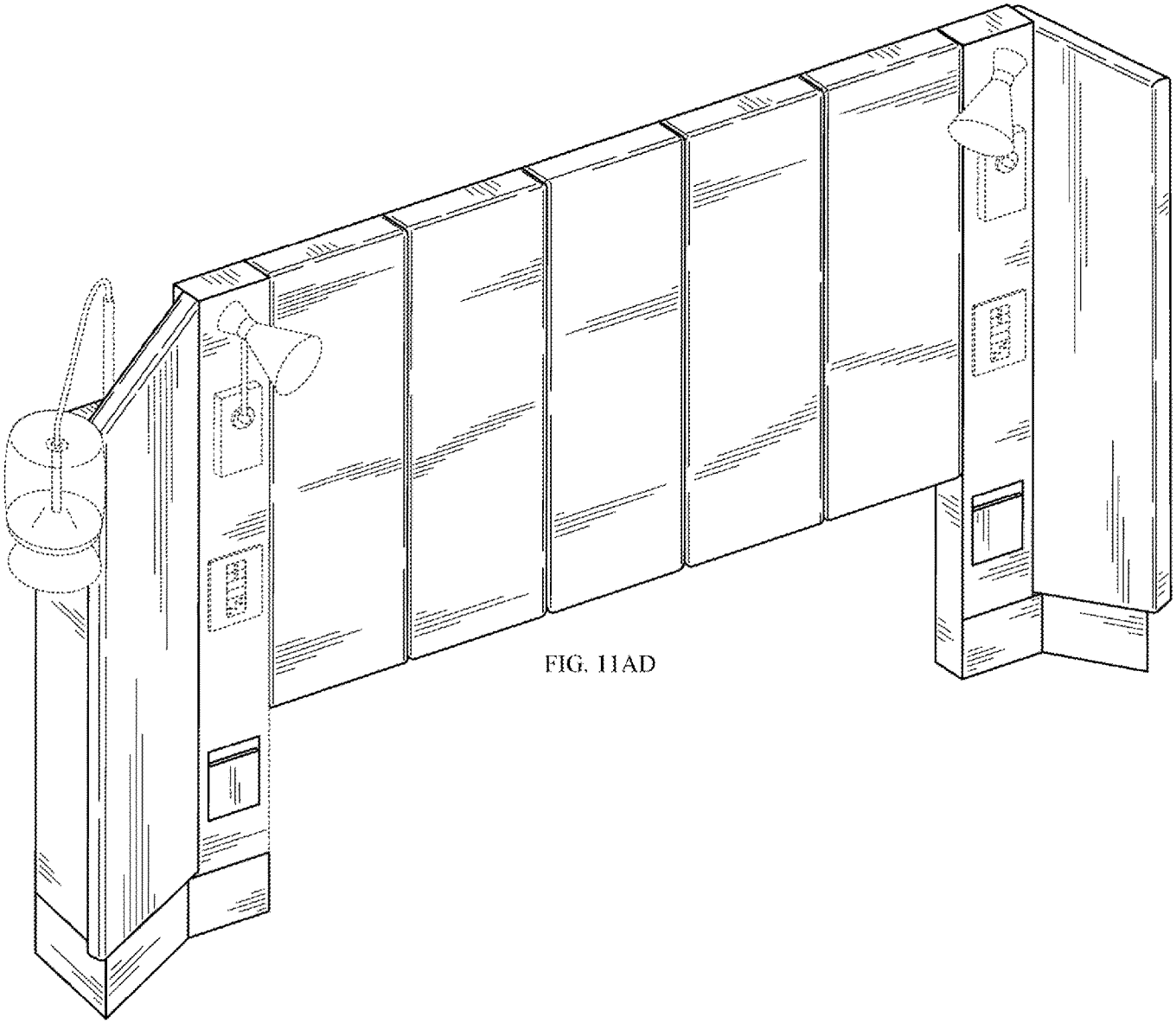
Figure 11A:
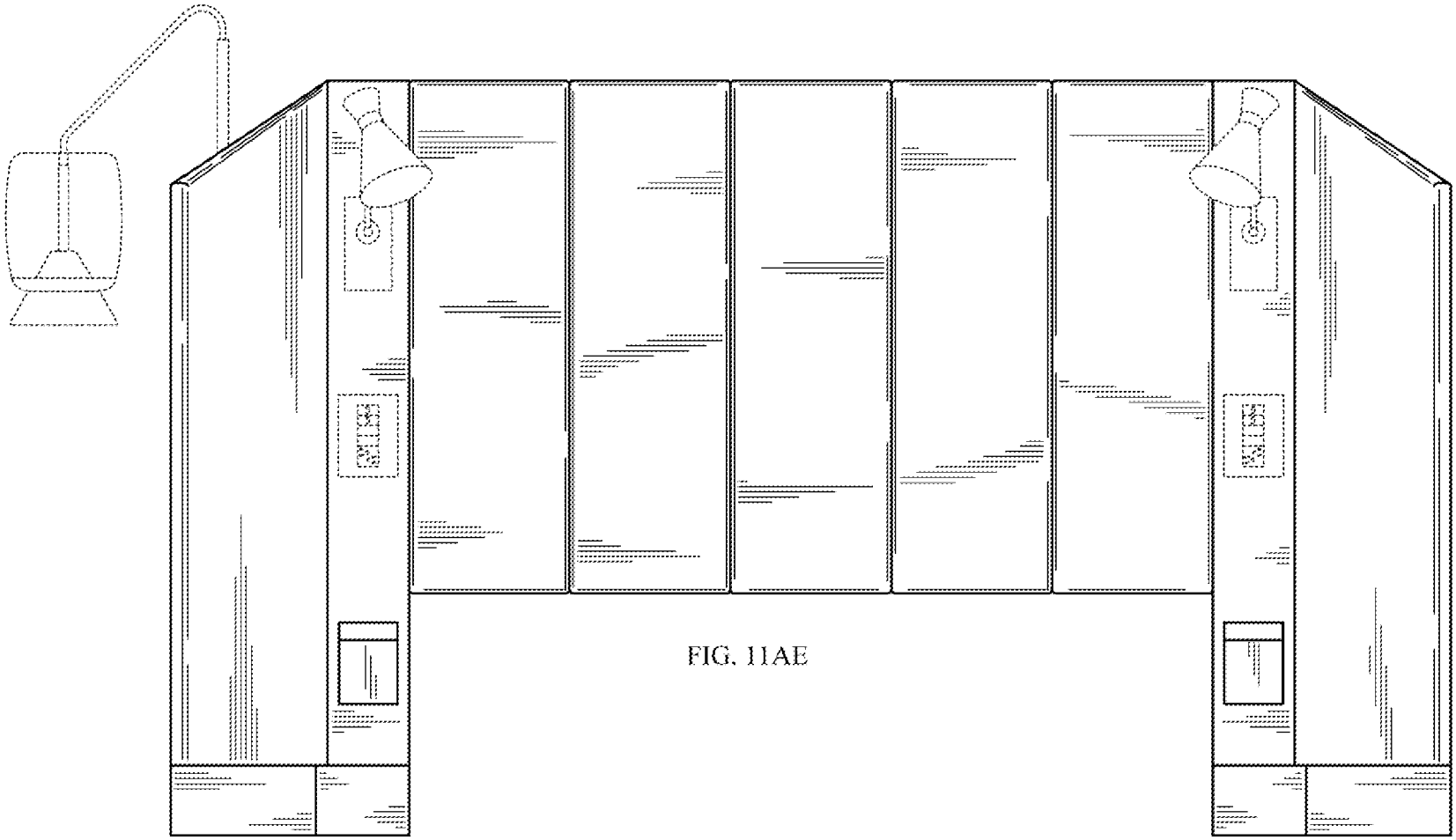
Figure 11A:
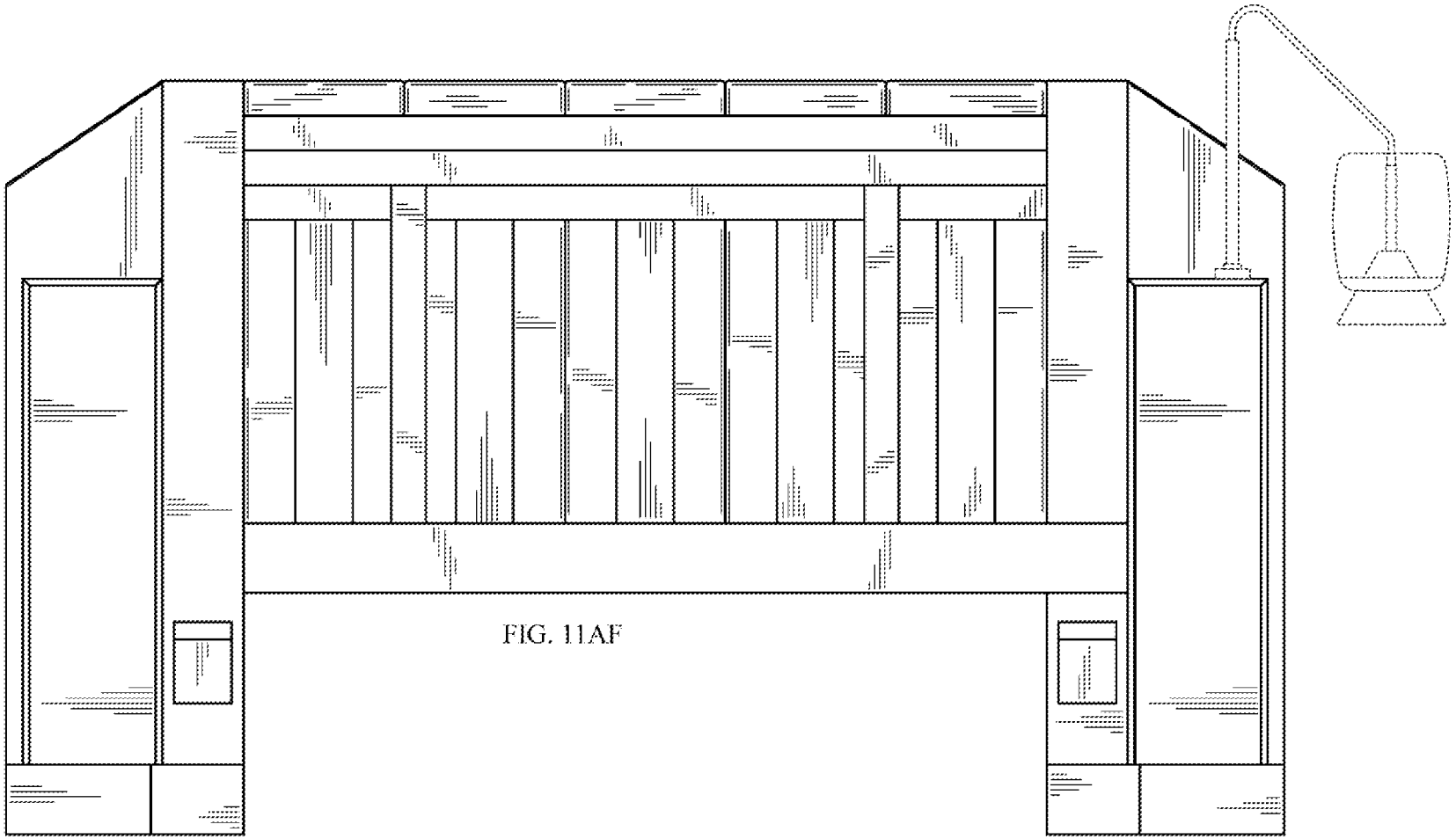
Figure 11A:
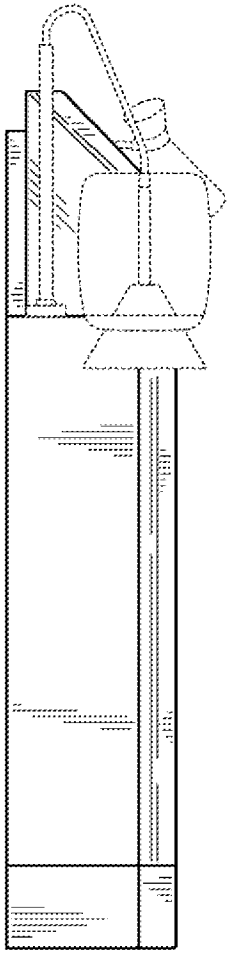
Figure 11A:
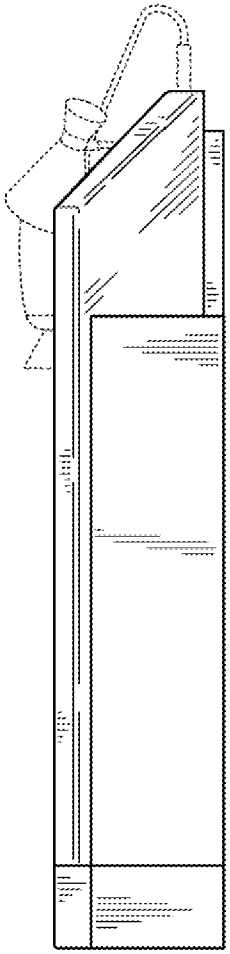
Figure 11A:
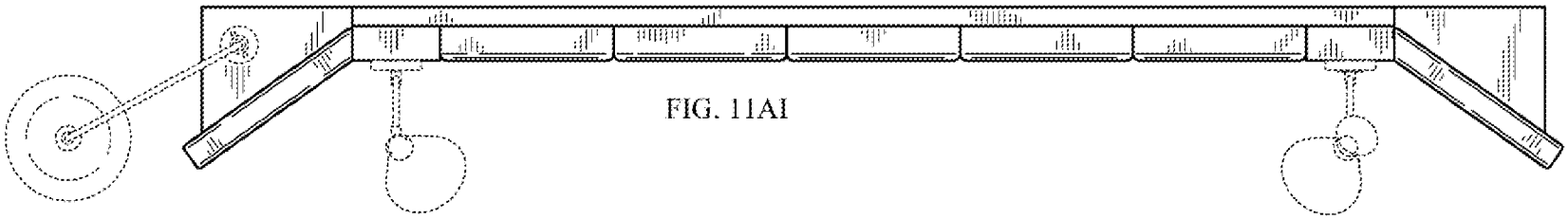
Figure 11A:
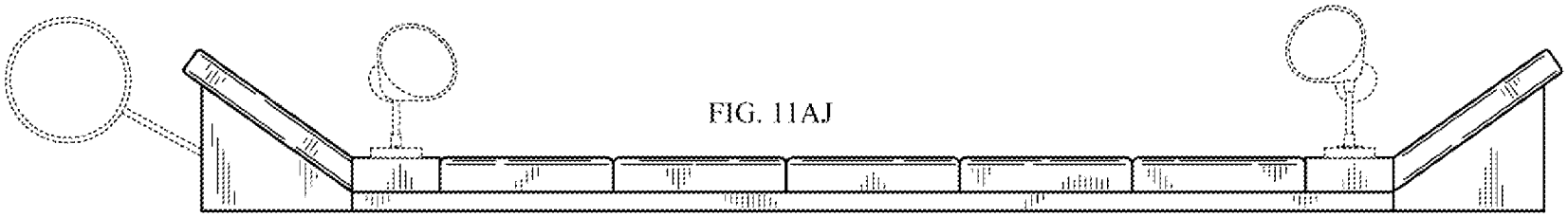

FIGS. 11A-11AJ illustrate various details related to an example headboard and example headboard components, according to aspects of the disclosure. Several variations of the headboard are shown in FIGS. 11A-11AJ. For each variation, a perspective, front, back, sides, top, and bottom views are shown. FIG. 11A-11G illustrate one variation. FIG. 11H-FIG. 11N illustrate a second variation. FIG. 11O-11U illustrate a third variation. FIG. 11V-11AB illustration a fourth variation. FIG. 11AC-FIG. 11AJ illustrate a fifth variation.

In some embodiments, an example headboard can be assembled including the components described above. For example, the following example steps can be used: preparing a back frame to hold back panels; preparing individual back panels for connecting to the back frame using cleating; connecting the back panels to the back frame using the cleating; preparing a side frame to hold side panels; preparing individual side panels for connecting to the side frame using cleating; and connecting the side panels to the side frame using the cleating. A chase can also be made to contain power elements, the chase made for connecting to a back panel and/or a side panel. The chase can be connected to a back panel and/or a side panel.

It is to be understood that the disclosed subject matter is not limited in its application to the details of construction and to the arrangements of the components set forth in the description or illustrated in the drawings. The disclosed subject matter is capable of other embodiments and of being practiced and carried out in various ways. Accordingly, other implementations are within the scope of the following claims. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

In addition, it should be understood that any figures which highlight the functionality and advantages are presented for example purposes only. For example, the specific details shown on the figures are example embodiments only, and any combination of these details may be used. The disclosed methodology and system are each sufficiently flexible and configurable such that they may be utilized in ways other than that shown. For example, other steps may be provided, or steps may be eliminated, from the described flows, and other components may be added to, or removed from, the described systems. In addition, the order of the steps illustrated or described may be changed.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A headboard, comprising:

multiple back panels connected together to frame a mattress, each back panel capable of being separated from the other back panels and capable of being individually covered and/or replaced, wherein the multiple back panels, when connected, comprise a bed-facing surface, an outward surface opposite the bed-facing surface, a bottom surface, a top surface, and two side surfaces;

a wing panel on at least one side surface of two of the multiple back panels, each wing panel tilted inward towards the mattress, and each wing panel capable of being individually covered and/or replaced;

a chase for attaching outlets and/or switches, wherein the chase bridges a plurality of panels from the group comprising: at least one of the multiple back panels and at least one of the wing panels, and wherein the chase is an opening in at least one of the two side surfaces; and an access panel integrated into the chase to conceal cords and/or cables, wherein a grommet in the access panel is configured to hold the cords and/or cables.

2. The headboard of claim 1, wherein the chase comprises a bottom opening for the cords and/or cables to be plugged into a wall near the headboard.

3. The headboard of claim 1, wherein the multiple back panels do not extend to a floor such that cables and/or cords are capable of being plugged into a wall under the headboard.

4. The headboard of claim 1, wherein back panel material is different from wing panel material.

5. The headboard of claim 1, wherein back panel material is the same as wing panel material.

6. The headboard of claim 1, wherein the chase further comprises integrated lighting.

7. The headboard of claim 6, wherein the lighting is configured to uplight a wall behind the headboard.

8. The headboard of claim 1, wherein at least one of the multiple back panels is attached using cleating.

9. The headboard of claim 1, wherein the wing panel is attached to the at least one side surface using cleating.

10. The headboard of claim 1, further comprising a power unit integrated into the chase.

11. The headboard of claim 1, further comprising a toe-kick at a bottom of the multiple back panels.

* * * * *